US006787295B1

(12) United States Patent
Nakanishi et al.

(10) Patent No.: US 6,787,295 B1
(45) Date of Patent: Sep. 7, 2004

(54) PHOTOGRAPHIC SOLID FINE-GRAIN DISPERSION, METHOD FOR PREPARING THE SAME, AND SILVER HALIDE PHOTOGRAPHIC LIGHT-SENSITIVE MATERIAL

(75) Inventors: Masatoshi Nakanishi, Minami-ashigara (JP); Yoshihito Hodosawa, Fujinomiya (JP); Yuko Saito, Minami-ashigara (JP); Nagahiko Tanaka, Odawara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/409,680

(22) Filed: Sep. 30, 1999

(30) Foreign Application Priority Data

Sep. 30, 1998 (JP) ..... 10-291359
Mar. 30, 1999 (JP) ..... 11-088032

(51) Int. Cl.[7] ..... G03C 1/08; G03C 7/32; G03C 7/26

(52) U.S. Cl. ..... 430/546; 430/512; 430/517; 430/519; 430/521; 430/522; 430/631

(58) Field of Search ..... 430/546, 521, 430/512, 522, 517, 377, 519, 520, 493, 631; 451/97; 241/46.17

(56) References Cited

U.S. PATENT DOCUMENTS 4,620,673 A 11/1986 Canepa et al.
5,474,237 A 12/1995 Bishop et al.
5,478,705 A * 12/1995 Czekai et al. ..... 430/449
5,500,331 A * 3/1996 Czekai et al. ..... 430/449
5,589,322 A * 12/1996 Lobo et al. ..... 430/449
5,750,323 A * 5/1998 Scaringe et al. ..... 430/512
5,882,246 A 3/1999 Inkyo et al.

* cited by examiner

*Primary Examiner*—Thorl Chea
(74) *Attorney, Agent, or Firm*—Birch, Stewart, Kolasch & Birch, LLP

(57) ABSTRACT

There is disclosed a method of preparing a photographic solid fine-grain dispersion, the method comprising the steps of: successively bringing a slurry of a water-insoluble photographically useful compound in a grinding chamber of a dispersing machine, which chamber is filled with media, allowing the compound to contact the media in the grinding chamber, to produce fine grains of the compound successively, successively separating the media from the compound by centrifugal force, and taking the compound out of the grinding chamber, using specific media with given physical properties. There is also disclosed a dispersion obtained by the method. According to the method, the photographic solid fine-grain dispersion is prepared efficiently, without coarse grains or abrasion materials resulting from media or so, and the dispersion causes no defect when coated in a form of a coating film.

8 Claims, 1 Drawing Sheet

PHOTOGRAPHIC SOLID FINE-GRAIN DISPERSION, METHOD FOR PREPARING THE SAME, AND SILVER HALIDE PHOTOGRAPHIC LIGHT-SENSITIVE MATERIAL

FIELD OF THE INVENTION

The present invention relates to a solid fine-grain dispersion of a water-insoluble photographically useful compound, and to a method for preparing the same, and further to a silver halide photographic light-sensitive material using the same.

BACKGROUND OF THE INVENTION

Examples of a water-insoluble photographically useful compound include a dye image-forming coupler, a dye image-providing redox compound, an antistain agent, an antifoggant, an ultraviolet absorber, an antifading agent, a color-mix-preventing agent, a nucleating agent, a silver halide solvent, a bleach-accelerator, a developing agent, a filter dye and a precursor thereof, a dyestuff, a pigment, a sensitizing agent, a hardener, a whitening agent, a desensitizing agent, an antistatic agent, an antioxidant, a developer scavenger, a mordant, a matte (matting) agent, a development accelerator, a development inhibitor, a heat solvent, a color-tone modifier, a sliding (slipping) agent, and a polymer latex for dispersion that is used as a medium for dispersing these compounds, and a water-insoluble inorganic salt (e.g. zinc hydroxide). These water-insoluble photographically useful compounds are used in a photographic emulsion layer or another layer, as an aqueous dispersion or hydrophilic colloid dispersion of a solid fine-grain dispersion thereof. The above-described water-insoluble photographically useful compounds are described in, for example, Research Disclosure (R.D.) No. 17643, ibid. No. 18716, and ibid. No. 307105. As an example of these materials, a solid fine-grain dispersion of dyestuff is often used in a photographic emulsion layer or another layer for coloration, in order to absorb light in a specific wavelength region, and to thereby improve color reproduction and sharpness, etc. Such a colored layer is called a filter layer, an antihalation layer, a crossover-cut filter layer, or so on, depending on its purpose. Further, photographic emulsion layers have been colored in order to prevent irradiation. It is necessary for these solid fine-grain dispersions to be held (fixed) in an intended layer of the photographic coating membrane, and further for them to be sufficiently fine to the thickness of the layer.

Such a solid fine-grain dispersion of the photographically useful compound can be prepared by an ordinary method. Details of the method are described in, for example, "Kinosei Ganryo Oyo Gijutsu (Applied Technology of Functional Dyes), published by C. M. C. (1991).

The media dispersion method is one of ordinary methods. According to the method, a powder of a dye or a dye wetted with water or an organic solvent, which is called a wet cake, is mixed with a solvent to make a slurry, and then the resultant mixture is mechanically pulverized (ground) in the presence of dispersion media (e.g. steel balls, ceramic balls, glass beads, alumina beads, zirconia silicate beads, zirconia beads, Ottawa sand), using a known pulverizer (e.g. a ball mill, a vibration ball mill, a planetary ball mill, an agitation ball mill, an annular-type ball mill, a vertical sand mill, a roller mill, a pin-type mill, a spike mill, a co-ball mill, a caddy mill, a horizontal sand mill, an attritor).

These dispersing tools are described in, for example, "Kagaku Kogaku Binran (Handbook of Chemical Engineering)," published by Maruzen, Revised 5th edition.

Of these media dispersion methods, the most generally used method for preparing fine grains of a photographically useful compound comprises the steps of:

- successively bringing (introducing) a slurry of the compound in a milling (grinding) chamber of a dispersing machine, which chamber is filled with media,
- allowing the compound to contact with the media in the grinding chamber, thereby finely pulverizing the compound, and then
- separating the media from the fine-grained compound by means of a screen, a gap, a slit, a mesh, or the like. This method is excellent in such points as productivity, wide usability, attainability of small grain size of the dispersed grains, and simplicity of a manufacturing process.

However, in this method, there are such problems as that, because mechanical energy is used, the energy required to pulverize a material is large; that only a part of the applied energy is used for pulverization, and the rest, which is the majority, is given off as thermal energy; that, because machine parts and media collide with each other, thereby causing abrasion, the resultant abrasion materials get mixed in the completed dispersion, which results in deterioration of property; that, because the grain size distribution of the dispersion is wide, coarse grains are likely to remain; and that, if the supplied energy is increased so as to rapidly progress pulverization and to obtain fine grains, not only the above-described generation of heat and abrasion increase, but also mixing in of a large amount of abrasion materials takes place.

In particular, a dispersion of a photographically useful compound is coated on a support (base) as an extremely thin colloid layer. Recently, a tendency to make a thin layer and high-speed coating of the colloid layer is increasingly progressing. In this case, such problems (defects) as pin holes and unevenness due to abrasion materials that will get mixed in a colloid layer, are actualized.

Media that have been used include, for example, steel balls, Ottawa sand, glass beads, dealkali glass beads, alumina beads, zircon beads, zirconia beads, and so on. Further, the grain size thereof has been generally 0.4 mm or more.

Of these media, it is known that steel balls cause metallic abrasion materials that result in defects when a dispersion is coated on a film, and they also cause coloring and an unpreferable chemical reaction. Ottawa sand, glass beads, and dealkali beads each have not only a defect due to dispersed abrasion material but also a possibility that an alkali component or a metal salt resulting from the abrasion, decomposes or aggregates a dispersion. On the other hand, alumina beads, zircon beads, and zirconia beads are hard, and each has a high bulk density, so that a great amount of energy can be applied to the dispersion, which results in a high dispersion efficiency. However, because the machine parts of the dispersing machine are worn out, abrasion-resistant ceramic or polymeric materials have been used as a material of the machine part.

However, recently such needs as improvement of the dispersion efficiency and reduction of the dispersion grain size are increasing. Therefore, if energies are increased (a round speed and a filling rate are increased), there is such a possibility that even using hard beads, an increase in abrasion and/or generation of heat occurs, thereby raising a problem about quality and the process of production.

As a method of reducing an abrasion material, while increasing productivity, and accomplishing reduction in coarse grains by rendering the grains more fine, an attempt to make the average grain size of the media small has been made. Usually the media and a dispersion are separated from each other by means of a screen, a gap, a slit, a mesh, and so on. In these methods, there are such drawbacks that a material of the separating part tends to be worn out, and the separating part is easily plugged (clogged) as the grain size of the media becomes smaller. Further, especially when a gap is used, a space that is smaller than the grain size of the media must be maintained, so that both high processing accuracy and control accuracy are required. Accordingly, there is a problem that a large-sized dispersing machine is difficult to manufacture.

Further, a method of dispersing a material using a polymeric material or fine grains thereof, as the media, followed by separation after dispersion, is also proposed. Such a method is described in, for example, U.S. Pat. Nos. 5,500,331, 5,679,138, and 5,662,279, and, European Patent (EP) Nos. 684508A and 684519A. However, these methods have such drawbacks that both the hardness and density of the media are low, and the dispersion speed is slow, and abrasion of the polymer occurs.

As a method of preventing beads from clogging, there are proposed methods of rotating a screen, or applying thereto vibration, as described in, for example, Utility Model Registration No. 3006047, JP-A-63-65959 ("JP-A" means unexamined published Japanese patent application), JP-A-10-116512, and JP-A-8-252472. These methods are not to prevent the media itself from reaching the screen, but an attempt to mechanically reduce the probability that the media becomes plugged even though the media have reached the screen. Consequently, it is difficult to say that the effects obtained thereby are satisfactory.

SUMMARY OF THE INVENTION

An object of the present invention is to provide a method of efficiently preparing a photographic solid fine-grain dispersion, wherein neither coarse grains nor abrasion materials resulting from media or so on exist, and moreover no aggregate occurs during storage, and which dispersion causes no trouble when the same is coated in a form of the coating film. Another object of the present invention is to provide such a dispersion.

Still another object of the present invention is to provide a silver halide photographic light-sensitive material using such a dispersion.

Other and further objects, features, and advantages of the invention will appear more fully from the following description, taken in connection with the accompanying drawings.

DETAILED DESCRIPTION OF THE INVENTION

Figure 1:
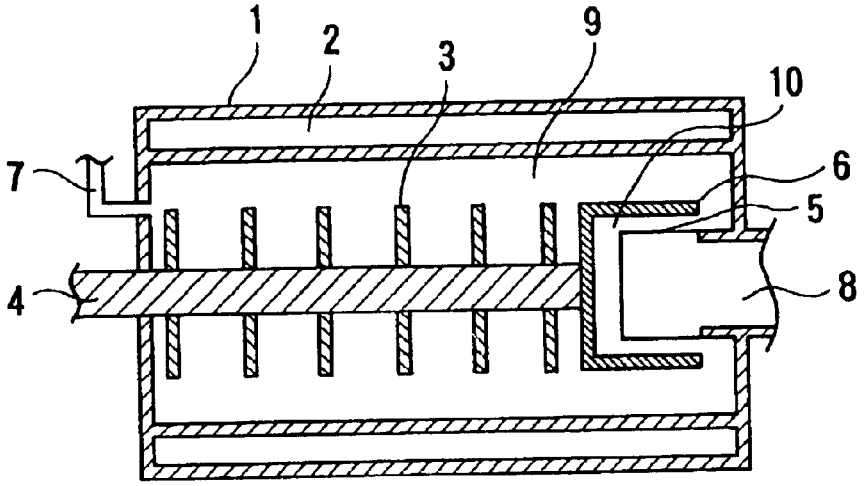
FIG. 1 is a schematic structural view of a grinder in a dispersing machine of the type, in which an overcap is provided in the vicinity of a screen to impart media centrifugal force, thereby returning the media from a media-separating chamber to a grinding chamber,and in the same time, the media is separated with the screen.

As a result of intensive investigation, the present inventors have found that the above-described objects can be accomplished by the following means. That is, according to the present invention, there are provided:

(1) A method of preparing a photographic solid fine-grain dispersion, the method comprising the steps of:
- successively bringing a slurry of a water-insoluble photographically useful compound in a grinding chamber of a dispersing machine, which chamber is filled with media,
- allowing the compound to contact the media in the grinding chamber, to produce fine grains of the compound successively,
- successively separating the media from the compound by centrifugal force, and
- taking the compound out of the grinding chamber,
- wherein the bulk density of the media is 4.0 g/cm$^3$ or more, the Vickers hardness thereof is 10 GPa or more, the breaking tenacity thereof is 5 MPa·m$^{1/2}$ or more, and the average grain size thereof is 0.3 mm or less;

(2) The method of preparing a photographic solid fine-grain dispersion as described in the above item (1), wherein the dispersion machine has such a mechanism that the same comprises a cylindrical container having a feed port and a discharge port for slurry, a screen covering the discharge port and projecting inward a dispersing container, and a rotatable shaft equipped (installed) with a plurality of stirrers; wherein at the feed port side of the cylindrical container, the grinding chamber filled with the media is arranged, and at the discharge port side of the cylindrical container, a media-separating chamber in which substantially no media exist, is arranged, respectively; wherein a disc-like rotor mounted on the rotatable shaft at the closest side to the discharge port is equipped with a stirrer member, the tip of which extends to the vicinity of a lateral face at the discharge port side of the screen; wherein, by rotation of the stirrer member, centrifugal force is applied to the media introduced into the separating chamber, and thereby the media is returned to the grinding chamber;

(3) The method of preparing a photographic solid fine-grain dispersion as described in the above item (1), wherein the dispersing machine comprises a grinding chamber filled with beads and having a feed port and a discharge port for slurry, a rotatable shaft equipped with an stirrer, and a media-separating chamber containing substantially no media, which chamber is separated by a wall from the grinding chamber and which chamber is installed with an impeller that applies by rotation a centrifugal force to the media introduced into the separating chamber to return the media to the grinding chamber taking out the slurry through a discharge passage formed in the rotatable shaft;

(4) The method of preparing a photographic solid. fine-grain dispersion as described in any one of the above items (1) to (3), wherein the member that contacts the media of the dispersing machine, is composed of a material selected from a ceramic whose main component is substantially a zirconia or an alumina, a polyurethane, a polytetrafluoroethylene (Teflon, trade name), and a polyethylene;

(5) A photographic solid fine-grain dispersion, which is obtained by the preparation method as described in any one of the above items (1) to (4);

(6) The photographic solid fine-grain dispersion as described in the above item (5), wherein the media and/or foreign matters resulting from the dispersing machine are contained in an amount of 100 ppm or less, in terms of the weight ratio in the dispersion;

(7) The photographic solid fine-grain dispersion as described in the above item (5) or (6), wherein the water-insoluble photographically useful compound is a compound represented by general formula (I):

$$D—(X)_y \qquad \text{General formula (I)}$$

Wherein, in general formula (I), D represents a residue of a compound having a chromophore; X represents a dissociating hydrogen atom, or a group having a dissociating hydrogen atom; and y represents an integer of 1 to 7;

(8) The photographic solid fine-grain dispersion as described in any one of the above items (5) to (7), which further contains a water-soluble synthetic high-molecular compound;

(9) The photographic solid fine-grain dispersion as described in the above item (8), wherein the synthetic high-molecular compound is an anionic high molecule;

(10) The photographic solid fine-grain dispersion as described in the above item (8) or (9), wherein the number-average molecular weight of the high-molecular compound is in the range of 2000 to 12000;

(11) The photographic solid fine-grain dispersion as described in the above item (9) or (10), wherein the high-molecular-weight compound is a compound containing a recurring (repeating) unit of a monomer represented by general formula (II):

General Formula (II)

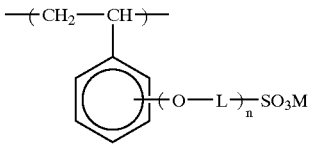

wherein L represents an aliphatic divalent group having 1 to 50 carbon atoms, M represents a hydrogen atom or a monovalent cation, and n represents 0 or 1.

(12) A coating composition for a silver halide photographic light-sensitive material, which composition comprises the photographic solid fine-grain dispersion as described in any one of the above items (5) to (11); and

(13) A silver halide photographic light-sensitive material having at least one light-sensitive silver halide emulsion layer on a support, which comprises the photographic solid fine-grain dispersion as described in any one of the above items (5) to (11).

The term "a water-insoluble photographically useful compound" that can be used in the method of the present invention, means any kind of organic compounds that are useful for a photographic use, and organic or inorganic dyestuffs and pigments. Further, the term "water-insoluble" used in the present specification means a situation in which, when a necessary amount of the photographically useful compound is added to a photographic element, the whole amount of the compound cannot be added to the coating solution as an aqueous solution, for lack of solubility, even though the coating solution is diluted to the limiting concentration of the range in which a coating is possible. The water-insolubility means that solubility is generally 10 or less, and preferably 5 or less, to 100 g of water at 20° C.

Examples of the water-insoluble photographically useful compound to which the present invention can be applied, include a dye image-forming coupler, a dye image-providing redox compound, an antistain agent, an antifoggant, an ultraviolet absorber, an antifading agent, a color-mix-preventing agent, a nucleating agent, a silver halide solvent, a bleaching accelerator, a developing agent, a filter dye and a precursor thereof, a dyestuff, a pigment, a sensitizing agent, a hardener, a whitening agent, a desensitizing agent, an antistatic agent, an antioxidant, a developer scavenger, a mordant, a matte agent, a development accelerator, a development inhibitor, a heat solvent, a color-tone modifier, a sliding agent, and a polymer latex for dispersion which is used as a medium for dispersing thereof, and a water-insoluble inorganic salt (e.g., zinc hydroxide). These compounds are described in, for example, Research Disclosure (R.D.) No. 17643, ibid. No. 18716, and ibid. No. 307105.

As a dyestuff or a pigment to which the present invention can be applied, can be mentioned azo-series, azomethine-series, oxonol-series, cyanine-series, phthalocyanine-series, quinacridone-series, anthraquinone-series, dioxazine-series, indigo-series, perynone/perylene-series, titanium oxide, cadmium-series, iron oxide-series, chromium oxide, carbon black organic dyestuffs (pigments) or inorganic dyestuffs (pigments), but not limited thereto. In addition, as a coloring agent, can be applied any of publicly known dyes, which have conventionally been used, or a mixture thereof. In the present invention, these dyestuffs (pigments) can be used in any of the states such as an aqueous paste state just after the preparation, or a powder state. The dyestuffs that can be used in the present invention are preferably those represented by the following general formula (I).

$$D—(X)_y \qquad \text{General formula (I)}$$

In general formula (I), D represents a residue of the compound having a chromophore; X represents a dissociating hydrogen atom, or a group having a dissociating hydrogen atom; and y represents an integer of 1 to 7. The dye represented by general formula (I) for use in the present invention is characterized in that the dye has a dissociating hydrogen atom or so on, in its molecular structure. That the dye has a dissociating hydrogen atom, or a group having a dissociating hydrogen atom in its molecular structure, is preferred from a viewpoint that the dye is decolored and removed at the time of a development processing.

The compound having a chromophore in the group D is not limited in particular, and therefore it can be selected from various kinds of publicly known dyes. Examples of these compounds include oxonol dyes, merocyanine dyes, cyanine dyes, arylidene dyes, azomethine dyes, triphenylmethane dyes, azo dyes, anthraquinone dyes, and indoaniline dyes.

The dissociating hydrogen atom or the group having a dissociating hydrogen atom represented by X, has such a characteristics that the atom or group is of non-dissociation in the state when the dyestuff represented by general formula (I) has been added to a silver halide photographic light-sensitive material of the present invention, thereby making the dyestuff of general formula (I) substantially water-insoluble; whereas the atom or group dissociates in the working step when said light-sensitive material is subjected to development, to make the compound of general formula (I) substantially water-soluble. Examples of the group having a dissociating hydrogen atom represented by X include groups having a carboxylic acid group, a sulfonamide group, a sulfamoyl group, a sulfonylcarbamoyl group, an acylsulfamoyl group, a phenolic hydroxyl group, and so on. Exemplary dissociating hydrogen atom represented by X includes, for example, a hydrogen atom of the enol group in an oxonol dye.

A substituent which each of the above-described groups may have, is not limited in particular, unless the substituent imparts the compound of general formula (I) substantial solubility in water having a pH of 5 to 7. Examples of the substituent include a carboxylic acid group, a sulfonamido group having 1 to 10 carbon atoms (e.g., methanesulfonamido, benzenesulfonamido, butanesulfonamido, n-octanesulfonamido), an unsubstituted, or alkyl- or aryl-substituted sulfamoyl group having 0 to carbon atoms (e.g., unsubstituted sulfamoyl, methylsulfamoyl, phenylsulfamoyl, naphthylsulfamoyl, butylsulfamoyl), a sulfonylcarbamoyl group having 2 to 10 carbon atoms (e.g., methanesulfonylcarbamoyl, propanesulfonylcarbamoyl, benzenesulfonylcarbamoyl), an acylsulfamoyl group having 1 to 10 carbon atoms (e.g., acetylsulfamoyl, propionylsulfamoyl, pivaloylsulfamoyl, benzoylsulfamoyl), a chain or cyclic alkyl group having 1 to 8 carbon atoms (e.g., methyl, ethyl, isopropyl, butyl, hexyl, cyclopropyl, cyclopentyl, cyclohexyl, 2-hydroxylethyl, 4-carboxybutyl, 2-methoxyethyl, benzyl, phenethyl, 4-carboxybenzyl, 2-diethylaminoethyl), an alkenyl group having 2 to 8 carbon atoms (e.g., vinyl, allyl), an alkoxy group having 1 to 8 carbon atoms (e.g., methoxy, ethoxy, butoxy), a halogen atom (e.g., F, Cl, Br), an amino group having 0 to 10 carbon atoms (e.g., unsubstituted amino, dimethylamino, diethylamino, carboxyethylamino), an ester group having 2 to 10 carbon atoms (e.g., methoxycarbonyl), an amido group having 1 to 10 carbon atoms (e.g., acetylamino, benzamido), a carbamoyl group having 1 to 10 carbon atoms (e.g., unsubstituted carbamoyl, methylcarbamoyl, ethylcarbamoyl), an aryl group having 6 to 10 carbon atoms (e.g., phenyl, naphthyl, hydroxyphenyl, 4-carboxyphenyl, 3-carboxyphenyl, 3,5-dicarboxyphenyl, 4-methanesulfonamidophenyl, 4-butanesulfonamidophenyl), an aryloxy group having 6 to 10 carbon atoms (e.g., phenoxy, 4-carboxyphenoxy, 3-methylphenoxy, naphthoxy), an alkylthio group having 1 to 8 carbon atoms (e.g., methylthio, ethylthio, octylthio), an arylthio group having 6 to 10 carbon atoms (e.g., phenylthio, naphthylthio), an acyl group having 1 to 10 carbon atoms (e.g., acetyl, benzoyl, propanoyl), a sulfonyl group having 1 to 10 carbon atoms (eg., methanesulfonyl, benzenesulfonyl), a ureido group having 1 to 10 carbon atoms (e.g., ureido, methylureido), a urethane group having 2 to 10 carbon atoms (e.g., methoxycarbonylamino, ethoxycarbonylamino), a cyano group, a hydroxyl group, a nitro group, and a heterocyclic group (e.g., 5-carboxybenzoxazole ring, pyridine ring, sulfolane ring, pyrrole ring, pyrrolidine ring, morpholine ring, piperazine ring, pyrimidine ring, furan ring).

Specific examples of the compounds for use in the method of the present invention are shown below. However, the present invention should not be limited thereto.

(I-1)

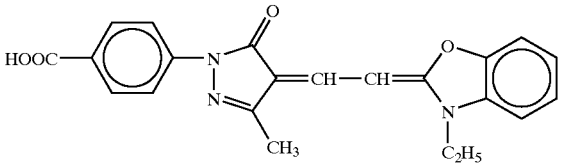

(I-2)

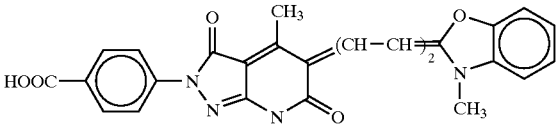

(I-3)

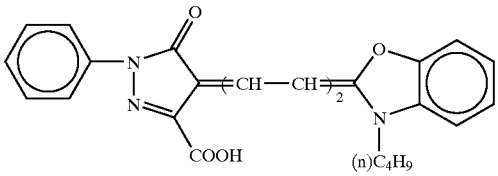

(I-4)

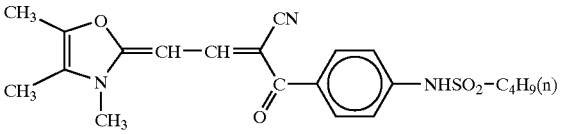

(I-5)

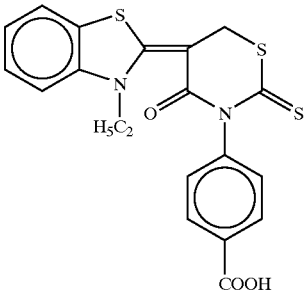

(I-6)

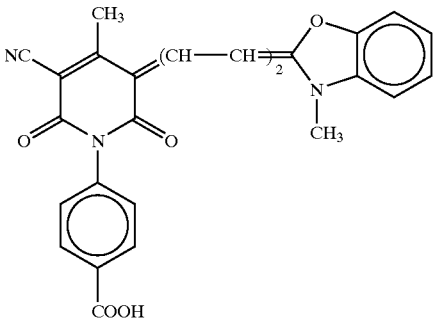

(I-7)

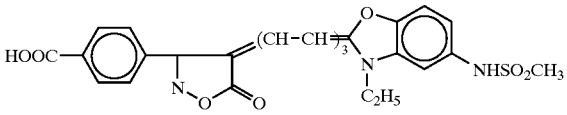

(I-8)

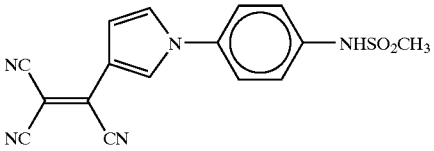

-continued
(I-9)
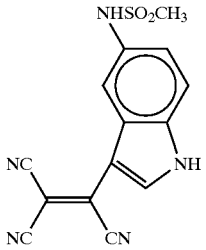
(I-10)
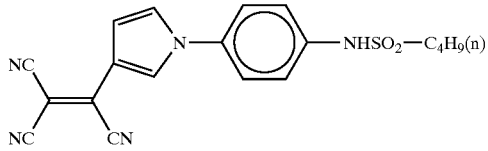
(I-11)
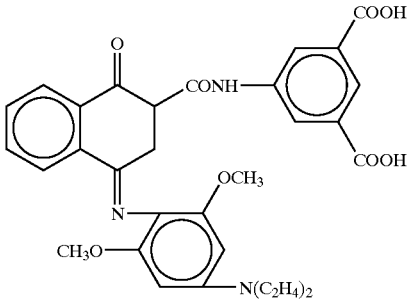
(I-12)
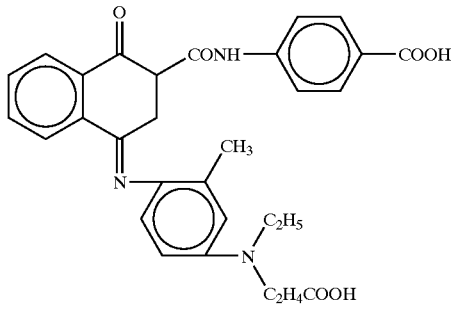
(I-13)
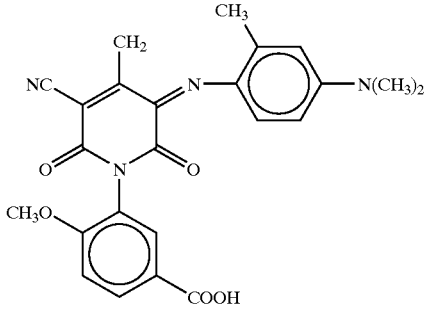
(I-14)
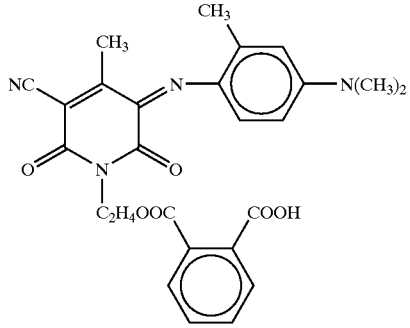
(I-15)
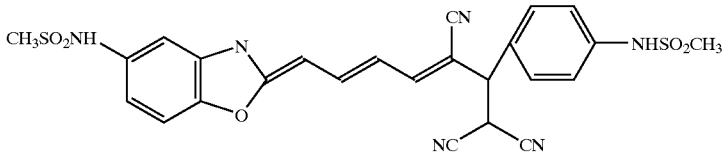
(I-16)
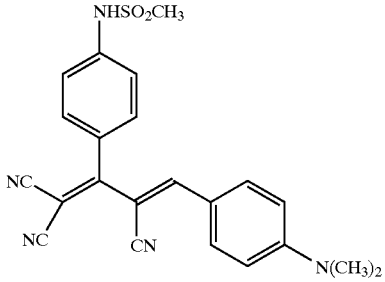
(I-17)
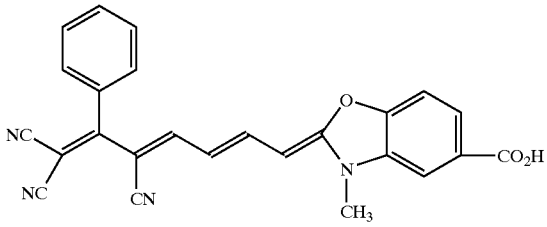
(I-18)
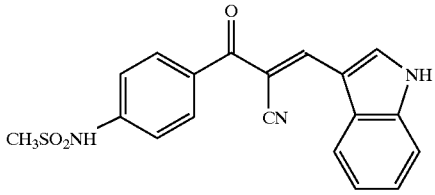
(II-1)
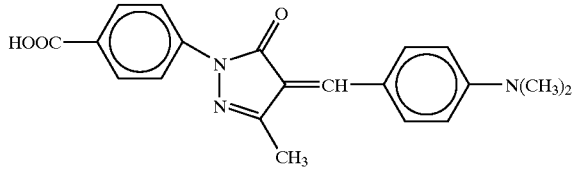

-continued
(II-2)
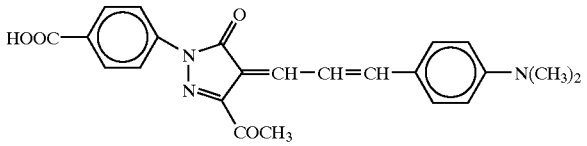
(II-3)
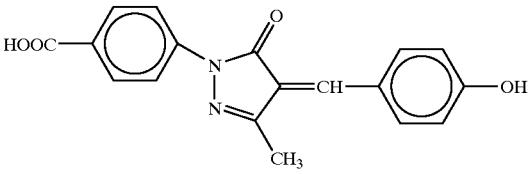
(II-4)
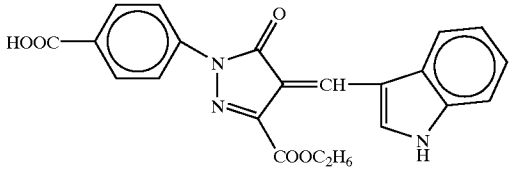
(II-5)
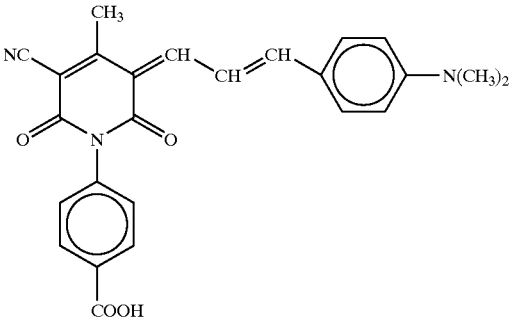
(II-6)
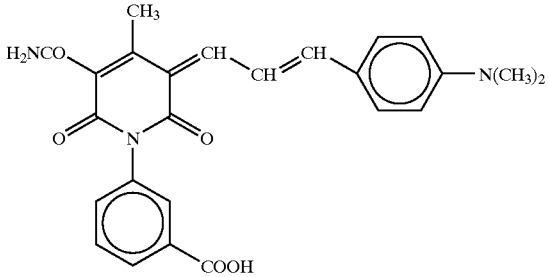
(II-7)
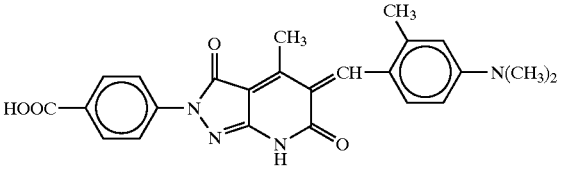
(II-8)
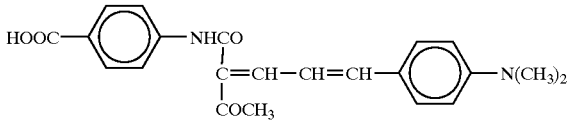
(II-9)
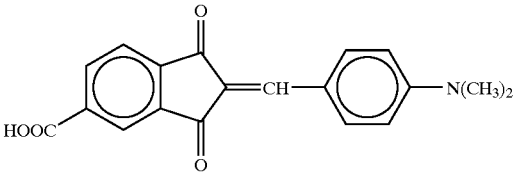
(II-10)
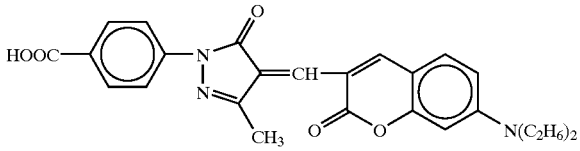
(II-11)
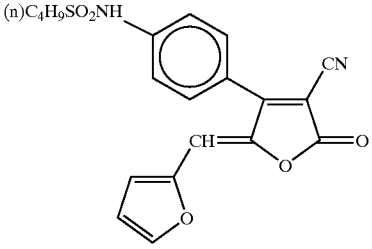
(II-12)
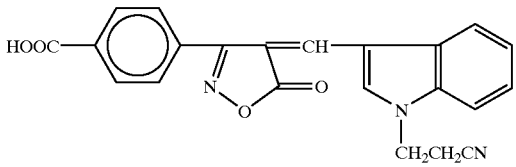
(II-13)
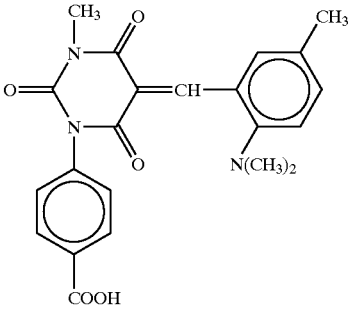

-continued
(II-14)
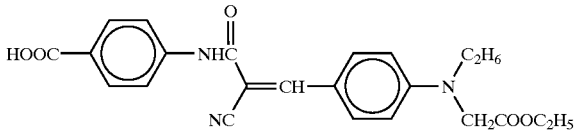
(II-15)
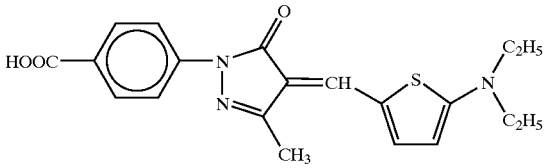
(II-16)
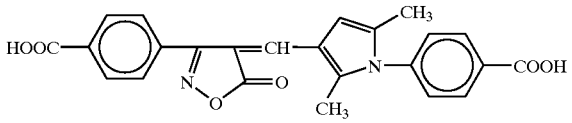
(II-17)
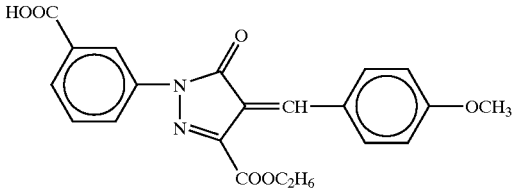
(II-18)
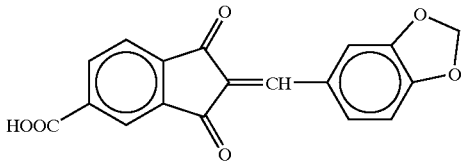
(II-19)
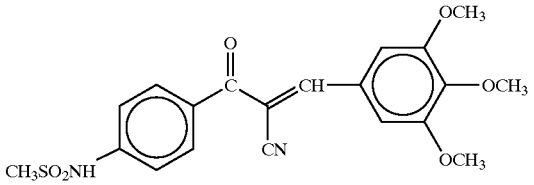
(II-20)
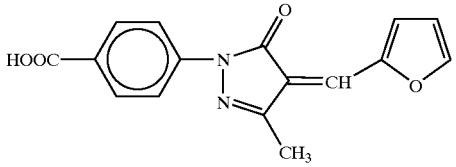
(II-21)
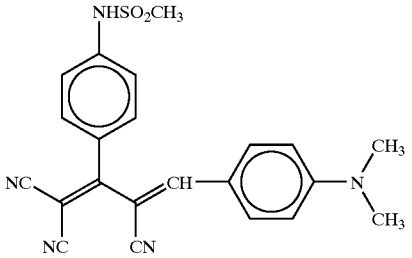
(II-22)
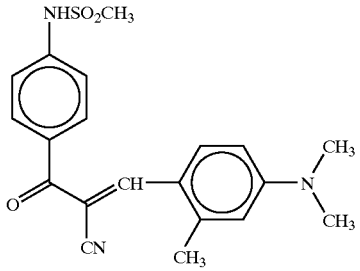
(II-23)
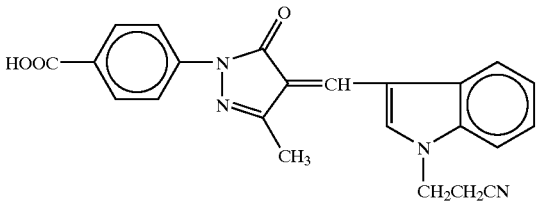
(II-24)
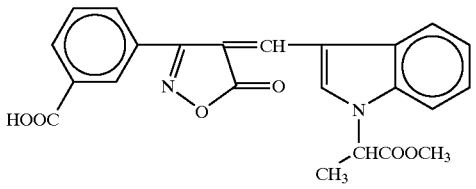
(II-25)
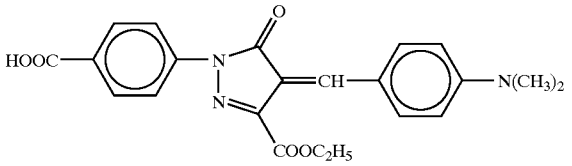

-continued
(II-26)
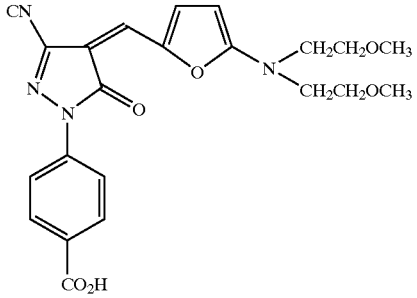
(II-27)
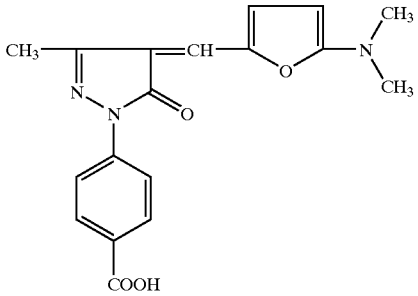
(II-28)
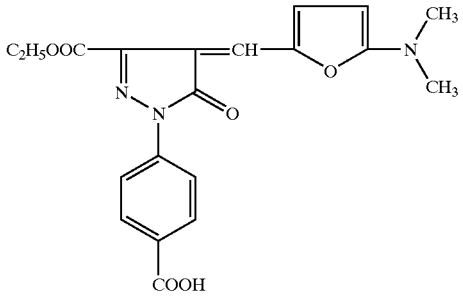
(II-29)
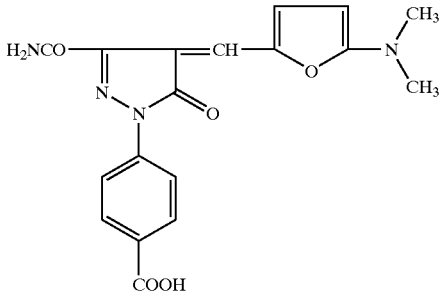
(II-30)
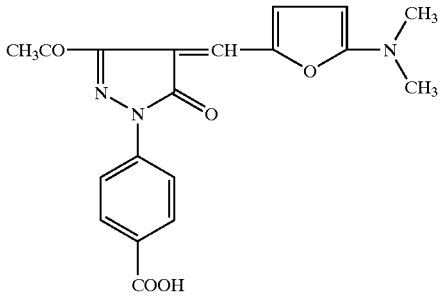
(II-31)
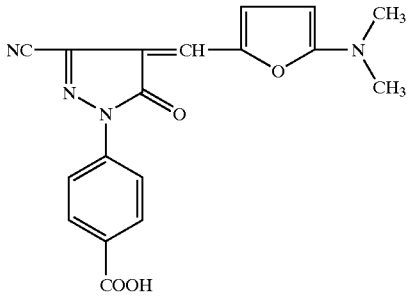
(III-1)
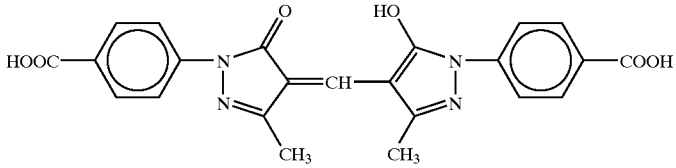
(III-2)
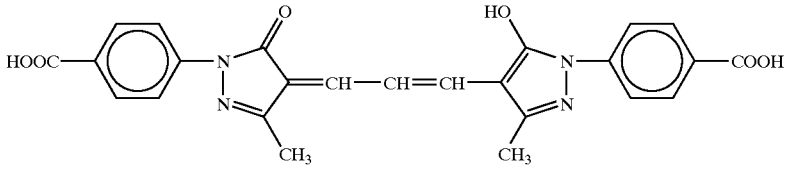
(III-3)
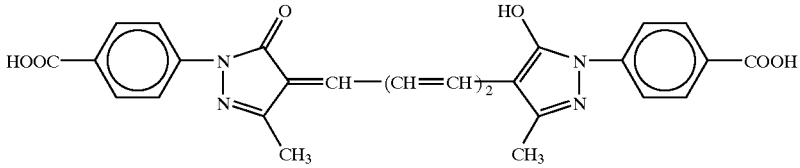
(III-4)
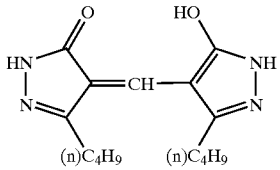
(III-5)
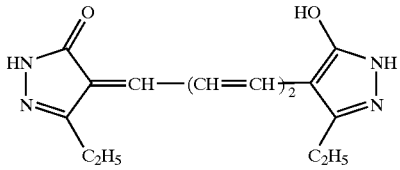

-continued
(III-6)
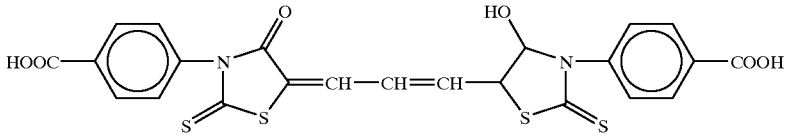
(III-7)
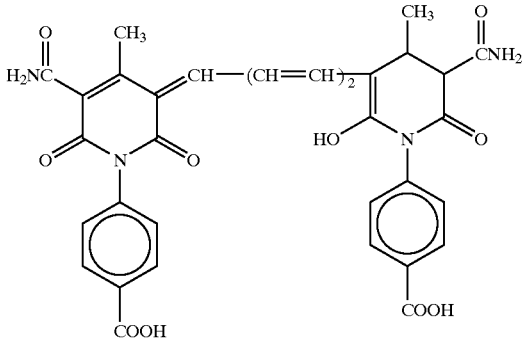
(III-8)
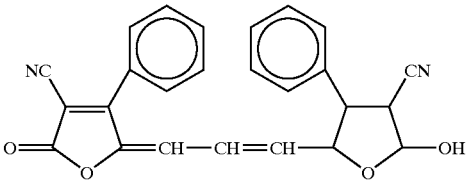
(III-9)
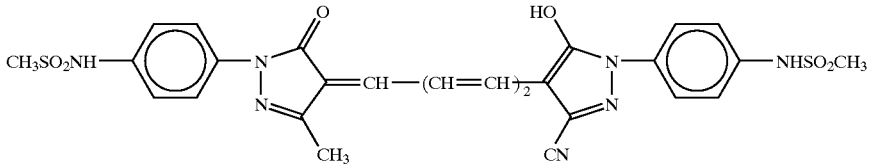
(III-10)
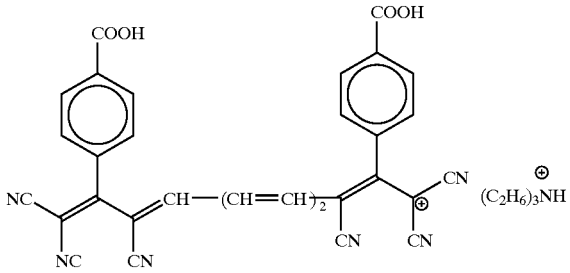
(III-11)
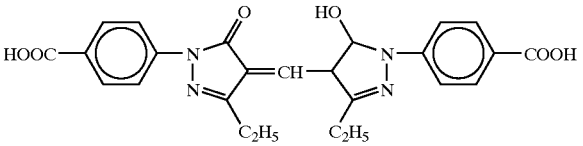
(III-12)
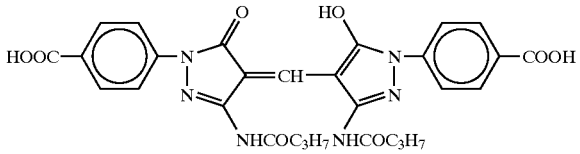
(III-13)
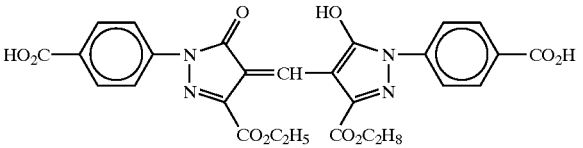
(III-14)
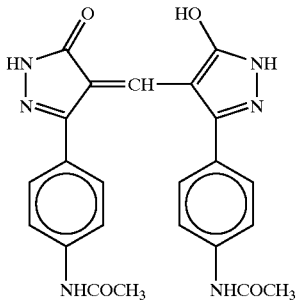
(III-15)
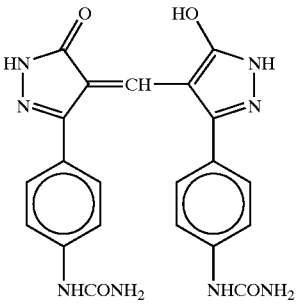

-continued
(III-16)
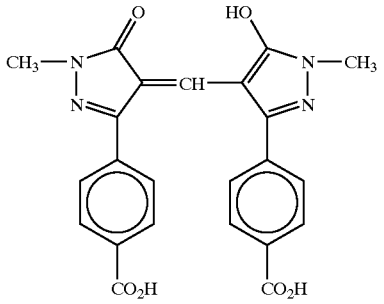
(III-17)
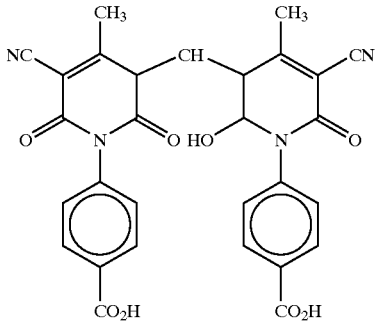
(III-18)
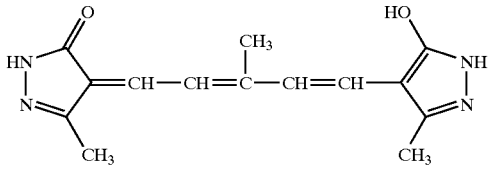
(III-19)
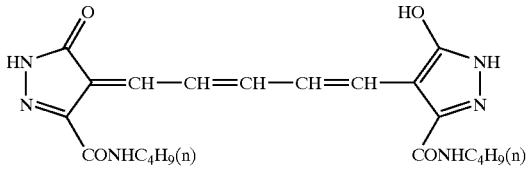
(III-20)
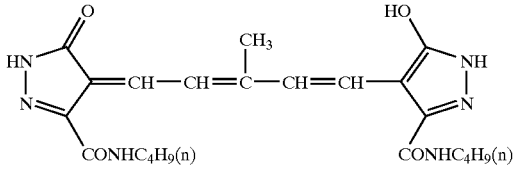
(III-21)
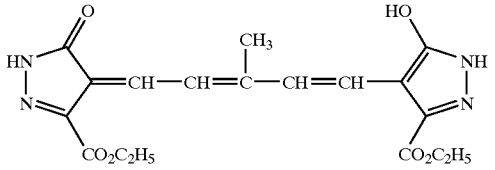
(III-22)
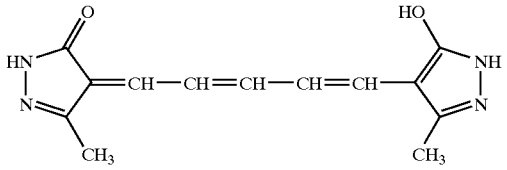
(III-23)
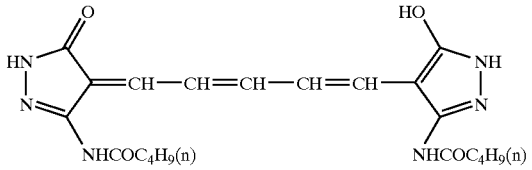
(III-24)
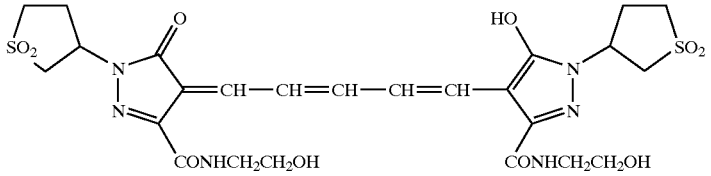
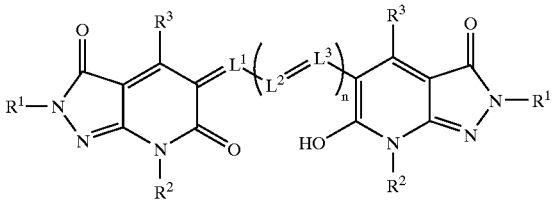
| | $R^1$ | $R^2$ | $R^3$ | $=L^1-(L^2=L^3)_n-$ |
|---|---|---|---|---|
| (III-25) | 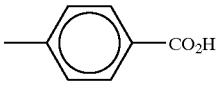 | H | $CH_3$ | =CH—CH=CH— |
| (III-26) | 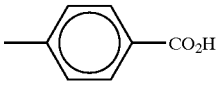 | $CH_3$ | $CH_3$ | =CH—CH=CH— |

-continued
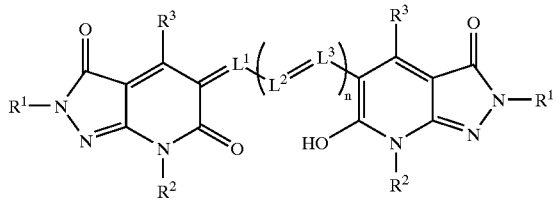
| $R^1$ | $R^2$ | $R^3$ | $=L^1(L^2=L^3)_n$ |
|---|---|---|---|
| (III-27) 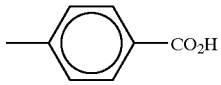 | H | $CH_3$ | 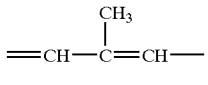 |
(III-28)
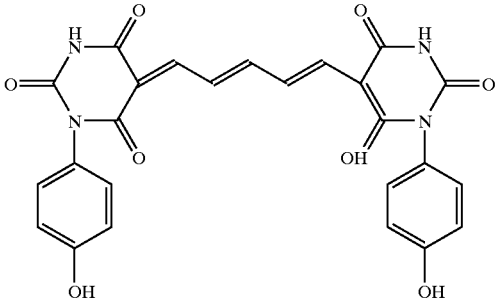
(VIII-1)
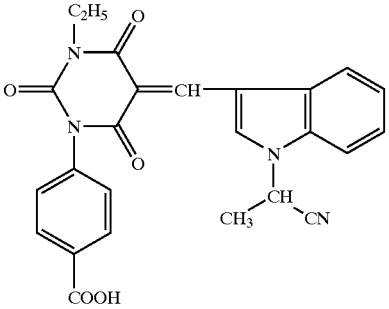
(VIII-2)
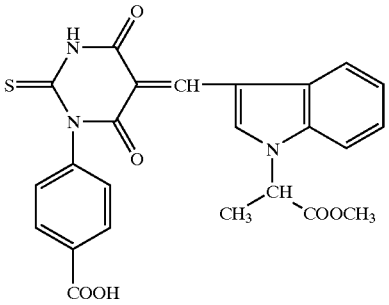
(VIII-3)
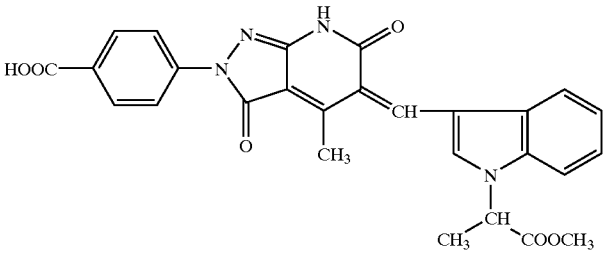

-continued
(VIII-4)
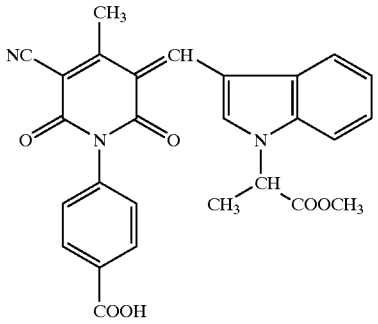
(VIII-5)
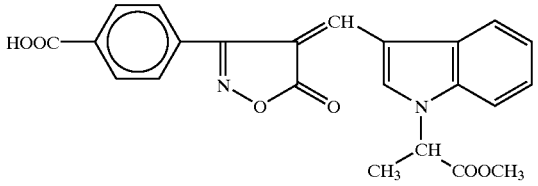
(VIII-6)
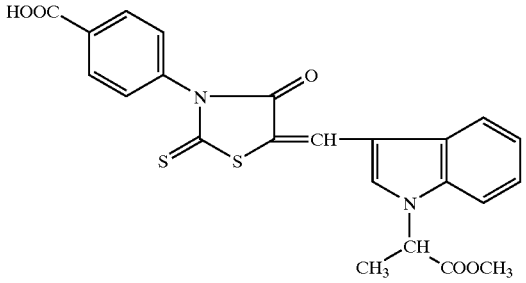
(VIII-7)
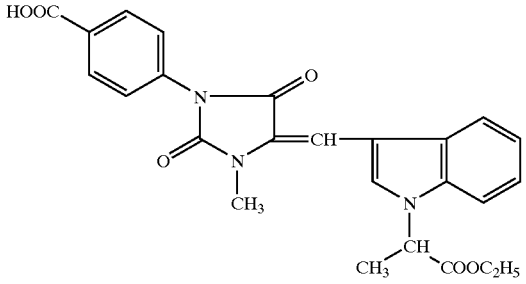
(IX-1)
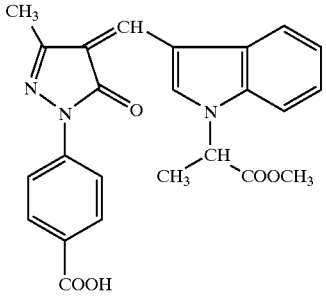
(IX-2)
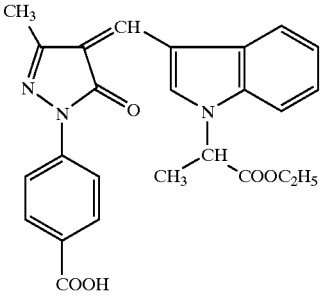

-continued
(IX-3)
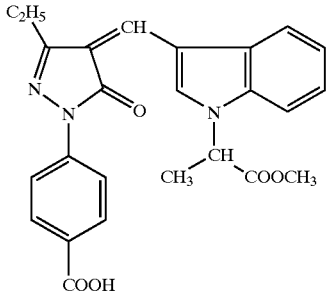
(IX-4)
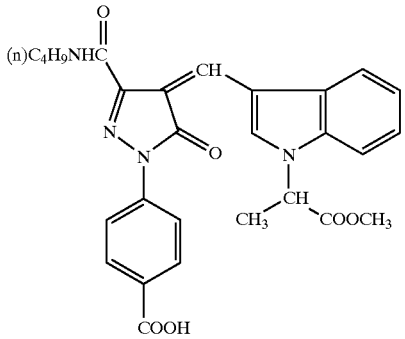
(IX-5)
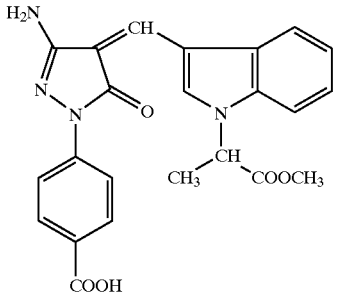
(IX-6)
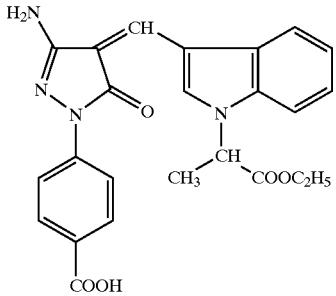
(IX-7)
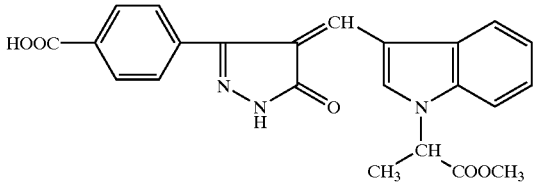
(IX-8)
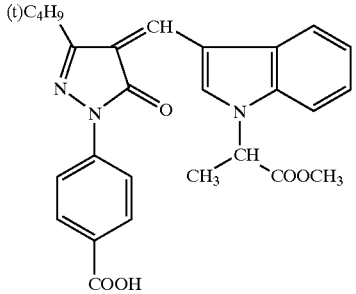
(IX-9)
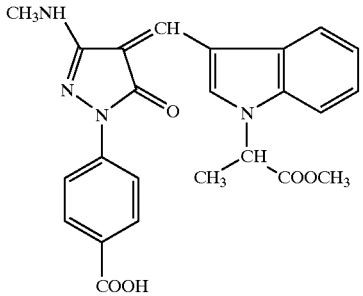
(IX-10)
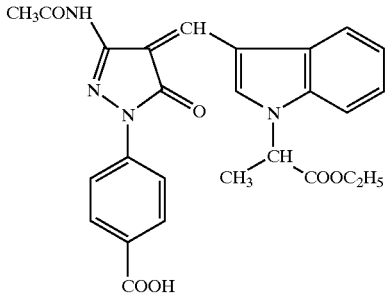
(IX-11)
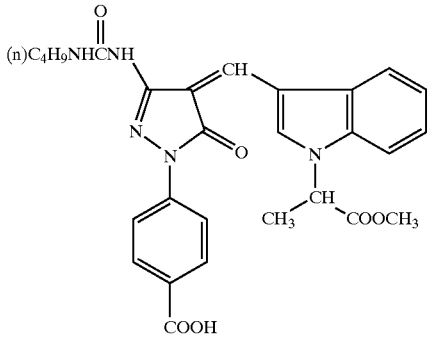
(IX-12)
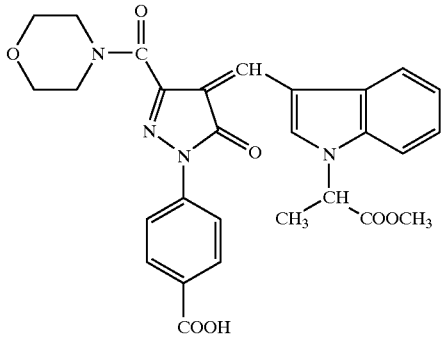

-continued
(IX-13)
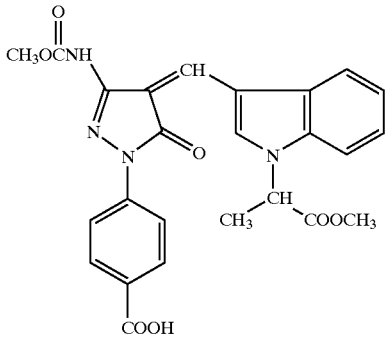
(IX-14)
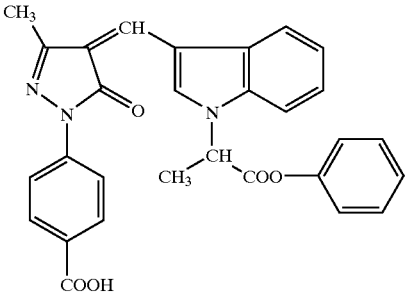
(IX-15)
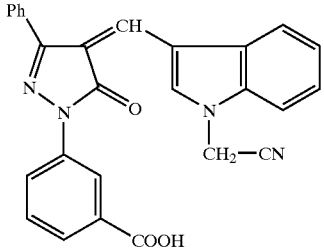
(IX-16)
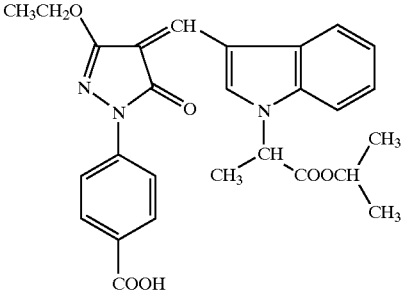
(IX-17)
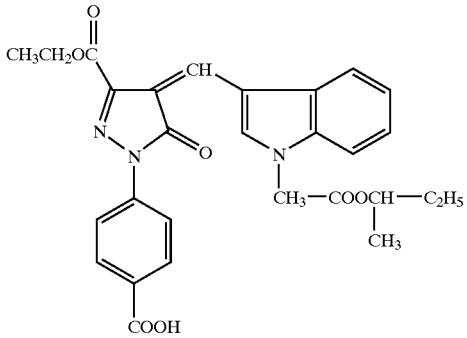
(IX-18)
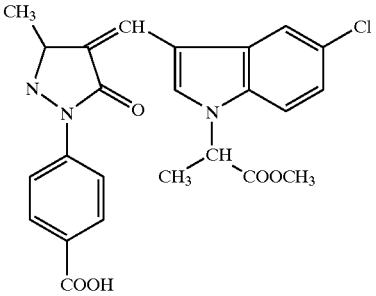
(IX-19)
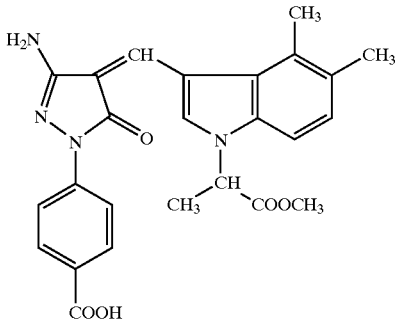
(IX-20)
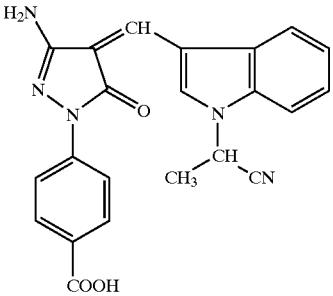
(IX-21)
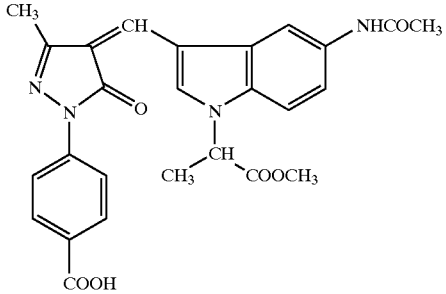
(IX-22)
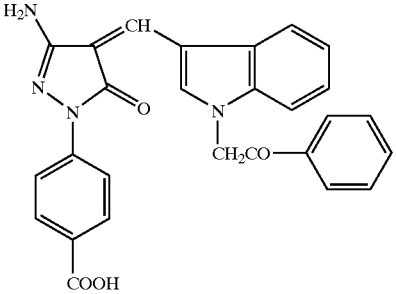

-continued
(IX-23)
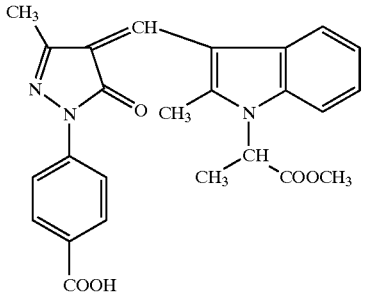
(IX-24)
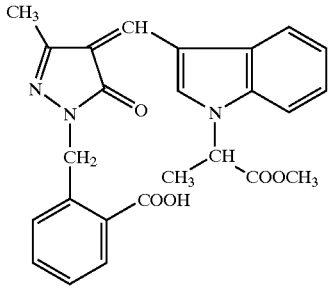
(IX-25)
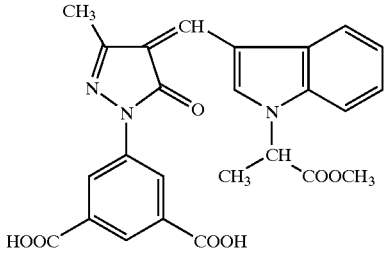
(IX-26)
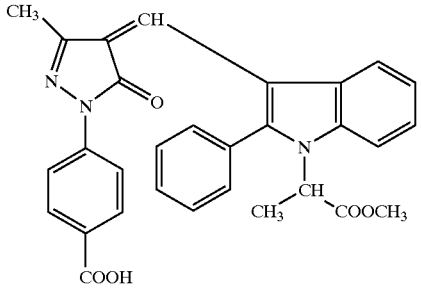
(IX-27)
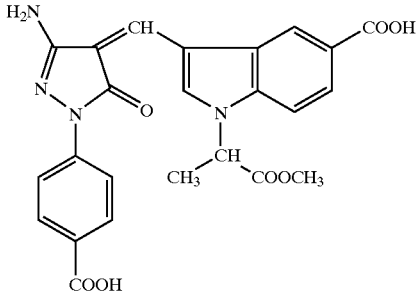
(IX-28)
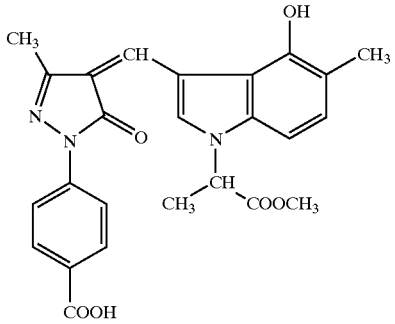
(IX-29)
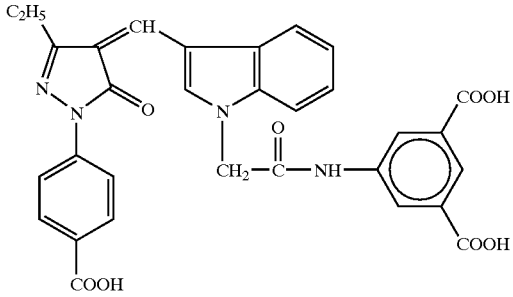
(IX-30)
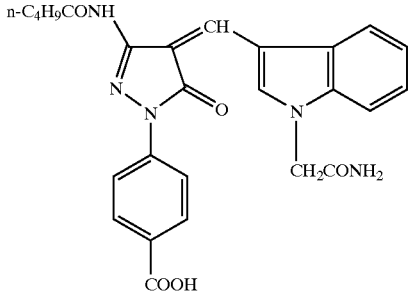
(IX-31)
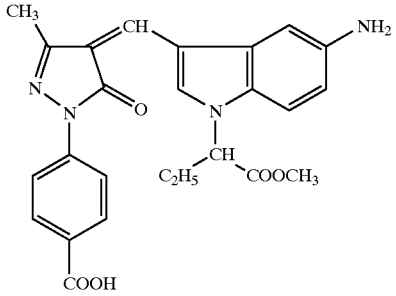
(IX-32)
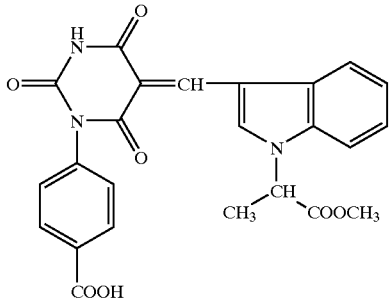

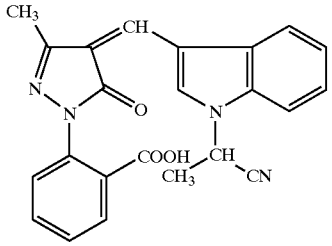

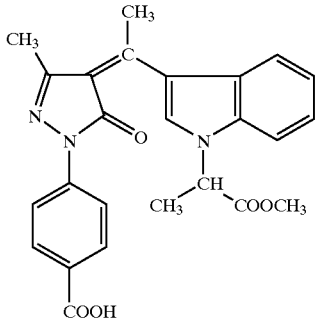

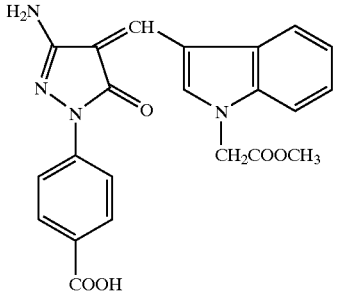

-continued (IX-33)

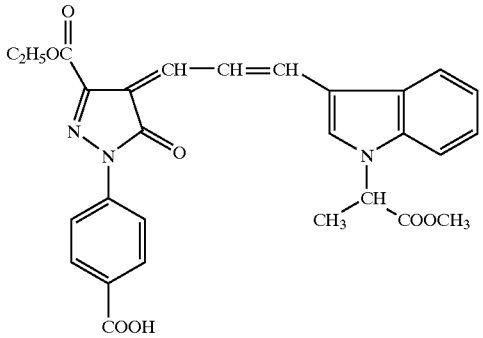

(IX-34)

(IX-35)

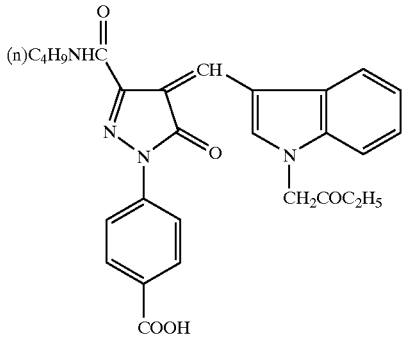

(IX-36)

(IX-37)

As a dispersing machine for use in the present invention, for example, JP-B-2-10699 ("JP-B" means examined Japanese patent publication), JP-A-6-31189, and JU-B-6-41638 ("JU-B" means examined Japanese utility model publication) disclose attempts for reducing an amount of the media that would reach a screen part, which attempts comprises rotating a rotor or a cap mounted around the screen projecting inward a dispersing machine, thereby applying centrifugal force to the media. These are effective to avoid clogging of the screen. However, even though these are used, a large amount of the media still reach the vicinity of the screen.

A further preferable dispersing machine is a machine of the type wherein a grinding chamber in which media exist and pulverizing is carried out therewith, is separated from a media-separating chamber in which the media is separated so that substantially no media exist therein. These two components are characterized in that they are contained in the same dispersing container, in which a barrier (wall) may exist or not, and in that the media entered into the media separating chamber is returned to the grinding chamber by centrifugal force of a stirrer member or an impeller provided in the separating chamber, so that substantially no media exist in the media-separating chamber. These separating machines are described in, for example, JU-B-6-41638, JU-B-7-46353, and WO 96/39251.

The method of the present invention can be preferably practiced by employing the dispersing machine shown in FIG. 1.

FIG. 1 is a sectional view of a dispersing machine. In the figure, 1 is a grinder (mill) entity, 2 is a cooling water jacket, and 3 is a dispersion stirrer (a disk for dispersion in this figure) mounted on a rotatable shaft 4. The stirrer may be a disk, a disk with a pin, an eccentric disk, a pin, or so on. 7 is a slurry take-in port (a slurry of a water-insoluble photographically useful compound). The slurry is introduced into a grinding chamber 9 filled with media to be finely pulverized by means of the dispersion stirrer 3 and the media. 8 is a take-out port for the finely ground slurry. 5 is a screen for separating the media, and the screen 5 covers the take-out port 8 for the slurry and it is projecting inward of a dispersing container. 6 is a stick-like stirrer member (an overcap) fitting to the disk which is mounted on the shaft 4 at the closest side to an outlet (discharge port). Further the overcap 6 is located in a media-separating chamber 10, and it is extending up to the vicinity of a lateral face at the outlet side of the screen 5, and also it is covering all over the surface of the screen 5. The stirrer member 6, when rotated, functions so that centrifugal force is applied to the media having entered into the media-separating chamber and the same is returned to the grinding chamber. Therefore, substantially no media exist in the media-separating chamber during dispersion. Accordingly, a screen clogging can be prevented.

The shape of the stirrer member is not limited so long as it functions as described above. For example, a blade-type or basket (cage)-type stirrer may be used.

As an example of the above dispersing machine, there is available AGITATOR KILL LMK, trade name, manufactured by Ashizawa K.K.

Figure 2:
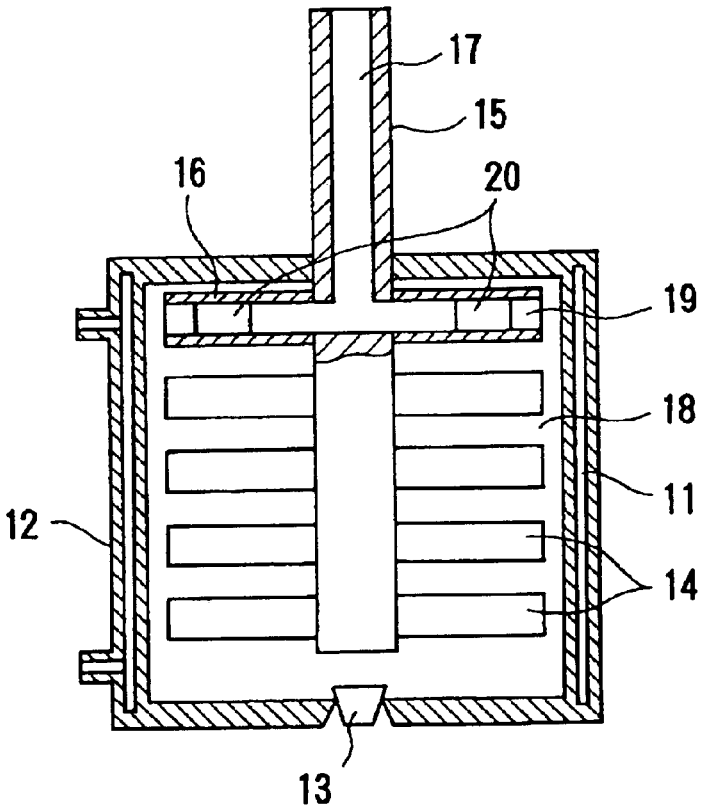
FIG. 2 is a schematic structural view of a grinder in a dispersing machine of the type, in which media is returned by centrifugal force from a media-separating chamber to a grinding chamber, and simultaneously a slurry is taken out through an axial center of the media-separating chamber.

FIG. 2 is a sectional view of another example of the dispersing machine for use in the practice of the present invention. In the figure, 11 is a cooling water jacket, 12 is a grinder (mill) entity, 14 is a dispersion stirrer (a pin in this figure) mounted on a rotatable shaft 15. The stirrer may be a disk, a disk with a pin, an eccentric disk, a pin, or so on. 13 is a slurry take-in port, and the slurry is introduced into a grinding chamber 18 filled with media to be finely pulverized by means of the dispersion stirrer 14 and the media. 16 is a media-separating chamber, which is called a sentry separator. In this example, the chamber is composed of two sheets of disks affixed on the shaft and a blade 20 sandwiched between them. By rotation thereof, the media-separating chamber serves as an impeller, and functions so that centrifugal force is applied to the media having entered into the chamber and the same is returned to the grinding chamber. Therefore, substantially no media exist in the media-separating chamber during dispersion. Finely ground slurry enters from a take-in port (feed port) 19 between the disks, and it is taken out through a slurry-discharging passage 17 provided inside of the shaft, via the sentry separator. The structure of the media-separating chamber is not limited, so long as the chamber has such a function that media having entered therein can be discharged by an impeller. For example, such an embodiment is acceptable that upper and lower disks do not rotate, but an impeller does rotate, which has been provided separately therein.

As an example of such a dispersing machine, there is available SAM, trade name, manufactured by Kotobuki Giken Industry Co., Ltd.

It is preferred that a welding part of the grinding chamber in a dispersing machine for use in the present invention be formed by a material selected from a group consisting of SiC, SiN, and ceramics which contain zirconia or alumina as a main component, with zirconia-enriched alumina being more preferred.

It is preferred that a stirrer part (e.g., disk, pin) of the dispersion machine for use in the present invention, is made of a material selected from zirconia, or a resin made of a polyurethane, a polytetrafluoroethylene (Teflon, trade name), a polyamide (Nylon, trade name), a polyethylene, a polypropylene, or an ABS.

In the method of the present invention, as the media, there can be used publicly known media for dispersion. The average grain size of the media is preferably in the range of 0.02 mm to 0.3 mm, more preferably in the range of 0.05 mm to 0.2 mm, and furthermore preferably in the range of 0.05 mm to 0.1 mm. It is possible that the grain size reduction not only reduces an excessive collision energy at the time of collision occurring among media, or between the media and the member, but also increases the number of collision, thereby improving a dispersion efficiency.

As the density of media is higher, presumably an impact force becomes larger, and also does a shearing force, and therefore an improvement of the dispersion speed can be expected. As the hardness of media is higher (more harder), assumably an impact force becomes larger, but a breaking tenacity is also an important factor to the fracture. Therefore, it is preferred that both factors of hardness and breaking tenacity be higher to some extent. As a result of intensive investigations, it has been found to be preferred that the bulk specific gravity of the media is 4.0 g/cm$^3$ or more, the Vickers hardness thereof is 10 GPa or more, and the breaking tenacity thereof is 5 MPa·m$^{1/2}$ or more. The Vickers hardness and the breaking tenacity are defined in JIS R1610 and JIS R1607 respectively.

Values of these physical properties relating main media are shown in Table 1. Zirconia has a high bulk specific gravity. Alumina has a high hardness, but a low breaking tenacity. Namely, alumina is hard, but fragile. Zircon beads are inferior in both the hardness and breaking tenacity. In contrast, zirconia beads are superior to in both of these properties of hardness and tenacity.

TABLE 1

Physical properties of various beads materials

| | Zirconia | ZS | Alumina | Glass | NS | $Si_3N_4$ |
|---|---|---|---|---|---|---|
| Bulk specific gravity (g/cm$^3$) | 5.5–6.1 | 4.6–3.8 | 3.9 | –3.2 | 3.2 | 3.2 |
| Breaking tenacity (Mpa · m$^{1/2}$) | 6–7 | 3–4 | 2–3 | 2–3 | 4–6 | 2–3 |
| Vickers hardness (GPa) | 13–14 | 7 | 16–20 | –8.8 | 13–18 | 25–28 |

As to a material of the media, zirconia is preferred, and tetragonal polycrystalline zirconia is especially preferred. These materials in which yttria, calcium oxide, magnesium oxide, alumina, or ceria is further doped, are also preferred. Those in which yttria or alumina is doped, are more preferred because they have both high strength and tenacity.

Further, the filling rate of media in the grinding chamber is preferably in the range of 70% to 90%, and more preferably in the range of 75% to 87%. Herein, the filling rate means a ratio of a volume of media having been most densely filled, said volume including a vacant space among the media, to a space volume of the interior of the grinding chamber in a dispersion machine.

In a method of the present invention, an amount of the foreign matters resulting from the media in a dispersion, or a dispersing machine, is generally 100 ppm or less, preferably 50 ppm or less, and more preferably 10 ppm or less.

As for the water-insoluble photographic solid fine-grain dispersion to which a method of the present invention is applied, a content of the solid fine-grains is preferably in the range of 3 to 60 wt. %, more preferably 20 to 60 wt. %, and furthermore preferably 32 to 45 wt. %, and the remainder is water as a dispersion medium.

Preferably these solid fine-grain dispersions are prepared in the presence of a dispersing agent (aid). Examples of conventionally known dispersing agents include anionic dispersing agents, such as an alkylphenoxyethoxyethanesulfonic acid salt, a polyoxyethylene alkylphenylether sulfonic acid salt, an alkylbenzenesulfonic acid salt, an alkylnaphthalenesulfonic acid salt, an alkylsulfonic acid ester salt, an alkylsulfosuccinic acid salt, sodium oleylmethyltauride, a formaldehyde condensation product of naphthalenesulfonic acid, polyacrylic acid, polymethacrylic acid, a copolymer of maleic acid/acrylic acid, carboxymethylcellulose, and sulfuric acid cellulose; nonionic dispersing agents, such as polyoxyethylenealkyl ether, sorbitan fatty acid ester, polyoxyethylenesorbitan fatty acid ester, and a block polymer of polyalkyleneoxide; cationic dispersing agents; and betain-series dispersing agents.

Further, a solid fine-grain dispersion may be prepared in the coexistence of a hydrophilic colloid, such as a polysaccaride and gelatin, for the purpose of the stabilization and viscosity reduction of the dispersion.

It is preferred in the present invention that a synthetic high-molecular compound be added as a dispersing agent. Exemplary high-molecular compounds include a block polymer of polyalkylene oxide. Anionic high-molecular compounds are more preferred. Examples thereof include a formaldehyde condensation product of naphthalenesulfonic acid, polyacrylic acid, polymethacrylic acid, a copolymer of maleic acid/acrylic acid, carboxymethyl cellulose, and sulfuric acid cellulose.

High-molecular compounds represented by formula II shown below are more preferred:

formula II

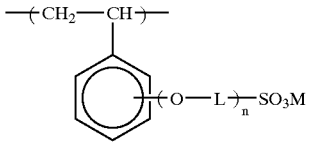

wherein L represents a divalent aliphatic group having 1 to 50 carbon atoms; M represents a hydrogen atom or a monovalent cation; and n represents 0 or 1.

Further, a number-average molecular weight thereof is preferably in the range of 2000 to 12000, and more preferably in the range of 4000 to 8000.

Generally, as a molecular weight of the dispersing agent is smaller, an adsorption speed becomes higher, and also does a dispersion speed, but desorption is also likely to occur, and therefore aggregation or so on tends to occur during storage of a dispersion solution on the other hand, high-molecular-weight dispersing agents have the advantage that stabilization due to steric repulsion is easily accomplished, but there is a possibility that they cause intertwinement among polymer chains or running dry (exhaustion) aggregate. Further, their adsorption to a new interface (surface) formed during dispersing is slow, and a dispersion speed is slow.

Compounds represented by the formula having an ionic group, a polar group, or a hydrophobic group (hydrophobic polymer main chain, aromatic ring) in their molecules, and having a number-average molecular weight of about 2,000 to about 12,000, have the advantages that a speed of their adsorption to a new interface is high, and also the adsorption is strong, and moreover steric repulsion due to a polymer chain can be expected.

In the case where a dispersion speed is extremely high as in the present invention, the adsorption speed and strength to the interface are especially important. Improvement of a dispersion speed and aggregation resistance of a dispersion agent for use in the present invention is more outstanding, compared to conventional dispersion methods.

In the present invention, a high-molecular dispersing agent and another low-molecular dispersing agent may be used in combination, or alternatively two or more kinds of high-molecules or dispersing agents may be used in combination.

These dispersing agents may be used in an amount of generally 2 to 30 wt. %, preferably 5 to 20 wt. %, to a material to be dispersed.

As to an addition time of the dispersing agents (aids), they may be added at any time of before, during and after fine-pulverization so long as they are used in the above-described range.

Specific examples of dispersing agents (aids) for use in the present invention are shown below. However, the present invention should not be limited to them.

(V-1)

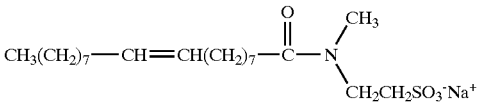

(V-2)

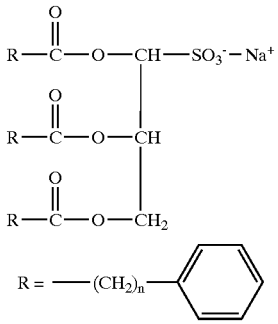

(V-3)

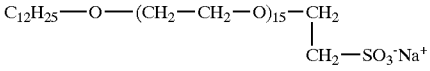

(V-4)

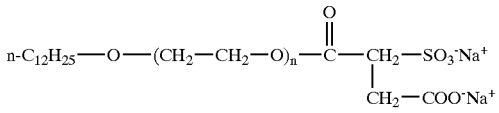

n = 3~5

-continued
(V-5)
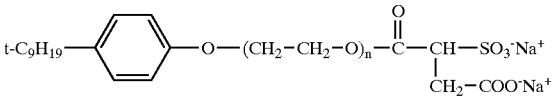
n = 5~10
(V-6)
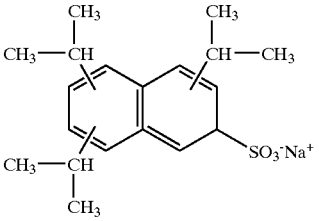
(V-7)
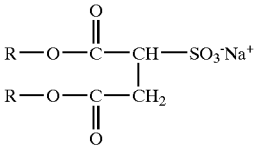
R = $CH(CH_3)C_4H_9$
(V-8)
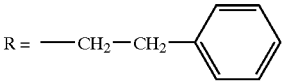
(V-9)
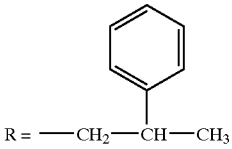
(V-10)
(V-11)
(n = 2~5)
(V-12)
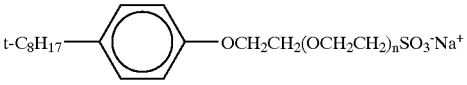
n = 1~3
(V-13)
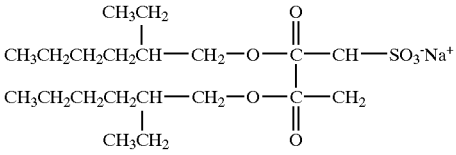
(V-14)
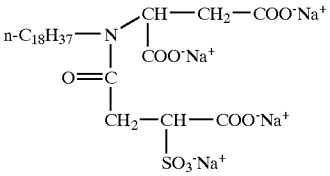
(V-15)
(V-16)
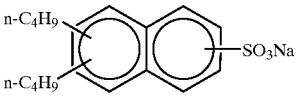
(V-17)
(V-18)
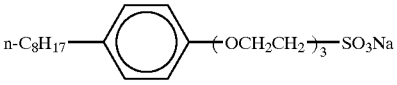
(V-19)
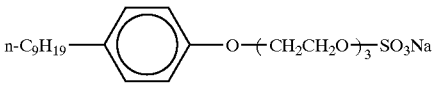
(V-20)
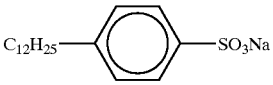
(V-21)
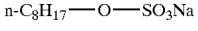
(V-22)
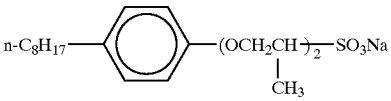
(V-23)
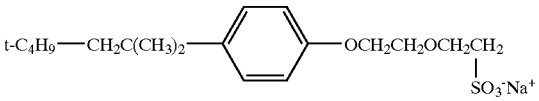
(V-24)

-continued (V-25)

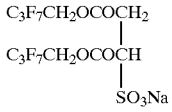

(VI-1)

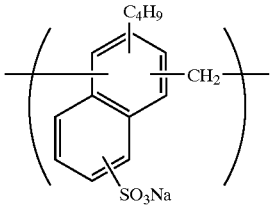

number-average
molecular weight 1600

(VI-2)

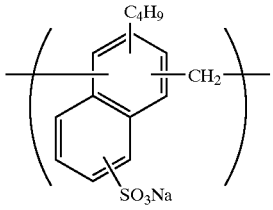

number-average
molecular weight 2900

(VI-3)

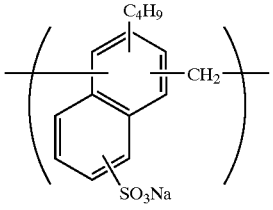

number-average
molecular weight 4500

(VI-4)

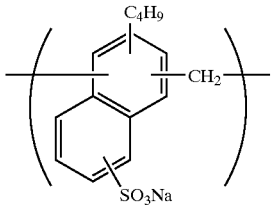

number-average
molecular weight 6700

(VI-5)

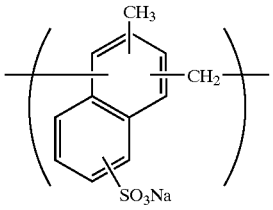

number-average
molecular weight 2300

(VI-6)

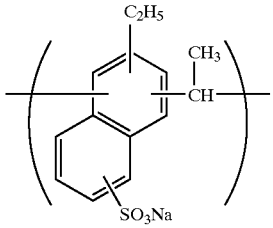

number-average
molecular weight 3400

(VI-7)

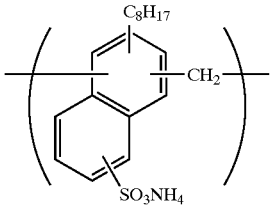

number-average
molecular weight 6900

(VI-8)

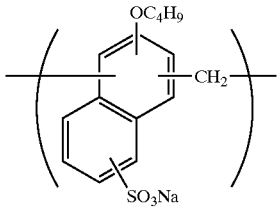

number-average
molecular weight 4200

(VI-9)

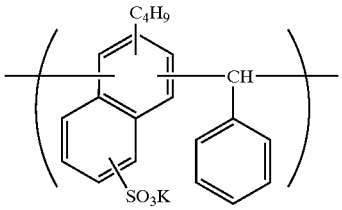

number-average
molecular weight 5500

(VI-10)

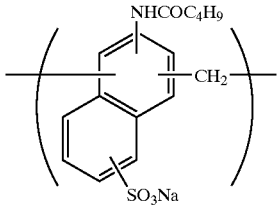

number-average
molecular weight 2400

(VI-11)

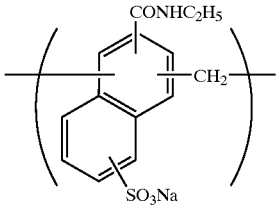

number-average
molecular weight 2100

-continued (VI-12)

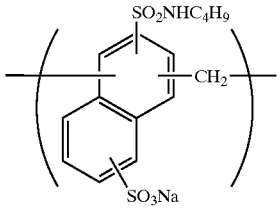

number-average
molecular weight 1700

(VI-13)

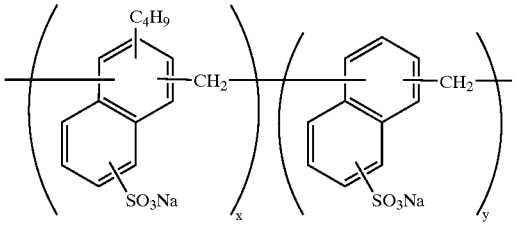

x/y = 75/25 (mol fraction)
number-average
molecular weight 3900

(VI-14)

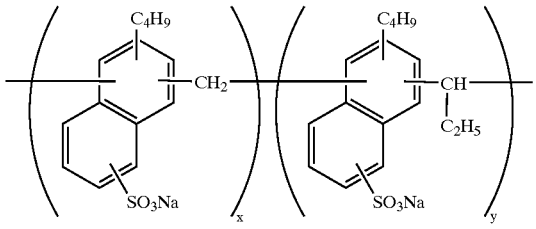

x/y = 50/50 (mol fraction)
number-average
molecular weight 4500

(VI-15)

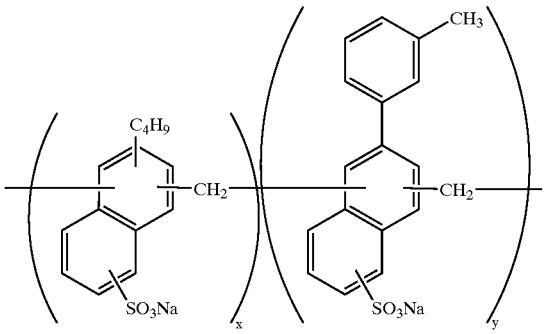

x/y = 95/5 (mol fraction)
number-average
molecular weight 4000

(VI-16)

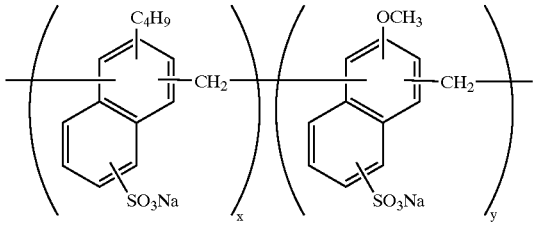

x/y = 60/40 (mol fraction)
number-average
molecular weight 6200

(VI-17)

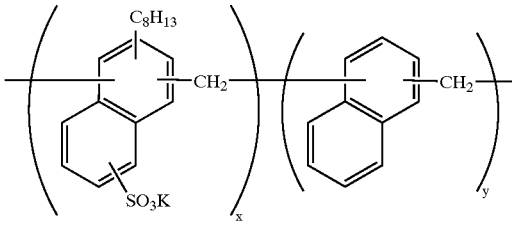

x/y = 50/50 (mol fraction)
number-average
molecular weight 3400

(VI-18)

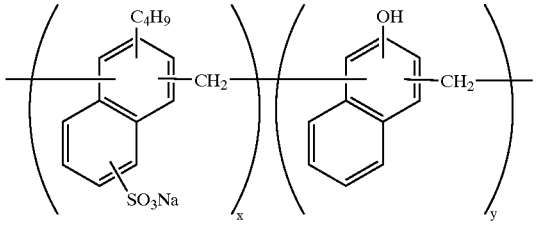

x/y = 60/40 (mol fraction)
number-average
molecular weight 2200

(VI-19)

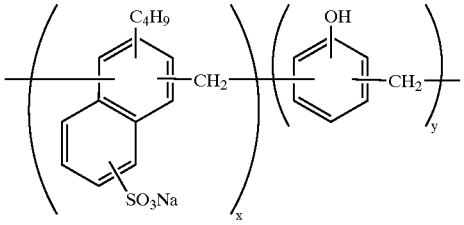

x/y = 70/30 (mol fraction)
number-average
molecular weight 5300

-continued
(VI-20)
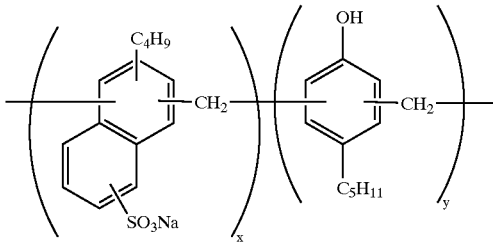
x/y = 80/20 (mol fraction)
number-average
molecular weight 4600
(VI-21)
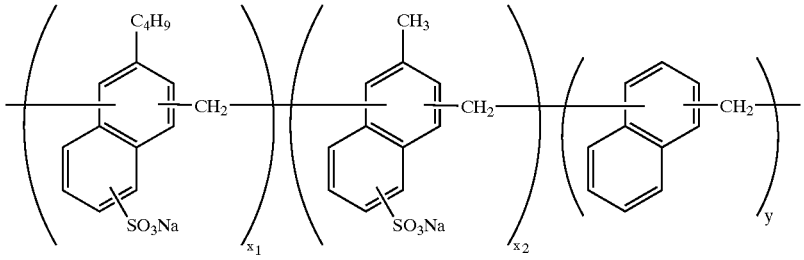
$x_1/x_2/y$ = 60/30/10 (mol fraction)
number-average
molecular weight 4900
(VI-22)
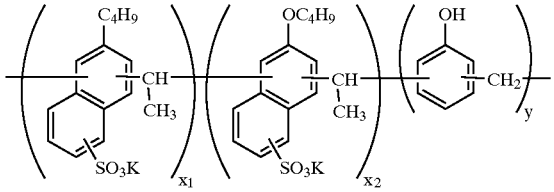
$x_1/x_2/y$ = 50/30/20 (mol fraction)
number-average
molecular weight 3300
(VII-1)
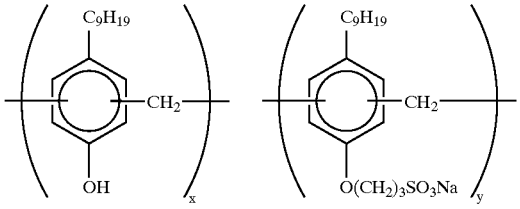
x:y = 50:50
x + y ≒ 6
(VII-2)
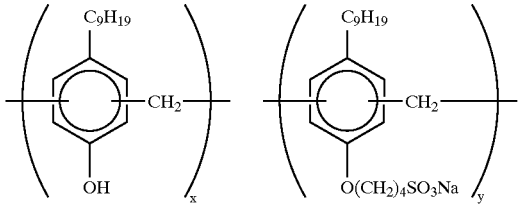
x:y = 55:45
x + y ≒ 7
(VII-3)
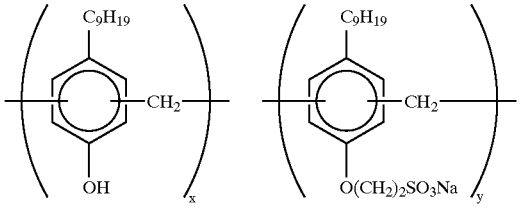
x:y = 20:80
x + y ≒ 6
(VII-4)
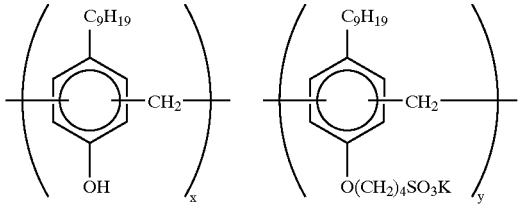
x:y = 75:25
x + y ≒ 6
(VII-5)
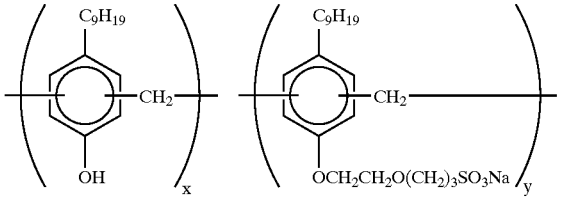
x:y = 5:5
x + y ≒ 6

-continued
(VII-6)
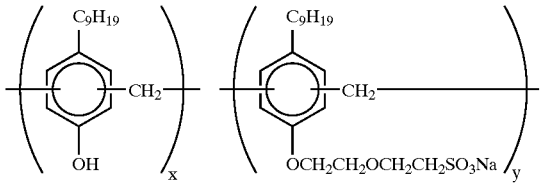
x:y = 2:8
x + y ≒ 10
(VII-7)
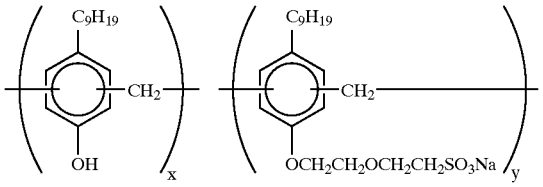
x:y = 2:8
x + y ≒ 25
(VII-8)
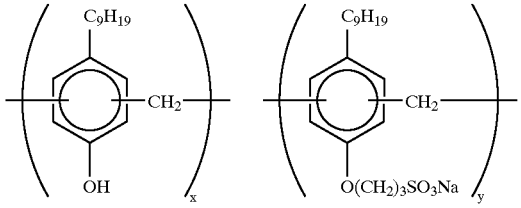
x:y = 1:9
x + y ≒ 10
(VII-9)
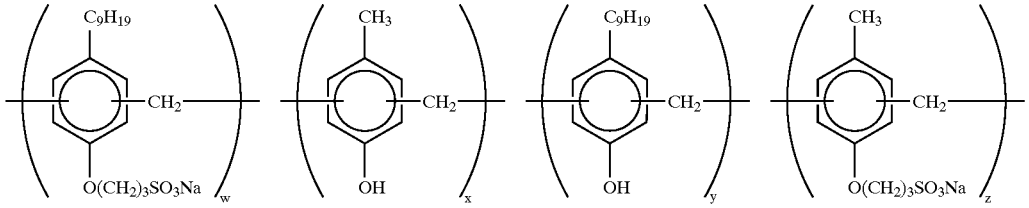
(w + z):(x+y) = 5:5
w+ x + y + z ≒ 5
(VII-10)
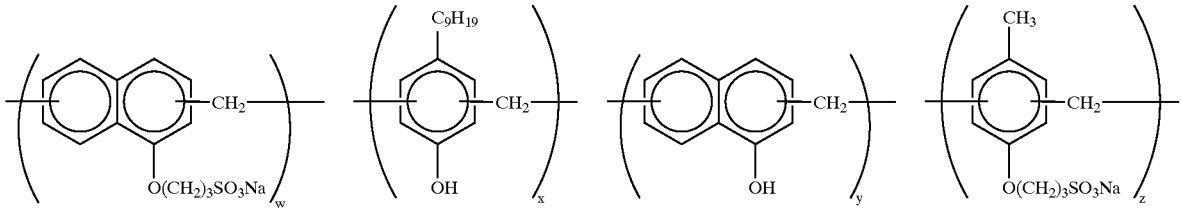
(w + z):(x+y) = 8:2
w+ x + y + z ≒ 8
(VII-11)
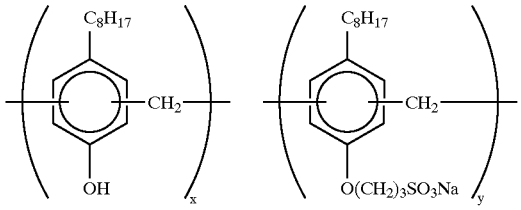
x:y = 4:6
x + y ≒ 8
(VII-12)
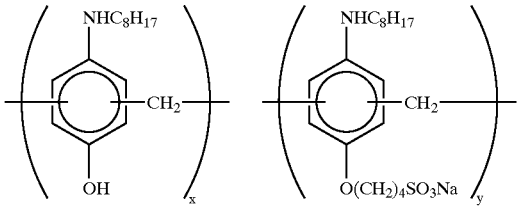
x:y = 5:5
x ÷ y ≒ 4

-continued
(VII-13)
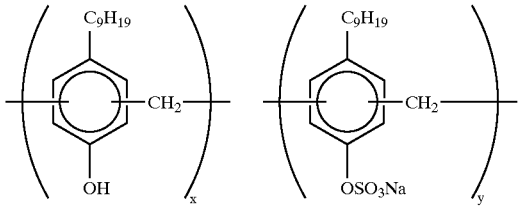
x:y = 6:4
x + y ≒ 6
(VII-14)
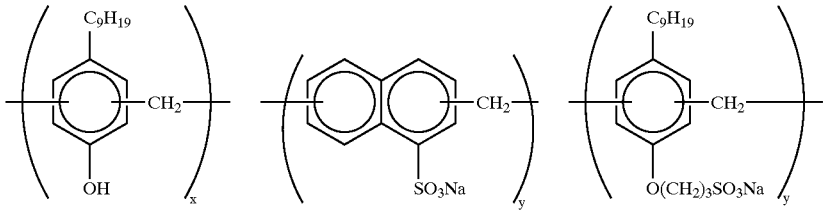
x:y:z = 4:3:3
x + y + z ≒ 6
(VII-15)
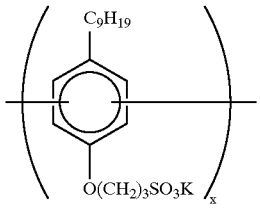
x ≒ 6
(VII-16)
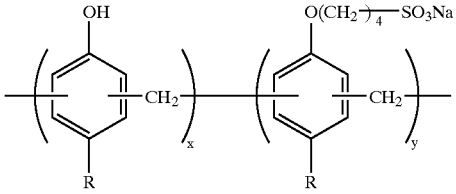
x/y = 0/100 (mol %)
R = —$C_5H_{11}^{(t)}$ or —$C_9H_{19}^{(n)}$
$C_5H_{11}/C_9H_{19}$ = 75/25 (mol %)
(VII-17)
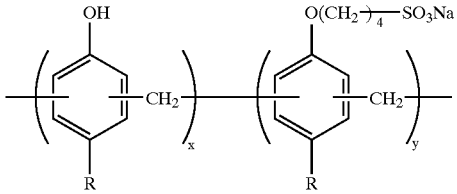
x/y = 20/80 (mol %)
R = 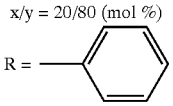
(VII-18)
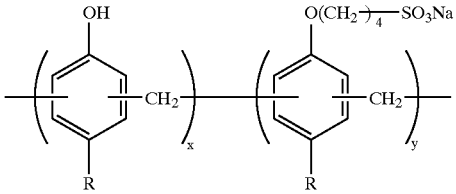
x/y = 20/80 (mol %)
R = —$C_5H_{11}^{(t)}$ or 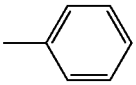
—$C_5H_{11}$/ 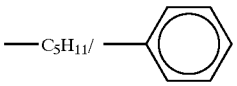 = 50/50 (mol %)
(VII-19)
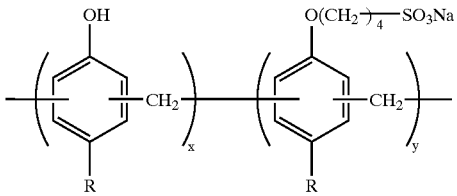
x/y = 20/80 (mol %)
R = —$C_4H_9^{(t)}$
(VII-20)
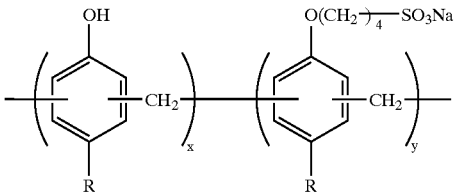
x/y = 20/80 (mol %)
R = —$C_5H_{11}^{(t)}$ or —$C_9H_{19}^{(n)}$
$C_5H_{11}/C_9H_{19}$ = 100/0 (mol %)

-continued (VII-21)

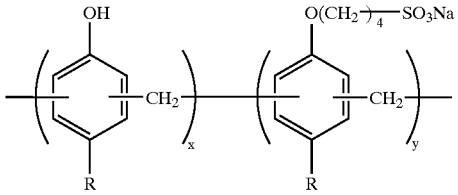

x/y = 10/90 (mol %)

R = —$C_5H_{11}^{(t)}$ or —$C_9H_{19}^{(n)}$ $C_5H_{11}/C_9H_{19}$ = 50/50 (mol %)

(VII-22)

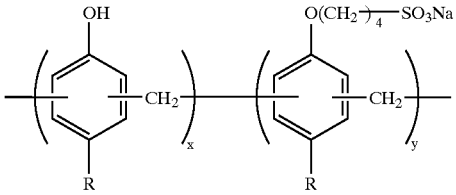

x/y = 0/100 (mol %)

R = —$C_5H_{11}^{(t)}$ or —$C_9H_{19}^{(n)}$ $C_5H_{11}/C_9H_{19}$ = 100/0 (mol %)

(VII-23)

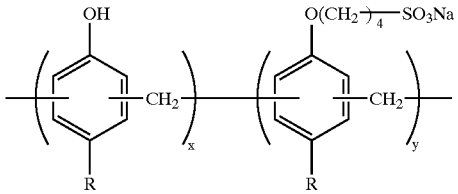

x/y = 0/100 (mol %)

R = —$C_5H_{11}^{(t)}$ or —$C_9H_{19}^{(n)}$ $C_5H_{11}/C_9H_{19}$ = 50/50 (mol %)

(VII-24)

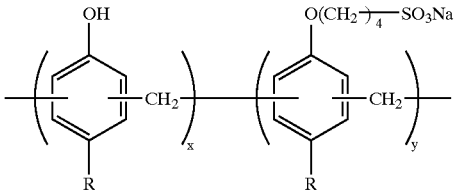

x/y = 30/70 (mol %)

R = —$C_5H_{11}^{(t)}$ or —$C_9H_{19}^{(n)}$ $C_5H_{11}/C_9H_{19}$ = 50/50 (mol %)

(VII-25)

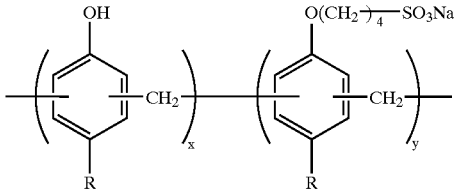

x/y = 20/80 (mol %)

R = —$C_5H_{11}^{(t)}$ or —$C_9H_{19}^{(n)}$ $C_5H_{11}/C_9H_{19}$ = 25/75 (mol %)

(VII-26)

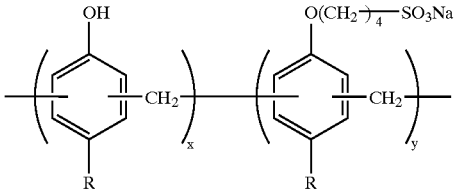

x/y = 20/80 (mol %)

R = —$C_5H_{11}^{(t)}$ or —$C_9H_{19}^{(n)}$ $C_5H_{11}/C_9H_{19}$ = 50/50 (mol %)

(VII-27)

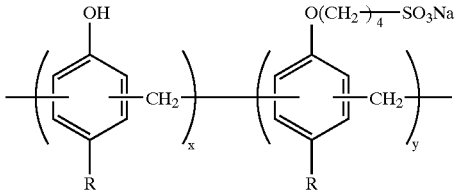

x/y = 20/80 (mol %)

R = —$C_5H_{11}^{(t)}$ or —$C_9H_{19}^{(n)}$ $C_5H_{11}/C_9H_{19}$ = 75/25 (mol %)

(VII-28)

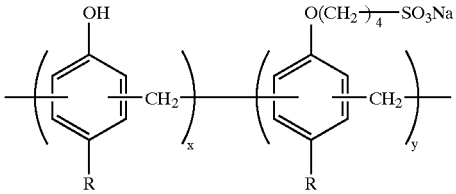

x/y = 60/40 (mol %)

R = —$C_5H_{11}^{(t)}$ or —$C_9H_{19}^{(n)}$ $C_5H_{11}/C_9H_{19}$ = 100/0 (mol %)

(VII-29)

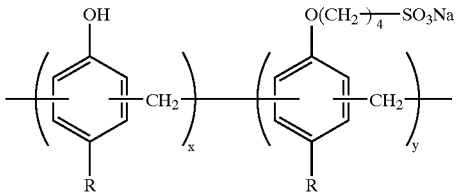

x/y = 40/60 (mol %)

R = —$C_5H_{11}^{(t)}$ or —$C_9H_{19}^{(n)}$ $C_5H_{11}/C_9H_{19}$ = 50/50 (mol %)

(VII-30)

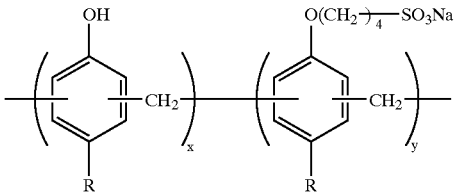

x/y = 40/60 (mol %)

R = —$C_5H_{11}^{(t)}$ or —$C_9H_{19}^{(n)}$ $C_5H_{11}/C_9H_{19}$ = 75/25 (mol %)

-continued (VII-31)

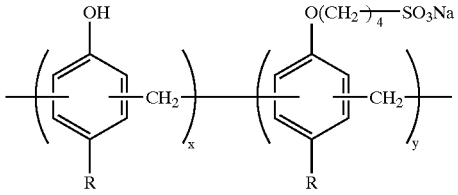

x/y = 40/60 (mol %)

R = —$C_5H_{11}^{(t)}$ or —$C_9H_{19}^{(n)}$ $C_5H_{11}/C_9H_{19}$ = 100/0 (mol %)

(VII-32)

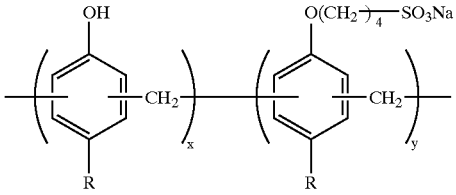

x/y = 60/40 (mol %)

R = —$C_5H_{11}^{(t)}$ or —$C_9H_{19}^{(n)}$ $C_5H_{11}/C_9H_{19}$ = 0/100 (mol %)

(VII-33)

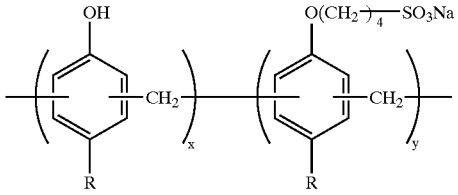

x/y = 60/40 (mol %)

R = —$C_5H_{11}^{(t)}$ or —$C_9H_{19}^{(n)}$ $C_5H_{11}/C_9H_{19}$ = 25/75 (mol %)

(VII-34)

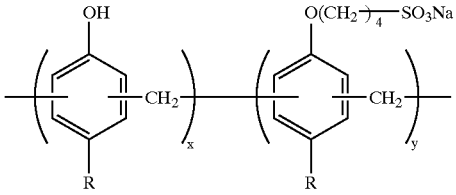

x/y = 60/40 (mol %)

R = —$C_5H_{11}^{(t)}$ or —$C_9H_{19}^{(n)}$ $C_5H_{11}/C_9H_{19}$ = 50/50 (mol %)

(VII-35)

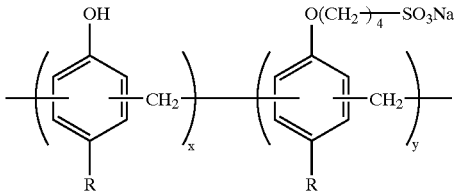

x/y = 60/40 (mol %)

R = —$C_5H_{11}^{(t)}$ or —$C_9H_{19}^{(n)}$ $C_5H_{11}/C_9H_{19}$ = 75/25 (mol %)

(VII-36)

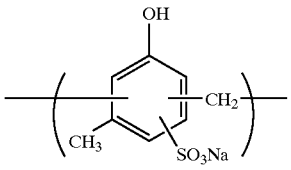

W′-1

$C_{14}H_{29}SO_3Na$

W′-2

$C_{11}H_{23}CH(OH)$—$CH_2CH_2SO_3Na$ $C_{11}H_{23}CH$═$CHCH_2SO_3Na$

Mixture of 40/60(wt)

W′-3

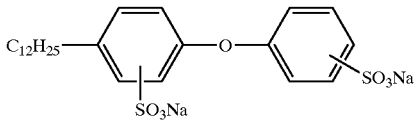

W′-4

$C_{11}H_{23}CON(CH_3)CH_2CH_2SO_3Na$

W′-5

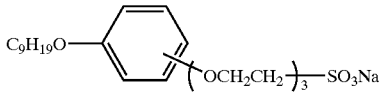

W′-6

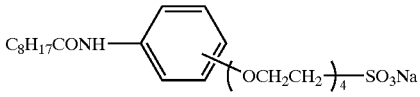

W′-7

$C_{12}H_{25}$—(O—$CH_2CH_2$)$_3$—$SO_3Na$

W′-8

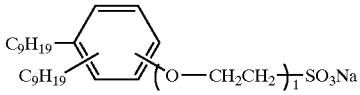

W′-9

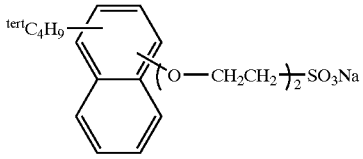

W′-10

$C_{17}H_{33}CON(CH_3)$—$CH_2CH_2$—(O—$CH_2CH_2$)$_5$—$SO_3Na$

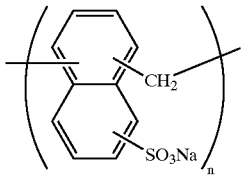
number-average molecular weight ≒ 1500
-continued
W′-12
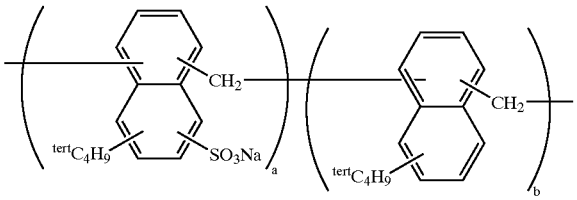
number-average molecular weight ≒ 1500
a/b ≒ 20/80(wt)
W′-13
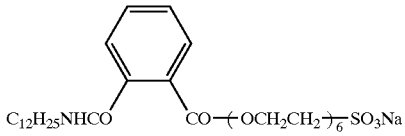
W′-14
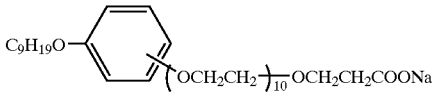
W′-15
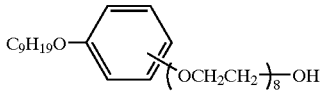
W′-16
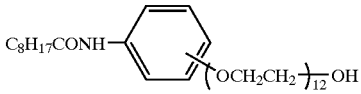
W′-17
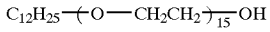
W′-18
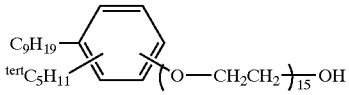
W′-19
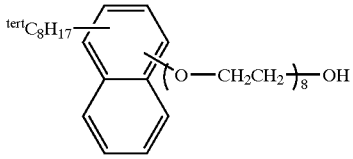
W′-20
W′-21
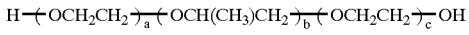
a+c/b = 207/39 (polymerization degree)
W′-22
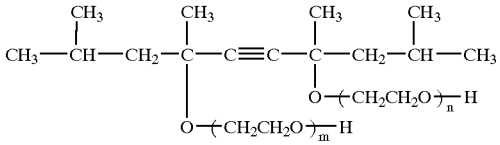
m + n ≒ 10
W′-23
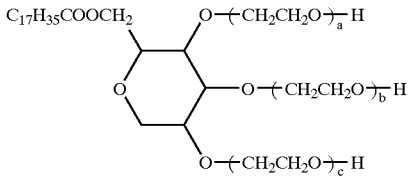
W′-24
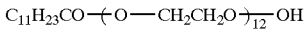
W′-25
Emulgen LS (trade name, maufactured by Kao Co., Ltd.)
W′-26
Emulgen MS (trade name, maufactured by Kao Co., Ltd.)
W′-27
SYNPERONIC NCE (trade name, maufactured by ICI)

Further, specific examples of dispersing agents represented by general formula II are shown below. However, the present invention should not be limited thereto.

P-1

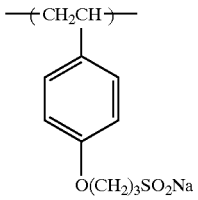

Mw = 4800

(Mw represents weight-average molecular weight)

P-2

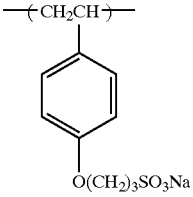

Mw = 5400

P-3

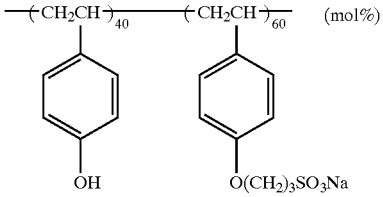

(mol%)

Mw = 8300

P-4

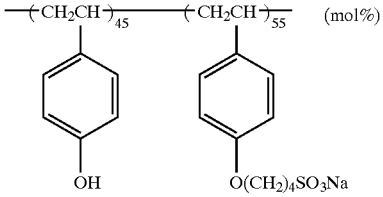

(mol%)

Mw = 6700

P-5

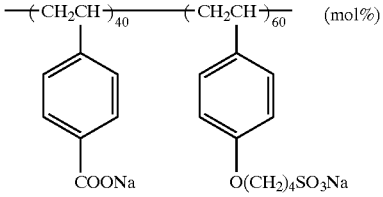

(mol%)

Mw = 12000

P-6

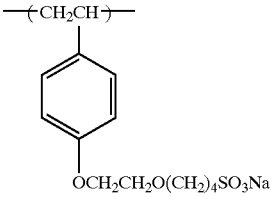

Mw = 7400

P-7

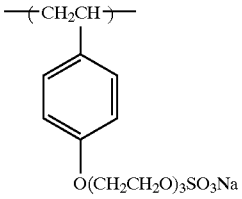

Mw = 15000

P-8

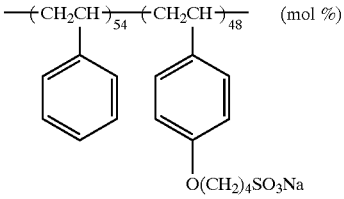

(mol %)

Mw = 4800

-continued

P-9

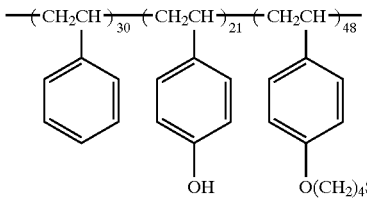

(mol %)

Mw = 4400

P-10

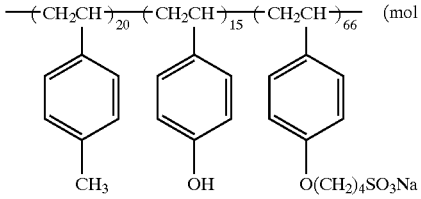

(mol %)

Mw = 7100

P-11

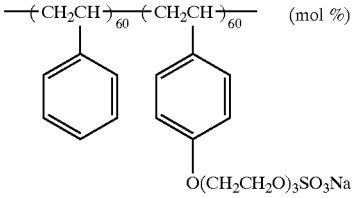

(mol %)

Mw = 9600

P-12

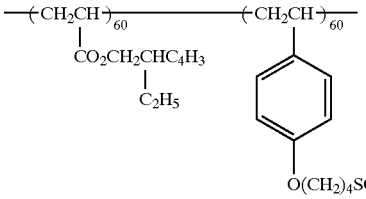

(mol %)

Mw = 14300

P-13

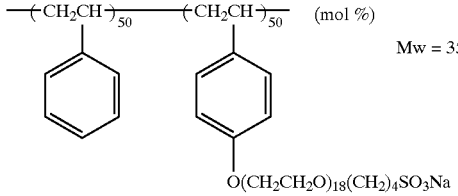

(mol %)

Mw = 35000

P-14

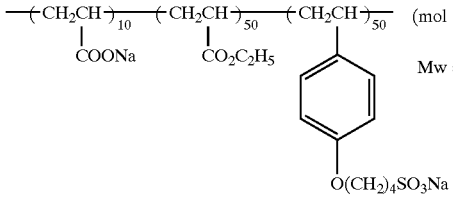

(mol %)

Mw = 22000

P-15

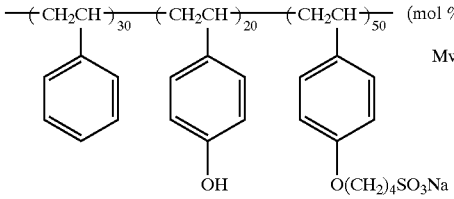

(mol %)

Mw = 5800

Mw (weight-average molecular weight)

P-16

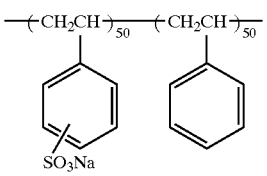

(molar ratio)

19000

-continued

P-17 $-(CH_2CH)_{30}-(CH_2CH)_{70}-$ (molar ratio) 6800

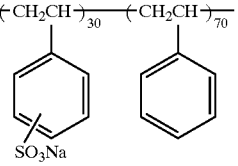

P-18 $-(CH_2CH)_{40}-(CH_2CH)_{60}-$ (molar ratio) 7300

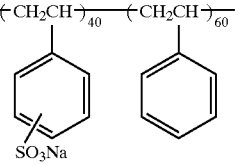

P-19 $-(CH_2CH)_{20}-(CH_2CH)_{50}-$ (molar ratio) 4100

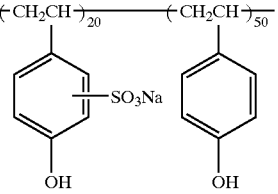

P-20 $-(CH_2CH)_{50}-(CH_2CH)_{50}-$ (molar ratio) 8200

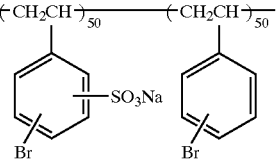

P-21 $-(CH_2CH)_{22}-(CH_2CH)_{87}-$ (molar ratio) 12000

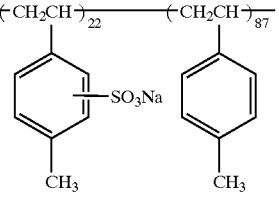

P-22 $-(CH_2CH)_{30}-(CH_2CH)_{70}-$ (molar ratio) 15400

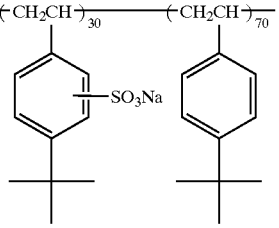

11400

P-23 $-(CH_2CH)_{30}-(CH_2CH)_{3}-(CH_2CH)_{10}-(CH_2CH)_{57}-$

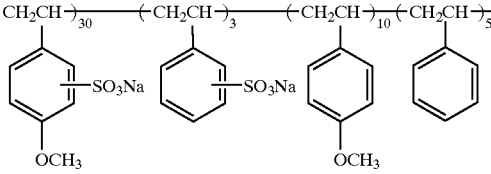

(molar ratio)

9800

P-24 $-(CH_2CH)_{5}-(CH_2CH)_{30}-(CH_2CH)_{25}-(CH_2CH)_{40}-$

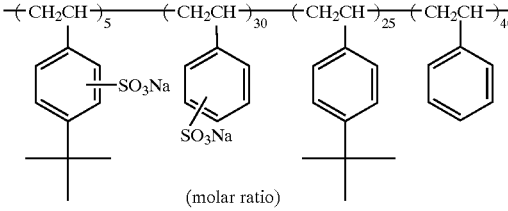

(molar ratio)

The pH of the dispersion after fine pulverization is preferably in the range of 4.5 to 8, and preferably the pH is adjusted before, during, or after fine pulverization. Further in order to impart a dispersion stability to the dispersion, a dispersion solution may be subjected to heat treatment before or after fine pulverization.

Further in the present invention, it is also preferred to mix a solid fine-grain dispersion with a hydrophilic colloid solution, to make a dispersion. By this method, sedimentation (precipitation) during storage can be prevented, and the thus-prepared dispersion can be coated onto a support as it is, to prepare a photographic light-sensitive material. As the content of a photographically useful compound in the dispersion is higher, the productivity of manufacture is higher and an equipment for the storage can be miniaturized, and also a drying load at the time of coating can be controlled to a lower level. The above-said content is generally in the range of 3 wt. % to 50 wt. %, preferably 7 wt. % to 30 wt. %, and more preferably 10 wt. % to 25 wt. %.

Of the hydrophilic colloids, gelatin is preferred.

To provide a layer containing fine grains of a dye for a photographic light-sensitive material, there can be used a method comprising the steps of: preparing a solid dispersion of approximately uniform grains by dispersing the thus-obtained grains into a suitable binder, and then applying the solid dispersion onto a desired support.

The above-described binders are not limited in particular, so long as they are a hydrophilic colloid which can be used for a light-sensitive emulsion layer or a light-insensitive layer. Generally, gelatin, or a synthetic polymer, such as polyvinyl alcohol and polyacrylamide, is used.

Fine grains in the solid dispersion prepared by the method of the present invention preferably have an average grain size of 0.005 $\mu$m to 10 $\mu$m, more preferably 0.01 $\mu$m to 1 $\mu$m, and furthermore preferably 0.02 $\mu$m to 0.5 $\mu$m.

A solid fine-grain dispersion of a dye prepared by the method of the present invention, can be incorporated in a light-insensitive hydrophilic colloid layer according to a hue of the dye in a silver halide photographic light-sensitive material. In the light-sensitive material having an embodiment wherein the above-said light-insensitive layer is composed of plural layers, the above-described solid fine-grain dispersion can be incorporated in each of the plural layers.

Examples of these silver halide light-sensitive materials include an X ray light-sensitive film, a film for printing (e.g a graphic arts film), a black-and-white negative film, a color negative film, a color reversal film, a motion picture film, and a color paper.

As various techniques, or inorganic or organic materials, that can also be used for the silver halide photographic light-sensitive material in the present invention, generally those described in the Research Disclosure No. 308119 (1989) can be used. In addition to the above, techniques or inorganic or organic materials that can be used in the silver halide photographic light-sensitive material of the present invention, are described in the below points of Published EP-A-436,938 (A2) and in the below-referred patent publications.

| Item | Corresponding section |
|---|---|
| 1) Layer structures | page 146, line 34 to page 147, line 25 |
| 2) Silver halide emulsions | page 147, line 26 to page 148, line 12 |
| 3) Yellow couplers | page 137, line 35 to page 146, line 33, an page 149, lines 21 to 23 |

-continued

| Item | Corresponding section |
|---|---|
| 4) Magenta couplers | page 149, lines 24 to 28; and EP-A-421,453 (A1), page 3, line 5 to page 25, line 55 |
| 5) Cyan couplers | page 149, lines 29 to 33; and EP-A-432,804 (A2), page 3, line 28 to page 40, line 2 |
| 6) Polymer couplers | page 149, lines 34 to 38; and EP-A-435,334 (A2), page 113, line 39 to page 123, line 37 |
| 7) Colored couplers | page 53, line 42 to page 137, line 34, and page 149, lines 39 to 45 |
| 8) Other functional couplers | page 7, line 1 to page 53, line 41, and page 149, line 46 to page 150, line 3; and EP-A-435,334 (A2), page 3, line 1 to page 29, line 50 |
| 9) Antiseptics and mildewproofing agents | page 150, lines 25 to 28 |
| 10) Formalin scavengers | page 149, lines 15 to 17 |
| 11) Other additives | page 153, lines 38 to 47; and EP-A-421,453 (A1), page 75, line 21 to page 84, line 56, and page 27, line 40 to page 37, line 40 |
| 12) Dispersion methods | page 150, lines 4 to 24 |
| 13) Supports (Bases) | page 150, lines 32 to 34 |
| 14) Film thickness and film physical properties | page 150, lines 35 to 49 |
| 15) Color development/black-and-white development/fogging steps | page 150, line 50 to page 151, line 47; and EP-A-442,323 (A2), page 34, lines 11 to 54, and page 35, lines 14 to 22 |
| 16) Desilvering steps | page 151, line 48 to page 152, line 53 |
| 17) Automatic processors | page 152, line 54 to page 153, line 2 |
| 18) washing/stabilizing steps | page 153, lines 3 to 37 |

The solid fine-grain dispersion obtained by the method of the present invention contains neither coarse grains nor abrasion materials resulting from media or so on, and further the dispersion causes no defect when coated in a hydrophilic colloid layer of a silver halide photographic light-sensitive material.

Now, the present invention is described in more detail with reference to the following examples, but the present invention is not limited thereto.

EXAMPLE

Example 1

(Preparation of Solid Fine-grain Dispersion S-1 to S-18)

| | |
|---|---|
| Wet cake of Compound IX-1 (containing water in 17.6 wt. %) | 2.80 kg |
| Compound V-12 (31 wt. % aqueous solution) | 0.376 kg |
| Antiseptics (A) (7% aqueous solution) | 0.011 kg |
| Water | 4.02 kg |
| Total | 7.21 kg |

pH = 7.2 (adjusted by sodium hydroxide)

A slurry having the above-described composition was roughly dispersed agitating by means of Dissolver, and thereafter the dispersed slurry was further dispersed under the conditions described in Table 2, until the absorbance ratio of the dispersion solution described below would become 0.4, to obtain Solid fine-grain dispersions S-1 to S-18. However, as for the dispersions S-9, S-10, S-11, and S-12, absorption of the dispersion solution was not measured, but the dispersing process was finished at the same period of dispersing time as in S-7. In the preparation of S-14, dispersing was continued until the absorbance ratio would become 0.17. Further, the grain size of dispersed grains in the slurry of solid fine-grains before the dispersion processing was in the range of about 50 to about 100 $\mu$m, although the size was different depending on the solid fine-grains to be used.

Properties of the thus-obtained solid fine-grain dispersions are shown in Table 3.

Antiseptics A

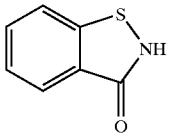

TABLE 2

| Dispersion solution | | Dispersion machine | Media separation method | Meida Material[1)] | Av. size [mm] | Filling rate [%] | Round speed | Dye |
|---|---|---|---|---|---|---|---|---|
| S-1 | Comparative example | UVX-2[2)] | Gap separator | Alumina | 0.5 | 87 | 10 | IX-1 |
| S-2 | " | " | " | Yttria-doped zirconia | 0.5 | " | " | " |
| S-3 | " | AGITATOR MILL LMK[3)] | Screen + overcap | Alumina | 0.5 | 80 | " | " |
| S-4 | " | " | " | Yttria-doped zirconia | 1 | " | " | " |
| S-5 | " | " | " | " | 0.5 | " | " | " |
| S-6 | " | " | " | " | 0.4 | " | " | " |
| S-7 | This invention | " | " | " | 0.3 | " | " | " |

TABLE 2-continued

| Dispersion solution | | Dispersion machine | Media separation method | Meida Material[1)] | Av. size [mm] | Filling rate [%] | Round speed | Dye |
|---|---|---|---|---|---|---|---|---|
| S-8 | " | " | " | " | 0.1 | " | " | " |
| S-9 | " | " | " | " | " | " | " | III-2 |
| S-10 | " | " | " | " | " | " | " | III-3 |
| S-11 | " | " | " | " | " | " | " | III-5 |
| S-12 | " | " | " | " | " | " | " | III-25 |
| S-13 | " | SAM[4)] | Sentry separator | " | 0.3 | " | " | IX-1 |
| S-14 | " | " | " | " | 0.1 | " | " | " |
| S-15 | " | " | " | " | " | " | 12 | " |
| S-16 | " | " | " | " | " | " | " | " |
| S-17 | " | " | " | " | 0.05 | " | " | " |
| S-18 | Comparative example | LME[5)] | " | zircon | 0.4 | " | 10 | " |

[1)]The bulk density of the alumina to be used was 3.8 g/cm$^3$, the Vickers hardness was 15 GPa, the breaking tenacity was 3.7 MPam$^{1/2}$. The bulk density of the zirconia to be used was 6.0 g/cm$^3$, the Vickers hardness was 14 GPa, the breaking tenacity was 4.0 MPam$^{1/2}$. The bulk density of the zircon to be used was 3.8 g/cm$^3$, the Vickers hardness was 7 GPa, the breaking tenacity was 4.0 MPam$^{1/2}$.
[2)]UVX-2 (trade name, IMEX Co.)
[3)]AGITATOR MILL LMK-4 (trade name, manufactured by Ashizawa K.K.) (4 liters of volume of a grinding chamber, 100 mm of disk size.)
[4)]SAM-1 (trade name, manufactured by Kotobuki Giken Industry Co.,) (1 liter of volume of a grinding chamber, 70 mm of length of a pin.)
[5)]LME-2 (trade name, manufactured by Netzsch Co.,) (2 liters of volume of a grinding chamber.)

TABLE 3

| Dispersion solution | Average residence time [min] | Foreign matters [ppm] | Number of plane defects (relative value) | Average grain size of dispersion (μm) |
|---|---|---|---|---|
| S-1 Comparative example | 250 | 300 | 250 | 0.30 |
| S-2 Comparative example | 50 | 120 | 25 | " |
| S-3 Comparative example | 250 | 95 | 7 | 0.29 |
| S-4 Comparative example | 100 | 70 | 4 | " |
| S-5 Comparative example | 50 | 50 | 2 | " |
| S-6 | 40 | 40 | 1 | " |
| S-7 This invention | 22 | 5.0 | 0 | " |
| S-8 This invention | 6 | 1.0 | 0 | " |
| S-9 This invention | 6 | 1.0 | 0 | 0.28 |
| S-10 This invention | 6 | 1.0 | 0 | " |
| S-11 This invention | 6 | 1.0 | 0 | 0.29 |
| S-12 This invention | 6 | 1.0 | 0 | " |
| S-13 This invention | 7 | 0.8 | 0 | " |
| S-14 This invention | 4 | 0.3 | 0 | " |
| S-15 This invention | 3 | 0.3 | 0 | " |
| S-16 This invention | 12 | 0.3 | 0 | 0.08 |
| S-17 This invention | 6 | 0.2 | 0 | " |
| S-18 This Comparative example* | 260 | 300 | 300 | 0.29 |

*During dispersing, an increase of the inner pressure was observed.

In the dispersion machine, an entire inner wall of the grinding chamber was made of zirconia-enriched alumina, and a disk or pin, or a gap separator, sentry separator, or screen (pore size 0.05 mm) were made of zirconia.

(Evaluation of Coating Film Defect)

Gelatin was added to the dispersion, and the resultant mixture was coated on a transparent TAC, and thereafter the number of defects per a definite area was counted.

(Determination of Abrasion Material)

Zr and Al in the dispersion solution were determined by ICP emission spectrophotometry, and the amount of foreign matters resulting from the media or the dispersing machine was calculated.

(Measurement of Grain Size)

An average grain size of the dispersion was measured by means of Microtrack UPAHRA (trade name, manufactured by Nikkaki Co. Ltd.).

(Absorption of Dispersion Solution)

Each of the dispersion solutions was diluted so that the content of the photographically useful compound would become 16 ppm. Subsequently, the maximum absorbance (A1) of the diluted dispersion solution at the visible wavelength region, and also a ratio (A2/A1) of the absorbance (A2) at the wavelength 500 nm being longer than the specific wavelength providing the maximum absorbance, to A1, were measured.

The solid fine-grain dispersion of the present invention had less foreign matters resulting from the media, and it had no defect. Further, according to the present invention, a small size of media can be used, so that further fine-pulverization and reduction of coarse grains are possible. These solid fine-grain dispersions were employed to prepare silver halide photographic light-sensitive materials in the following Examples.

Example 2

(Preparation of Solid Fine-grain Dispersions T-1 to T-16)

According to a method of Example 1, dispersions of the composition described in Table 4 were dispersed under the conditions described in Table 4, to obtain Solid fine-grain dispersions T-1 to T-16.

(Evaluation of Stability)

Dispersions were allowed to stand at 40° C. for 14 days, and thereafter the grain size was measured. The results are shown in Table 5.

TABLE 4

| Dispersion | Dispersion machine | Media | | | Round | Dye | Dispersion agent | |
|---|---|---|---|---|---|---|---|---|
| | | Material | Av. grain size (mm) | Filling rate (%) | speed (m/s) | | Kind | Amount to be used (per solid content of dye) |
| T-1 (Comparative example) | UVX-2 | Yttria-doped zirconia | 0.5 | 87 | 10 | IX-1 | V-12 | 5% |
| T-2 (This invention) | LMK-4 | " | 0.1 | 80 | " | " | " | " |
| T-3 (This invention) | " | " | " | " | " | " | X-1 | 10% |
| T-4 (This invention) | " | " | " | " | " | " | X-2 | " |
| T-5 (This invention) | " | " | " | " | " | " | X-3 | " |
| T-6 (This invention) | " | " | " | " | " | " | X-4 | " |
| T-7 (This invention) | " | " | " | " | " | " | X-5 | " |
| T-8 (This invention) | " | " | " | " | " | " | X-6 | " |
| T-9 (This invention) | " | " | " | " | " | " | X-7 | 30% |
| T-10 (This invention) | SAM-1 | " | 0.05 | " | 12 | " | V-12 | 5% |
| T-11 (This invention) | " | " | " | " | " | " | X-1 | 10% |
| T-12 (This invention) | " | " | " | " | " | " | X-2 | " |
| T-13 (This invention) | " | " | " | " | " | " | X-3 | " |
| T-14 (This invention) | " | " | " | " | " | " | X-4 | " |
| T-15 (This invention) | " | " | " | " | " | " | X-5 | " |
| T-16 (This invention) | " | " | " | " | " | " | X-7 | 30% |

TABLE 5

| Dispersion | Average residence time (min) | Average grain size of dispersion (μm) | | |
|---|---|---|---|---|
| | | Immediately after preparation | After standing at 40° C. for 14 days | Rate of change of the grain size (%) |
| T-1 (Comparative example) | 250 | 0.30 | 0.37 | 23 |
| T-2(This invention) | 6 | 0.29 | 0.38 | 31 |
| T-3(This invention) | 4 | 0.28 | 0.31 | 11 |
| T-4(This invention) | — | — | — | — |
| T-5(This invention) | — | — | — | — |
| T-6(This invention) | — | — | — | — |
| T-7(This invention) | — | — | — | — |
| T-8(This invention) | 25 | — | 0.34 | 21 |
| T-9(This invention) | 12 | — | 0.32 | 14 |
| T-10(This invention) | 6 | 0.08 | 0.15 | 88 |
| T-11(This invention) | 4 | — | 0.08 | <10 |
| T-12(This invention) | — | — | — | — |
| T-13(This invention) | — | — | — | — |
| T-14(This invention) | — | — | — | — |
| T-15(This invention) | — | — | 0.12 | 50 |
| T-16(This invention) | 10 | — | 0.13 | 68 |

X-1

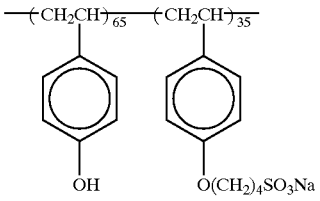

Mw = 6700

X-2

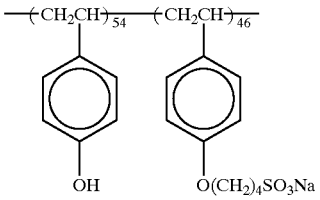

Mw = 4800

TABLE 5-continued

| | |
|---|---|
| X-3 | 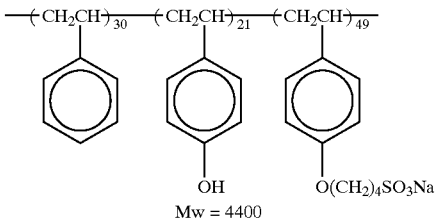 Mw = 4400 |
| X-4 | 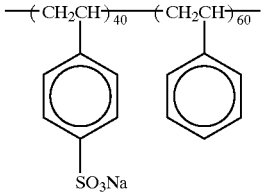 Mw = 7300 |
| X-5 | 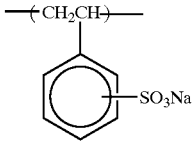 Mw = 1500 |
| X-6 | Polyvinyl pyrrolidone Mw = 15000 |
| X-7 | Daparal GE202 Mw = 12500~25000 (A block copolymer of a branched carboxylic acid partially esterified) |

A high-molecular dispersing agent for use in the present invention not only accelerates a dispersing speed, but also can prevent aggregation from occurring during storage.

Further, when a high-efficient dispersing according to the present invention is practiced, or a grain size is small, such an effect is remarkable.

Example 3

(Preparation of Sample 301)

Layers having the below-shown compositions were formed on a cellulose triacetate film support, having a thickness of 127 um, that had been provided an undercoat, to prepare a multi-layer color light-sensitive material, which was named Sample 301. Each figure represents the amount to be added per square meter of the light-sensitive material. In the followings, it should be noted that the effect/function of a specific compound added is not limited to the use as described.

| | |
|---|---|
| First Layer (Halation-prevention layer) | |
| Dispersion S-12 | in terms of III-25 0.28 g |
| Gelatin | 2.20 g |
| Ultraviolet ray absorbent U-1 | 0.27 g |
| Ultraviolet ray absorbent U-3 | 0.08 g |
| Ultraviolet ray absorbent U-4 | 0.08 g |
| High-boiling organic solvent Oil-1 | 0.29 g |
| Coupler C-9 | 0.12 mg |
| Second Layer (Intermediate layer) | |
| Gelatin | 0.38 g |
| Compound Cpd-K | 5.0 mg |
| Ultraviolet ray absorbent U-2 | 3.0 mg |

-continued

| | |
|---|---|
| High-boiling organic solvent Oil-3 | 0.06 g |
| Dye D-4 | 10.0 mg |
| Third Layer (Intermediate layer) | |
| Yellow colloidal silver | silver 0.007 g |
| Gelatin | 0.40 g |
| Fourth Layer (First red-sensitive emulsion layer) | |
| Emulsion A | silver 0.55 g |
| Emulsion B | silver 0.23 g |
| Silver iodobromide emulsion of fine grains, whose surfaces were fogged (av. grain diameter: 0.11 μm) | 0.07 g |
| Gelatin | 1.11 g |
| Coupler C-1 | 0.04 g |
| Coupler C-2 | 0.09 g |
| Compound Cpd-A | 1.0 mg |
| Compound Cpd-E | 0.14 g |
| Compound Cpd-K | 2.0 mg |
| Compound Cpd-H | 4.4 mg |
| High-boiling organic solvent Oil-2 | 0.09 g |
| Fifth Layer (Second red-sensitive emulsion layer) | |
| Emulsion C | silver 0.14 g |
| Emulsion D | silver 0.28 g |
| Gelatin | 0.65 g |
| Coupler C-1 | 0.05 g |
| Coupler C-2 | 0.11 g |
| Compound Cpd-E | 0.10 g |
| High-boiling organic solvent Oil-2 | 0.09 g |
| Sixth Layer (Third red-sensitive emulsion layer) | |
| Emulsion E | silver 0.50 g |
| Gelatin | 1.56 g |
| Coupler C-3 | 0.63 g |
| Compound Cpd-E | 0.11 g |
| Additive P-1 | 0.16 g |
| High-boiling organic solvent Oil-2 | 0.04 g |
| Seventh Layer (Intermediate layer) | |
| Gelatin | 0.50 g |
| Compound Cpd-D | 0.04 g |
| High-boiling organic solvent Oil-3 | 0.08 g |
| Dispersion S-9 | in terms of III-2 0.07 g |
| Eighth Layer (Intermediate layer) | |
| Yellow colloidal silver | silver 0.01 g |
| Gelatin | 1.56 g |
| Compound Cpd-A | 0.12 g |
| Compound Cpd-I | 0.04 mg |
| Compound Cpd-J | 0.07 g |
| High-boiling organic solvent Oil-3 | 0.15 g |
| Ninth Layer (First green-sensitive emulsion layer) | |
| Emulsion F | silver 0.42 g |
| Emulsion G | silver 0.38 g |
| Emulsion H | silver 0.32 g |
| Silver bromide emulsion of core/shell-type fine grains, whose surfaces were fogged (av. grain diameter: 0.11 μm) | silver 0.08 g |
| Gelatin | 1.53 g |
| Coupler C-7 | 0.07 g |
| Coupler C-8 | 0.17 g |
| Compound Cpd-B | 0.30 mg |
| Compound Cpd-C | 2.00 mg |
| Compound Cpd-K | 3.0 mg |
| Polymer latex P-2 | 0.02 g |
| High-boiling organic solvent Oil-2 | 0.10 g |
| Tenth Layer (Second green-sensitive emulsion layer) | |
| Emulsion I | silver 0.16 g |
| Emulsion J | silver 0.34 g |
| Gelatin | 0.75 g |
| Coupler C-4 | 0.20 g |
| Compound Cpd-B | 0.03 g |
| Polymer latex P-2 | 0.01 g |
| High-boiling organic solvent Oil-2 | 0.01 g |

-continued

| | |
|---|---|
| Eleventh Layer (Third green-sensitive emulsion layer) | |
| Emulsion K | silver 0.44 g |
| Gelatin | 0.91 g |
| Coupler C-4 | 0.34 g |
| Compound Cpd-B | 0.06 g |
| Polymer latex P-2 | 0.01 g |
| High-boiling organic solvent Oil-2 | 0.02 g |
| Twelfth Layer (Yellow filter layer) | |
| Dispersion S-17 | in terms of IX-1 0.24 g |
| Yellow colloidal silver | 0.02 g |
| Gelatin | 0.73 g |
| Compound Cpd-G | 0.02 g |
| Compound Cpd-J | 0.04 g |
| High-boiling organic solvent Oil-3 | 0.08 g |
| Polymer M-1 | 0.23 g |
| Thirteenth Layer (First blue-sensitive emulsion layer) | |
| Emulsion L | silver 0.35 g |
| Gelatin | 0.55 g |
| Coupler C-5 | 0.20 g |
| Coupler C-6 | 4.00 g |
| Coupler C-10 | 0.02 g |
| Compound Cpd-E | 0.07 g |
| Compound Cpd-K | 0.03 mg |
| Fourteenth Layer (Second blue-sensitive emulsion layer) | |
| Emulsion M | silver 0.06 g |
| Emulsion N | silver 0.10 g |
| Gelatin | 0.75 g |
| Coupler C-5 | 0.35 g |
| Coupler C-6 | 5.00 g |
| Coupler C-10 | 0.30 g |
| Compound Cpd-E | 0.04 g |
| Fifteenth Layer (Third blue-sensitive emulsion layer) | |
| Emulsion O | silver 0.20 g |
| Emulsion P | silver 0.02 g |
| Gelatin | 2.40 g |
| Coupler C-6 | 0.09 g |
| Coupler C-10 | 0.90 g |
| Compound Cpd-E | 0.09 g |
| Compound Cpd-M | 0.05 mg |

-continued

| | |
|---|---|
| High-boiling organic solvent Oil-2 | 0.40 g |
| Additive P-2 | 0.10 g |
| Sixteenth Layer (First protective layer) | |
| Gelatin | 1.30 g |
| Ultraviolet ray absorber U-1 | 0.10 g |
| Ultraviolet ray absorber U-2 | 0.03 g |
| Ultraviolet ray absorber U-5 | 0.20 g |
| Compound Cpd-F | 0.40 g |
| Compound Cpd-J | 0.06 g |
| Dye D-1 | 0.01 g |
| Dye D-2 | 0.01 g |
| Dye D-3 | 0.01 g |
| Dye D-5 | 0.01 g |
| High-boiling organic solvent Oil-2 | 0.37 g |
| Seventeenth Layer (Second protective layer) | |
| Silver iodobromide emulsion of fine grains (average grain diameter 0.06 μm, silver iodide content 1 mol %) | silver 0.05 g |
| Gelatin | 1.80 g |
| Compound Cpd-L | 0.8 mg |
| Polymethyl methacrylate (average grain diameter 1.5 μm) | 5.00 g |
| Copolymer of methyl methacrylate and methacrylic acid (6:4) (average grain diameter 1.5 μm) | 0.10 g |
| Silicon oil SO-1 | 0.030 g |
| Surface active agent W-2 | 0.030 g |
| P-3 | 0.14 g |

Further, to all emulsion layers, in addition to the above-described components, additives F-1 to F-11 were added. Further, to each layer, in addition to the above-described components, gelatin hardener H-1 and surface active agents W-1, W-3, W-4, W-5, and W-6 for coating and emulsifying were added.

Further, as antifungal and antibacterial agents, phenol, 1,2-benzisothiazoline-3-one, 2-phenoxyethanol, phenetylalcohol, and p-hydroxybenzoic acid butyl ester were added.

The light-sensitive emulsions used for preparation of Sample 301 were shown in Table 6.

TABLE 6

| Emulsion | Diameter corresponding to sphere (μm) | Deviation coefficient of diameter corresponding to sphere (%) | Average aspect ratio of all grains (diameter corresponding to sphere/thickness) | Iodine content (mol %) | Sensitizing dye kind | Sensitizing dye Amount to be added (× $10^{-4}$ mol/mol Ag) | Sensitizing dye kind | Sensitizing dye Amount to be added (× $10^{-4}$ mol/mol Ag) | Sensitizing dye kind | Sensitizing dye Amount to be added (× $10^{-4}$ mol/mol Ag) |
|---|---|---|---|---|---|---|---|---|---|---|
| A | 0.20 | 16 | 1.6 | 4.0 | S-1 | 8.1 | | | S-3 | 0.3 |
| B | 0.25 | 15 | 3.0 | 4.0 | S-1 | 8.9 | | | S-3 | 0.3 |
| C | 0.22 | 14 | 2.5 | 4.0 | S-1 | 8.8 | S-2 | 0.2 | S-3 | 0.2 |
| D | 0.35 | 10 | 3.6 | 4.0 | S-1 | 9.8 | S-2 | 0.3 | S-3 | 0.2 |
| E | 0.49 | 16 | 5.0 | 2.0 | S-1 | 6.7 | S-2 | 0.5 | S-3 | 0.2 |
| F | 0.15 | 15 | 1.0 | 3.5 | S-4 | 15.1 | S-5 | 1.5 | | |
| G | 0.23 | 14 | 1.9 | 3.5 | S-4 | 10.4 | S-5 | 2.0 | | |
| H | 0.32 | 11 | 2.4 | 3.5 | S-4 | 7.5 | S-5 | 1.4 | | |
| I | 0.28 | 11 | 4.5 | 3.3 | S-4 | 7.7 | S-5 | 1.4 | | |
| J | 0.40 | 16 | 4.0 | 3.3 | S-4 | 7.2 | S-5 | 1.4 | | |
| K | 0.59 | 20 | 5.9 | 2.8 | S-4 | 6.4 | S-5 | 1.2 | | |
| L | 0.24 | 14 | 3.4 | 4.6 | S-6 | 6.5 | S-7 | 2.5 | | |
| M | 0.30 | 10 | 3.0 | 4.6 | S-6 | 6.2 | S-7 | 2.0 | | |
| N | 0.40 | 9 | 4.5 | 1.6 | S-6 | 5.6 | S-7 | 1.8 | | |

TABLE 6-continued

| Emulsion | Diameter corresponding to sphere (μm) | Deviation coefficient of diameter corresponding to sphere (%) | Average aspect ratio of all grains (diameter corresponding to sphere/thickness) | Iodine content (mol %) | Sensitizing dye kind | Sensitizing dye Amount to be added (× $10^{-4}$ mol/mol Ag) | Sensitizing dye kind | Sensitizing dye Amount to be added (× $10^{-4}$ mol/mol Ag) | Sensitizing dye kind | Sensitizing dye Amount to be added (× $10^{-4}$ mol/mol Ag) |
|---|---|---|---|---|---|---|---|---|---|---|
| O | 0.60 | 15 | 5.5 | 1.0 | S-6 | 4 | S-7 | 1.5 | | |
| P | 0.80 | 18 | 25 | 1.0 | S-6 | 3.4 | S-7 | 1.1 | | |

Note 1) Each of emulsions described above was subjected to chemical sensitization using gold/sulfur/selenium.

Note 2) To each emulsions described above, sensitizing dyes were added prior to chemical sensitization.

Note 3) To each emulsions described above, compounds F-5, F-7, F-8, F-9, F-10, F-11, F-12, F-13, F-14, and F-15 were added appropriately.

Note 4) Emulsions described above contain triple structured tabular grains, and the main plane of those grains was a (100) plane for emulsions A, B, I, J and a (111) plane for the other emulsions.

Note 5) Emulsions A, B, E, F, I, P were emulsions containing grains whose internal sensitivity was higher than its surface sensitivity.

Note 6) Emulsions E, I, P contained grains obtained by making epitaxial growth of silver chloride after chemical sensitization.

Note 7) In grains of emulsions other than emulsions A, E, F, at least 50 dislocation lines per grain were observed by means of a transmission-type election microscope.

C-1

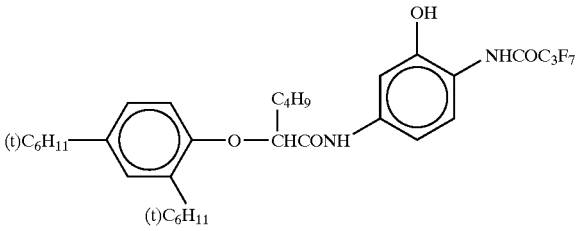

C-2

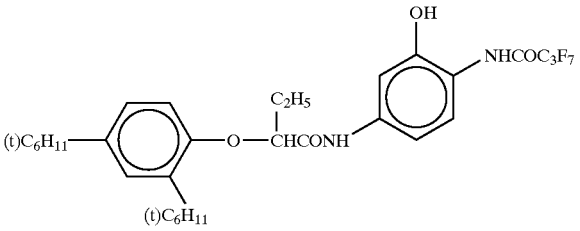

C-3

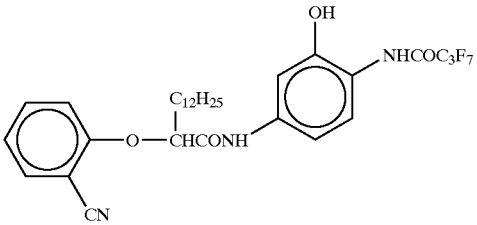

C-4

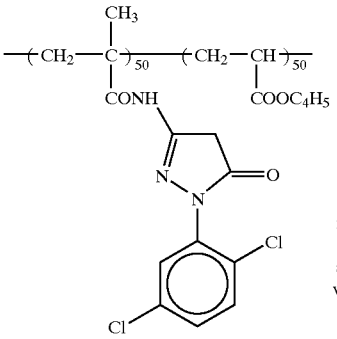

numerical value is in terms of wt% average molecular weight: c.a. 25,000

C-5

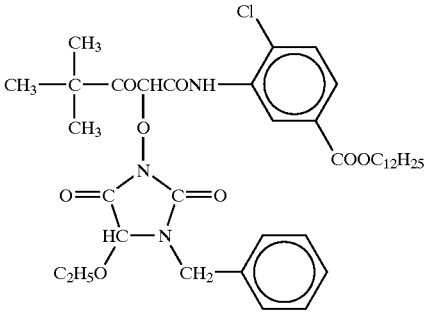

C-6

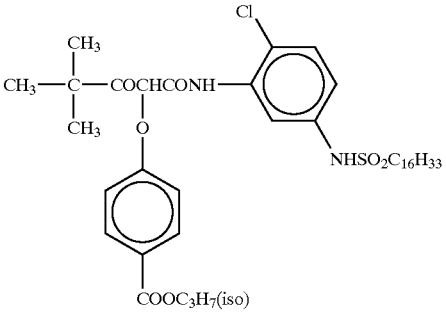

-continued
C-7
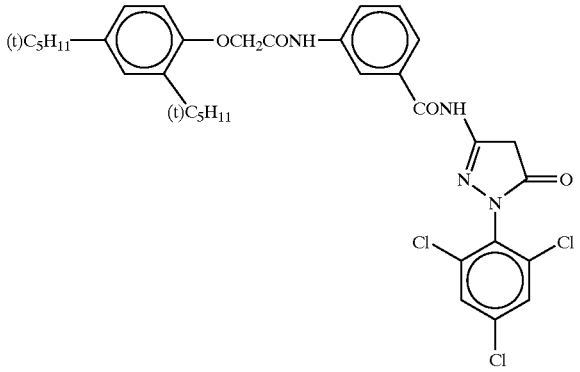
C-8
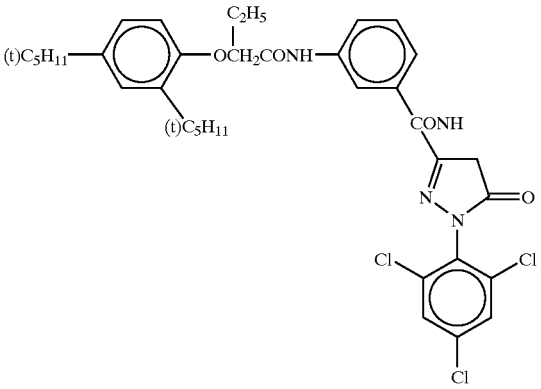
C-9
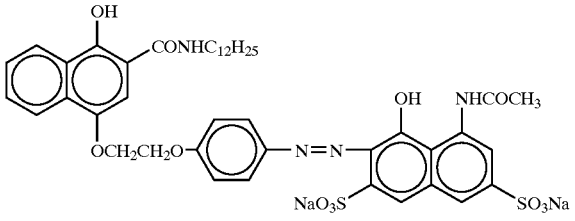
C-10
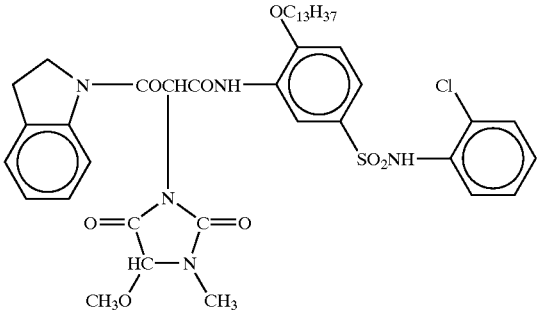
Oil-1
Dibutyl phthalate
Oil-2
Tricresyl phosphate
Oil-3
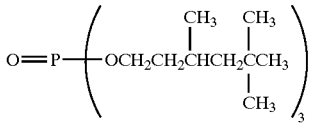
Cpd-A
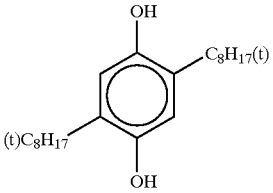
Cpd-B
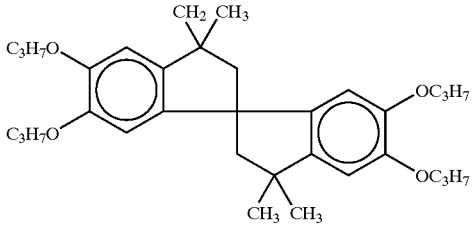
Cpd-C
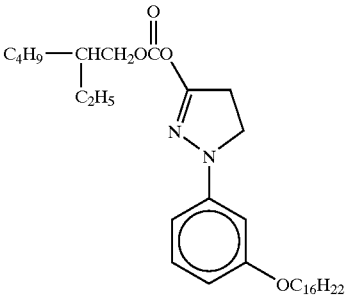
Cpd-D
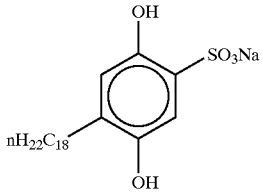
Cpd-E
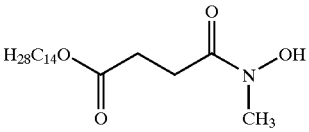

-continued
Cpd-F
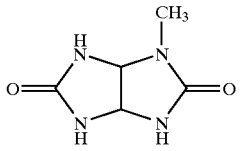
Cpd-G
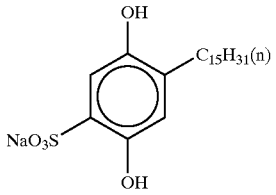
Cpd-H
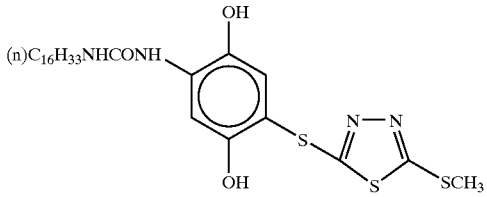
Cpd-I
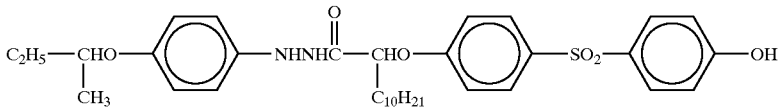
Cpd-J
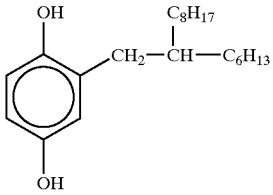
Cpd-K
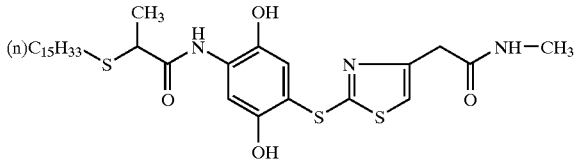
Cpd-L
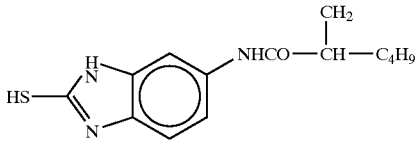
Cpd-M
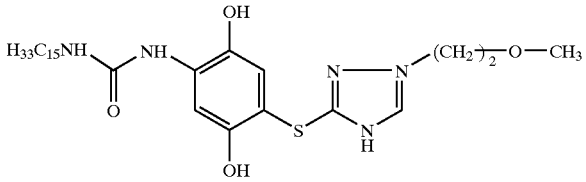
U-1
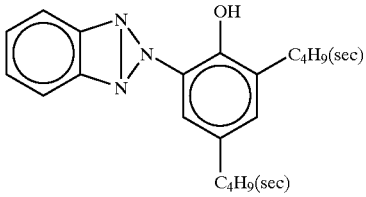
U-2
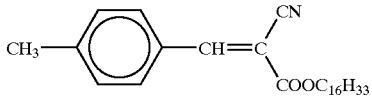
U-3
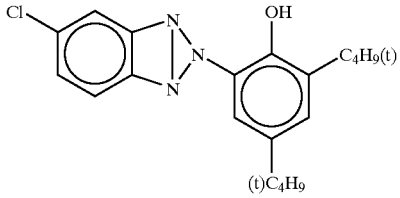
U-4
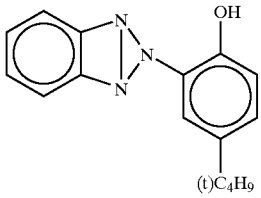
U-5
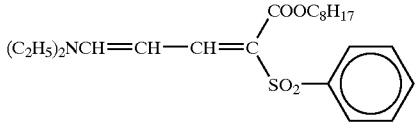
S-1
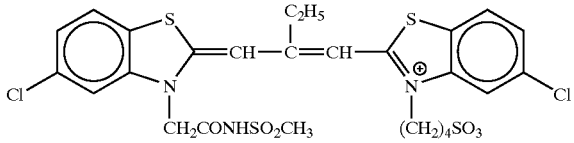

-continued
S-2
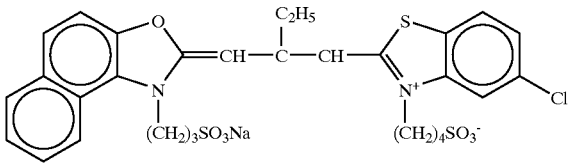
S-3
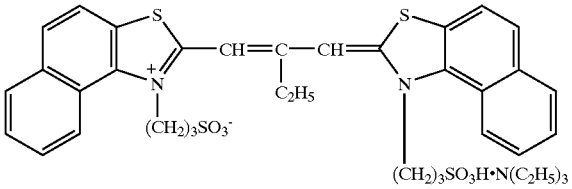
S-4
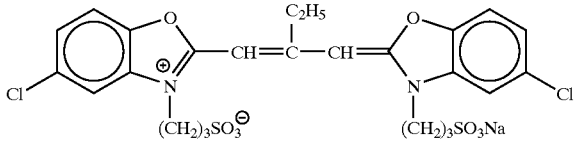
S-5
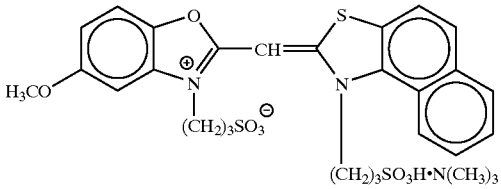
S-6
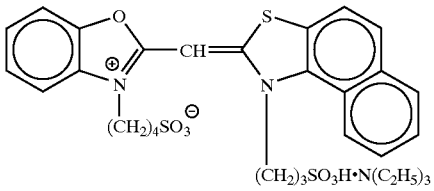
S-7
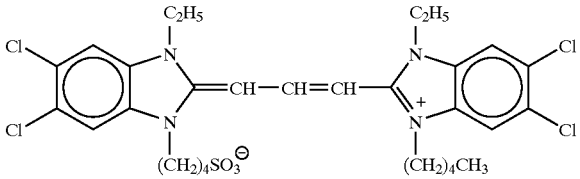
D-1
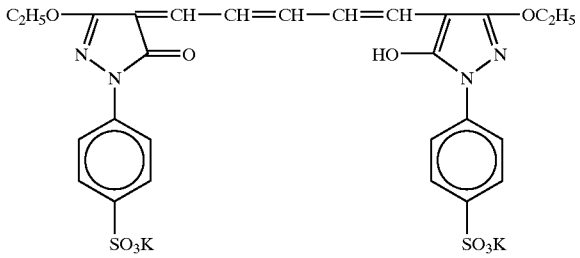
D-2
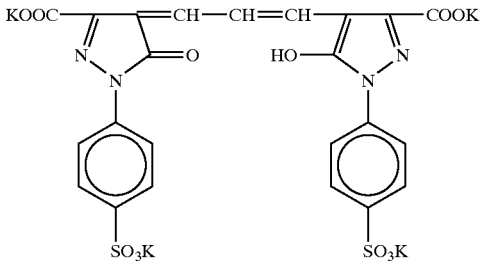
D-3
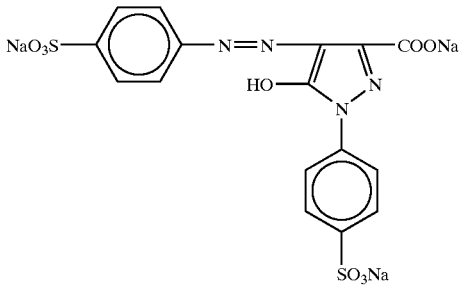
D-4
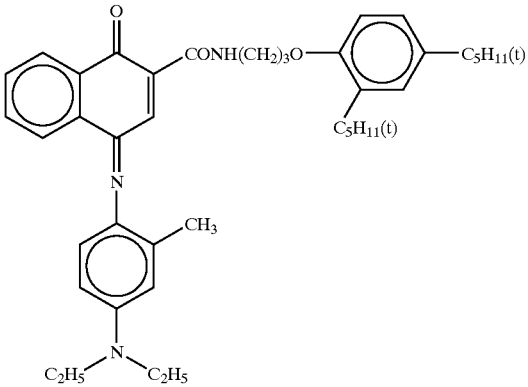
D-5
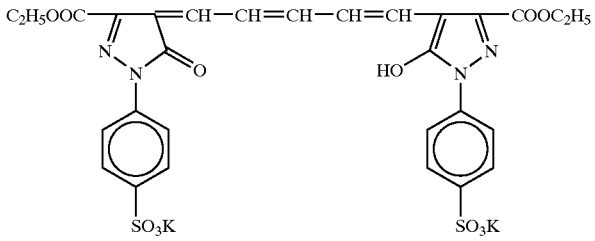
D-6
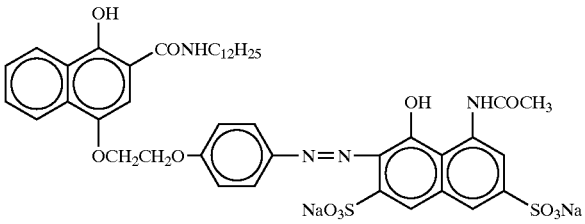

-continued
E-1
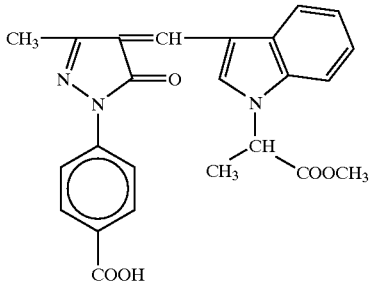
H-1
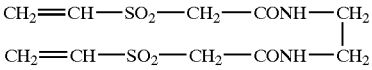
W-1
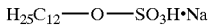
W-2
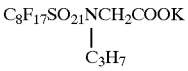
W-3
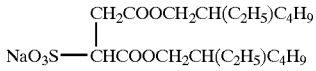
W-4
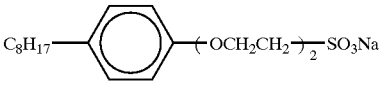
W-5
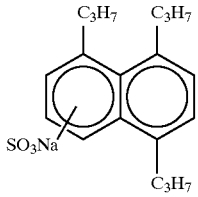
W-6
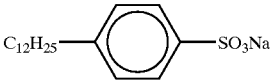
P-1
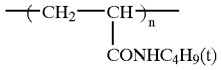
n = 1,000
P-4
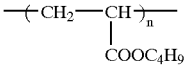
n = 1,000
SO-1
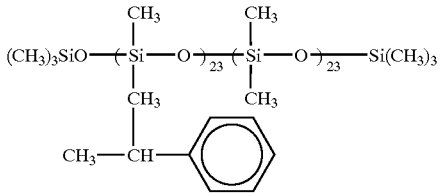
F-1
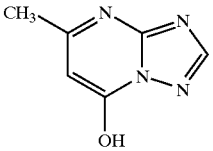
F-2
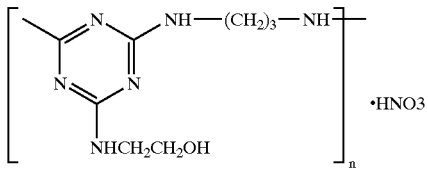
(n = 3~4)
F-3
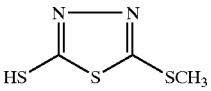
F-4
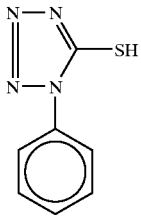
F-5
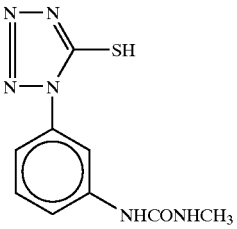

-continued
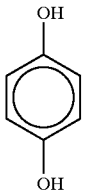
F-6
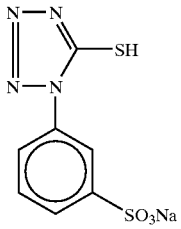
F-7
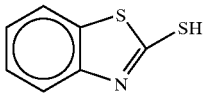
F-8
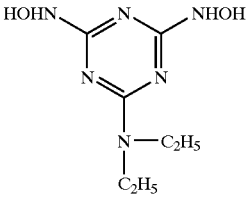
F-9
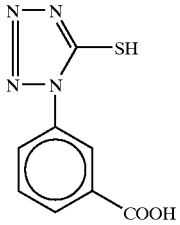
F-10
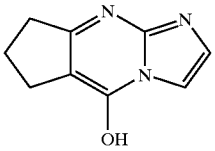
F-11
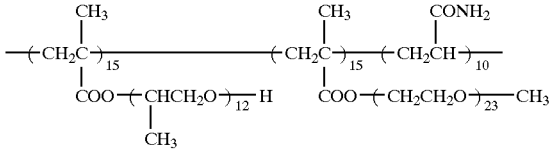
F-12
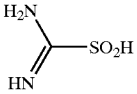
F-13
$K_2IrCl_5$
F-14
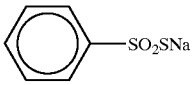
F-15
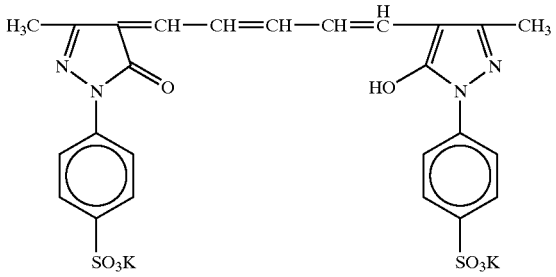
D-7
Copolymer of polybutyl acrylate/acrylic acid in 95:5
P-2
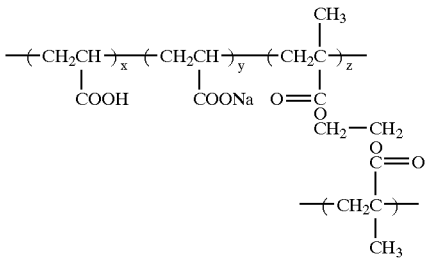
P-3
X:Y:Z = 42.5:7.5:50
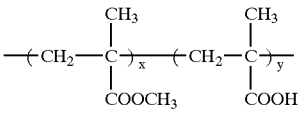
B-1
x/y = 90/10

-continued

B-2

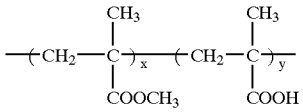

x/y = 60/40

The thus-obtained Sample 301 was exposed imagewise. The exposed sample was subjected to a color reversal processing in accordance with the processing steps described below. The processing was practiced by a system in which a sample is conveyed while being hanged on a hanger.

(Processing)

| Processing step | Time | Temperature | Tank volume | Replenisher |
|---|---|---|---|---|
| 1st development | 6 min | 38° C. | 12 liters | 2,200 ml/m$^2$ |
| 1st Water-washing | 2 min | 38° C. | 4 liters | 7,500 ml/m$^2$ |
| Reversal | 2 min | 38° C. | 4 liters | 1,100 ml/m$^2$ |
| Color development | 6 min | 38° C. | 12 liters | 2,200 ml/m$^2$ |
| Pre-bleaching | 2 min | 38° C. | 4 liters | 1,100 ml/m$^2$ |
| Bleaching | 6 min | 38° C. | 2 liters | 220 ml/m$^2$ |
| Fixing | 4 min | 38° C. | 8 liters | 1,100 ml/m$^2$ |
| 2st Water-washing | 4 min | 38° C. | 8 liters | 7,500 ml/m$^2$ |
| Final rinse | 1 min | 25° C. | 2 liters | 1,100 ml/m$^2$ |

Compositions of each processing solutions used were as follows:

| | Tank solution | Replenisher |
|---|---|---|
| [First developer] | | |
| Pentasodium nitrilo-N,N,N-trimethylene-phosphonate | 1.5 g | 1.5 g |
| Pentasodium diethylenetriamine pentaacetate | 2.0 g | 2.0 g |
| Sodium sulfite | 30 g | 30 g |
| Hydroquinone/potassium monosulfonate | 20 g | 20 g |
| Potassium carbonate | 15 g | 20 g |
| Sodium bicarbonate | 12 g | 15 g |
| 1-Phenyl-4-methyl-4-hydroxymethyl-3-pyrazolydone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethylene glycol | 13 g | 15 g |
| Water to make | 1,000 ml | 1,000 ml |
| pH | 9.60 | 9.60 |
| (pH was adjusted by using sulfuric acid or potassium hydroxide.) | | |
| [Reversal solution] | | |
| Pentasodium nitrilo-N,N,N-trimethylene-phosphonate | 3.0 g | Same to Tank solution |
| Stannous chloride dihydrate | 1.0 g | |
| p-Aminophenol | 0.1 g | |
| Sodium hydroxide | 8 g | |
| Glacial acetic acid | 15 ml | |
| Water to make | 1,000 ml | |
| pH | 6.00 | |
| (pH was adjusted by using acetic acid or sodium hydroxide. | | |
| [Color developer] | | |
| Pentasodium nitrilo-N,N,N-trimethylene-phosphonate | 2.0 g | 2.0 g |
| Sodium sulfite | 7.0 g | 7.0 g |
| Trisodium phosphate 12-hydrate | 36 g | 36 g |
| Potassium bromide | 1.0 g | — |
| Potassium iodide | 90 mg | — |
| Sodium hydroxide | 3.0 g | 3.0 g |
| Cytrazinic acid | 1.5 g | 1.5 g |
| N-Ethyl-N-(β-methane-sulfonamidoethyl)-3-methyl-4-aminoaniline-3/2 sulfate-mono hydrate | 11 g | 11 g |
| 3,6-Dithiaoctane-1,8-diol | 1.0 g | 1.0 g |
| Water to make | 1,000 ml | 1,000 ml |
| pH | 11.80 | 11.80 |
| (pH was adjusted by using acetic acid or potassium hydroxide.) | | |
| [Pre-bleaching solution] | | |
| Disodium ethylenediamine-tetraacetate dihydrate | 8.0 g | 8.0 g |
| Sodium sulfite | 6.0 g | 8.0 g |
| 1-Thioglycerol | 0.4 g | 0.4 g |
| Formaldehyde-sodium bisulfite adduct | 30 g | 35 g |
| Water to make | 1,000 ml | 1,000 ml |
| pH | 6.30 | 6.10 |
| (pH was adjusted by using acetic acid or sodium hydroxide.) | | |
| [Bleaching solution] | | |
| Disodium ethylenediamine-tetraacetate dihydrate | 2.0 g | 4.0 g |
| Iron (III) ammonium ethylenediaminetetraacetate dihydrate | 120 g | 240 g |
| Potassium bromide | 100 g | 200 g |
| Ammonium nitrate | 10 g | 20 g |
| Water to make | 1,000 ml | 1,000 ml |
| pH | 5.70 | 5.50 |
| (pH was adjusted by using nitric acid or sodium hydroxide.) | | |
| [Fixing solution] | | |
| Ammonium thiosulfate | 80 g | Same to tank solution |
| Sodium sulfite | 5.0 g | Same to tank solution |
| Sodium bisulfite | 5.0 g | Same to tank solution |
| Water to make | 1,000 ml | 1,000 ml |
| pH | 6.60 | |

-continued

| | | |
|---|---|---|
| (pH was adjusted by using acetic acid or aqueous ammonia.) | | |
| [Stavilizing solution] | | |
| 1,2-benzoisothiazoline-3-one | 0.02 g | 0.03 g |
| Polyoxyethylene-p-monononyl phenyl ether (av. polymerization degree: 10) | 0.3 g | 0.3 g |
| Polymaleic acid (av. molecular weight: 2000) | 0.1 g | 0.15 g |
| Water to make | 1,000 ml | 1,000 ml |
| pH | 7.0 | 7.0 |

It was observed that the sample according to the present invention was excellent in such properties as sensitivity (speed), gradation, sharpness, color balance at the time of push-processing, silver removal characteristics, and pressure-induced sensitization/desensitization. Further, neither defect nor unevenness were found in the sample.

Example 4

(Preparation of Sample 401)

1) Support

The support that was used in this example was prepared as follows:

100 weight parts of polyethylene-2,6-naphthalate polymer, and 2 weight parts of Tinuvin P. 326 (trade name, manufactured by Ciba-Geigy Co.), as an ultraviolet absorbing agent, were dried, then melted at 300° C.; subsequently they were extruded through a T-type die, and stretched 3.3 times in the lengthwise direction at 140° C., and then 3.3 times in the width direction at 130° C.; and further they were thermally fixed for 6 seconds at 250° C., thereby a PEN film having a thickness of 90 μm was obtained. To the PEN film, appropriate amounts of a blue dye, a magenta dye, and a yellow dye (I-1, I-4, I-6, I-24, I-26, I-27, and II-5, as described in Kokai Giho: Kogi No. 94-6023) were added. Further, this film was wound around a stainless steel core (spool) having a diameter of 20 cm, and thermal history was imparted thereto at 110° C. for 48 hours, to obtain a support having suppressed core-set-curl.

2) Coating of an Undercoat Layer

After both surfaces of the above support were subjected to corona discharge, UV discharge, and glow discharge treatments, each side of the support was coated with an undercoat solution having a composition of 0.1 g/m$^2$ of gelatin, 0.01 g/m$^2$ of sodium a-sulfo-di-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of polyamide-epichlorohydrin polycondensation product (10 cc/m$^2$, a bar coater was used). The undercoat layer was provided on the side that was heated at a higher temperature at the time of stretching. Drying was carried out at 115° C. for 6 minutes (the roller and the transportation apparatus in the drying zone all were set at 115° C.).

3) Coating of a Backing Layer

An antistatic layer, a magnetic recording layer, and a slipping layer, each having the compositions mentioned below, were coated on one side of the above support coated with the undercoat layer, as a backing layer.

3-1) Coating of an Antistatic Layer 0.2 g/m$^2$ of a dispersion of fine grain powder of a composite of stannic oxide-antimony oxide having an average grain diameter of 0.005 μm, and the specific resistance of 5 Ω·cm (secondary aggregation grain diameter of about 0.08 μm) was coated with 0.05 g/m$^2$ of gelatin, 0.02 g/m$^2$ of $(CH_2{=}CHSO_2CH_2CH_2NHCO)_2CH_2$, 0.005 g/m$^2$ of poly (polymerization degree: 10)oxyethylene-p-nonylphenol, and resorsine.

3-2) Coating of a Magnetic Recording Layer

3-Poly(polymerization degree: 15)oxyethylene-propyloxytrimethoxysilan (15 weight %)-coated Co-γ-iron oxide (specific surface area, 43 m$^2$/g; major axis, 0.14 μm; minor axis, 0.03 μm; saturation magnetization, 89 emu/g, $Fe^{2+}/Fe^{3+}$=6/94; the surface was treated with 2 weight % respectively, based on iron oxide, of aluminum oxide and silicon oxide) (0.06 g/m$^2$), diacetylcellulose (dispersion of the iron oxide was carried out by an open kneader and a sand mill) (12 g/m$^2$), and $C_2H_5C(CH_2OCONH{-}C_6H_3(CH_3)NCO)_3$ (0.3 g/m$^2$), as a hardner, were coated using acetone, methylethylketone, and cyclohexanone, as solvents, by means of a bar coater, to obtain a magnetic recording layer having a thickness of 1.2 μm. Silica grains (0.3 μm), as a matting agent, and 3-poly(polymerization degree: 15)oxyethylene-propyloxytrimethoxysilan (15 weight %)-coated aluminum oxide (0.15 μm), as an abrasive, were each added thereto, to give a coverage of 10 mg/m$^2$. Drying was conducted at 115° C. for 6 min (the roller and the transportation apparatus in the drying zone all were set at 115° C.). The increment of the color density of $D^B$ of the magnetic recording layer was about 0.1 when X-light (blue filter) was used. The saturation magnetization moment of the magnetic recording layer was 4.2 emu/g, the coercive force was $7.3\times10^4$ A/m, and the squareness ratio was 65%.

3-3) Preparation of a Slipping Layer

Diacetyl cellulose (25 mg/m$^2$), and a mixture of $C_6H_{13}CE(OH)C_{10}H_{20}COOC_{40}H_{81}$ (Compound a, 6 mg/m$^2$) and $C_{50}H_{101}O(CH_2CH_2O)_{16}$ (Compound b, 9 mg/$^2$) were coated. When adding the mixture, the mixture was dissolved in a solution of xylene and propyleneglycol monomethylether (1/1) at 105° C., and this solution was poured into a 10-fold volume of propyleneglycol monomethylether (normal temperature) and finely dispersed. This was further dispersed in acetone, and the obtained dispersion (average grain diameter: 0.01 μm) was added to the coating solution. Silica grains (0.3 μm), as a matting agent, and 3-poly (polymerization degree, 15)oxyethylene-propyloxytrimethoxysilan (15 weight %)-coated aluminum oxide (0.15 μm), as an abrasive, were each added thereto, to give a coverage of 15 mg/m$^2$, respectively. The slipping layer was dried at 115° C. for 6 minutes (the roller and the transportation apparatus in the drying zone all were set at 115° C.). The slipping layer showed excellent performances of the coefficient of dynamic friction: 0.06 (a stainless steel hard ball of 5 mmϕ, diameter, load: 100 g, speed: 6 cm/min), and of the static friction coefficient: 0.07 (clip method). The sliding property of the slipping layer with the emulsion surface, which will be described below, was also excellent, such that the coefficient of dynamic friction was 0.12.

4) Coating of Light-sensitive Layers

Layers having the below-shown compositions were multi-coated on the support of the opposite side of the backing layer of the support, to prepare a multi-layer color light-sensitive material, Sample 401.

(Compositions of Light-sensitive Layers)

Main materials used in each layer were classified as follows:

ExC: Cyan coupler

ExM: Magenta coupler

ExY: Yellow coupler

ExS: Sensitizing dye

UV: Ultraviolet ray absorbent

HBS: High-boiling organic solvent

H': Gelatin hardening agent

Figures corresponding to each component represents the coating amount in terms of g/m$^2$ and for silver halide, in terms of silver. With respect to sensitizing dyes, the coating amount is shown in mol, per mol of the silver halide in the same layer.

(Sample 401)

| | |
|---|---|
| First Layer (First halation-prevention layer) | |
| Black colloidal silver | silver 0.08 |
| Gelatin | 0.70 |
| Second Layer (Second halation-preventing layer) | |
| Black colloidal silver | silver 0.09 |
| Gelatin | 1.00 |
| ExM-1 | 0.12 |
| ExF-1 | $2.0 \times 10^{-3}$ |
| Dispersion S-12 | 0.070 (in terms of solid Content) |
| HBS-1 | 0.15 |
| HBS-2 | 0.02 |
| Third Layer (Intermediate layer) | |
| ExC-2 | 0.05 |
| Polyethyl acrylate latex | 0.20 |
| Gelatin | 0.70 |
| Fourth Layer (Low-sensitivity red-sensitive emulsion layer) | |
| Silver bromoiodide emulsion A' | silver 0.20 |
| Silver bromoiodide emulsion B' | silver 0.23 |
| Silver bromoiodide emulsion C' | silver 0.10 |
| ExS-1 | $3.8 \times 10^{-4}$ |
| ExS-2 | $1.6 \times 10^{-5}$ |
| ExS-3 | $5.2 \times 10^{-4}$ |
| ExC-1 | 0.17 |
| ExC-2 | 0.02 |
| ExC-3 | 0.030 |
| ExC-4 | 0.10 |
| ExC-5 | 0.020 |
| ExC-6 | 0.010 |
| Cpd'-2 | 0.025 |
| HBS-1 | 0.10 |
| Gelatin | 1.10 |
| Fifth Layer (Medium-sensitivity red-sensitive emulsion layer) | |
| Silver bromoiodide emulsion C' | silver 0.15 |
| Silver bromoiodide emulsion D' | silver 0.46 |
| ExS-1 | $4.0 \times 10^{-4}$ |
| ExS-2 | $2.1 \times 10^{-5}$ |
| ExS-3 | $5.7 \times 10^{-4}$ |
| ExC-1 | 0.14 |
| ExC-2 | 0.02 |
| ExC-3 | 0.03 |
| ExC-4 | 0.090 |
| ExC-5 | 0.02 |
| ExC-6 | 0.01 |
| Cpd'-4 | 0.030 |
| Cpd'-2 | 0.05 |
| HBS-1 | 0.10 |
| Gelatin | 0.75 |
| Sixth Layer (High-sensitivity red-sensitive emulsion layer) | |
| Silver bromoiodide emulsion E' | silver 1.30 |
| ExS-1 | $2.5 \times 10^{-4}$ |
| ExS-2 | $1.5 \times 10^{-5}$ |
| ExS-3 | $3.6 \times 10^{-4}$ |
| ExC-1 | 0.12 |
| ExC-3 | 0.11 |
| ExC-6 | 0.020 |
| ExC-7 | 0.010 |
| Cpd'-2 | 0.050 |

-continued

| | |
|---|---|
| Cpd'-4 | 0.020 |
| HBS-1 | 0.22 |
| HBS-2 | 0.050 |
| Gelatin | 1.40 |
| Seventh Layer (Intermediate layer) | |
| Cpd'-1 | 0.060 |
| Dispersion S-9 | 0.030 (in terms of solid content) |
| HBS-1 | 0.040 |
| Polyethyl acrylate latex | 0.15 |
| Gelatin | 1.10 |
| Eighth Layer (Low-sensitivity green-sensitive emulsion layer) | |
| Silver bromoiodide emulsion F' | silver 0.22 |
| Silver bromoiodide emulsion G' | silver 0.35 |
| ExS-7 | $6.2 \times 10^{-4}$ |
| ExS-8 | $1.4 \times 10^{-4}$ |
| ExS-4 | $2.7 \times 10^{-5}$ |
| ExS-5 | $7.0 \times 10^{-5}$ |
| ExS-6 | $2.7 \times 10^{-4}$ |
| ExM-3 | 0.410 |
| ExM-4 | 0.086 |
| ExY-1 | 0.070 |
| ExY-5 | 0.0070 |
| HBS-1 | 0.30 |
| HBS-3 | 0.015 |
| Cpd'-4 | 0.010 |
| Gelatin | 0.95 |
| Ninth Layer (Medium-sensitivity green-sensitive emulsion layer) | |
| Silver bromoiodide emulsion G' | silver 0.48 |
| Silver bromoiodide emulsion H' | silver 0.48 |
| ExS-4 | $4.8 \times 10^{-5}$ |
| ExS-7 | $9.3 \times 10^{-4}$ |
| ExS-8 | $2.1 \times 10^{-4}$ |
| ExC-8 | 0.0020 |
| ExM-3 | 0.115 |
| ExM-4 | 0.035 |
| ExY-1 | 0.010 |
| ExY-4 | 0.010 |
| ExY-5 | 0.0050 |
| Cpd'-4 | 0.011 |
| HBS-1 | 0.13 |
| HBS-3 | $4.4 \times 10^{-3}$ |
| Gelatin | 0.80 |
| Tenth Layer (High-sensitivity green-sensitive emulsion layer) | |
| Silver bromoiodide emulsion I' | silver 1.30 |
| ExS-4 | $4.5 \times 10^{-5}$ |
| ExS-7 | $5.3 \times 10^{-4}$ |
| ExS-8 | $1.2 \times 10^{-4}$ |
| ExC-1 | 0.021 |
| ExM-1 | 0.010 |
| ExM-2 | 0.030 |
| ExM-5 | 0.0070 |
| ExM-6 | 0.0050 |
| Cpd'-3 | 0.017 |
| Cpd'-4 | 0.040 |
| HBS-1 | 0.25 |
| Polyethyl acrylate latex | 0.15 |
| Gelatin | 1.33 |
| Eleventh Layer (Yellow filter layer) | |
| Dispersion S-8 | 0.18 (in terms of solid content) |
| HBS-1 | 0.60 |
| Gelatin | 0.60 |
| Twelfth Layer (Low-sensitivity blue-sensitive emulsion layer) | |
| Silver bromoiodide emulsion J' | silver 0.13 |
| Silver bromoiodide emulsion K' | silver 0.15 |
| Silver bromoiodide emulsion L' | silver 0.38 |
| ExS-9 | $8.4 \times 10^{-4}$ |
| ExC-1 | 0.03 |

-continued

| | |
|---|---|
| ExC-8 | $7.0 \times 10^{-3}$ |
| ExY-1 | 0.050 |
| ExY-2 | 0.55 |
| ExY-3 | 0.49 |
| ExY-4 | 0.040 |
| ExC-7 | 0.005 |
| Cpd'-2 | 0.10 |
| Cpd'-4 | 0.01 |
| HBS-1 | 0.28 |
| Gelatin | 2.10 |
| Thirteenth Layer (High-sensitivity blue-sensitive emulsion layer) | |
| Silver bromoiodide emulsion M' | silver 0.70 |
| ExS-9 | $3.5 \times 10^{-4}$ |
| ExY-2 | 0.100 |
| ExY-3 | 0.035 |
| ExY-4 | 0.0050 |
| ExC-7 | 0.003 |
| Cpd'-2 | 0.10 |
| Cpd'-4 | 0.02 |
| HBS-1 | 0.081 |
| Gelatin | 0.55 |
| Fourteenth Layer (First protective layer) | |
| Silver bromoiodide emulsion N' | silver 0.10 |
| UV-1 | 0.13 |
| UV-2 | 0.10 |
| UV-3 | 0.16 |
| UV-4 | 0.025 |
| ExF-8 | 0.001 |
| ExF-9 | 0.002 |
| HBS-1 | $5.0 \times 10^{-2}$ |
| HBS-4 | $5.0 \times 10^{-2}$ |
| Gelatin | 1.8 |
| Fifteenth Layer (Second protective layer) | |
| H'-1 | 0.40 |
| B'-1 (diameter: 1.7 μm) | 0.06 |

-continued

| | |
|---|---|
| B'-2 (diameter: 1.7 μm) | 0.09 |
| B'-3 | 0.13 |
| ES-1 | 0.20 |
| Gelatin | 0.70 |

Further, in order to improve preservability, processability, pressure resistance, antimold and antibacterial properties, antistatic property, and coating property, compounds of W'-1 to W'-3, B'-4 to B'-6, and F'-1 to F'-18, and salts of iron, lead, gold, platinum, palladium, iridium, and rhodium were appropriately added in each layer.

TABLE 7

| Emulsion | Average AgI context (mol %) | Average grain diameter Sphere-equivalent diameter (μm) | Deviation coefficient concerning grain diameter (%) | Diameter of projected area assumed to be a circle (μm) | Ratio of diameter/thickness | Tabulability |
|---|---|---|---|---|---|---|
| A' | 3.7 | 0.37 | 13 | 0.43 | 2.3 | 12 |
| B' | 3.7 | 0.43 | 19 | 0.58 | 3.2 | 18 |
| C' | 5.0 | 0.55 | 20 | 0.86 | 6.2 | 45 |
| D' | 5.4 | 0.66 | 23 | 1.10 | 7.0 | 45 |
| E' | 4.7 | 0.85 | 22 | 1.36 | 5.5 | 22 |
| F' | 3.7 | 0.43 | 19 | 0.58 | 3.2 | 18 |
| G' | 5.4 | 0.55 | 20 | 0.86 | 6.2 | 45 |
| H' | 5.4 | 0.66 | 23 | 1.10 | 7.0 | 45 |
| I' | 7.5 | 0.85 | 24 | 1.30 | 5.0 | 19 |
| J' | 3.7 | 0.37 | 19 | 0.55 | 4.6 | 38 |
| K' | 4.7 | 0.37 | 19 | 0.55 | 4.6 | 38 |
| L' | 8.8 | 0.64 | 23 | 0.85 | 5.2 | 32 |
| M' | 8.8 | 1.05 | 20 | 1.46 | 3.7 | 9 |
| N' | 1.0 | 0.07 | — | — | 1.0 | — |

ExC–1

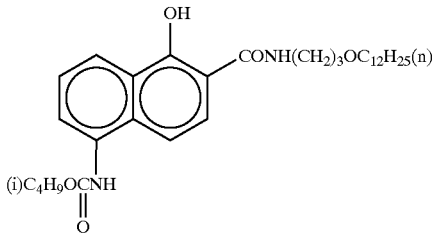

ExC–2

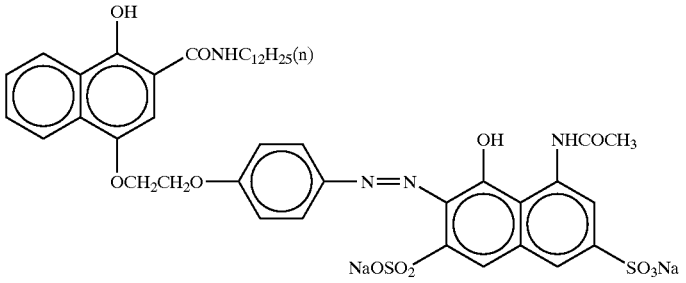

ExC–3

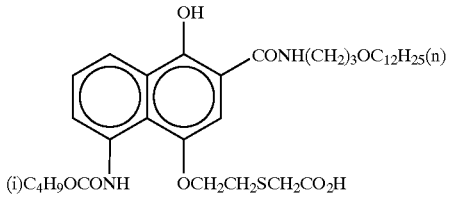

-continued
ExC−4
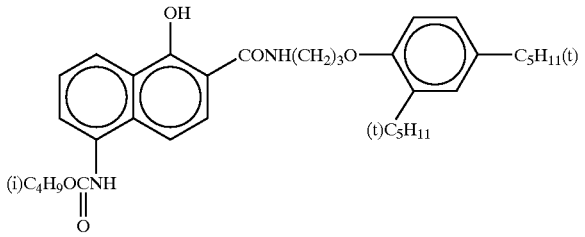
ExC−5
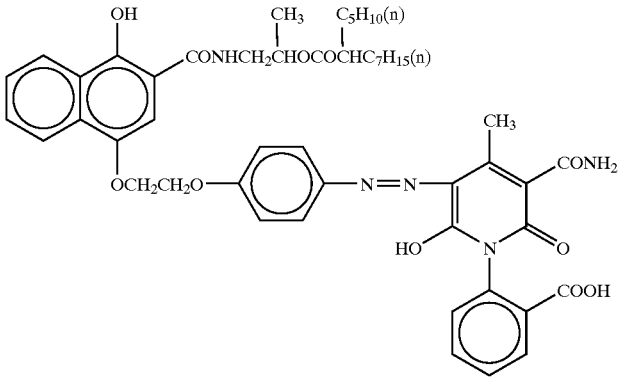
ExC−6
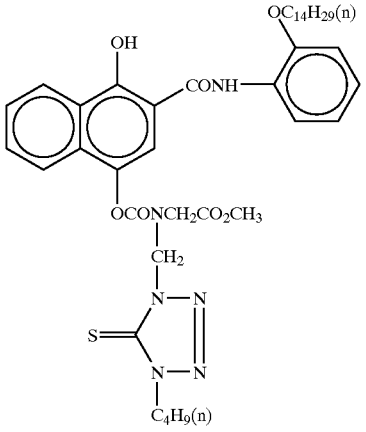
ExC−7
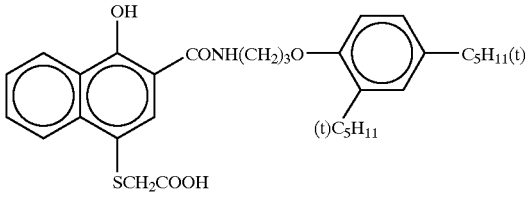

-continued
ExC−8
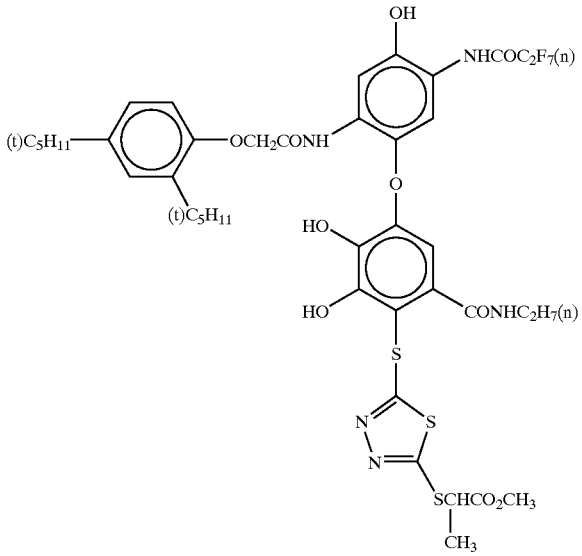
ExM−1
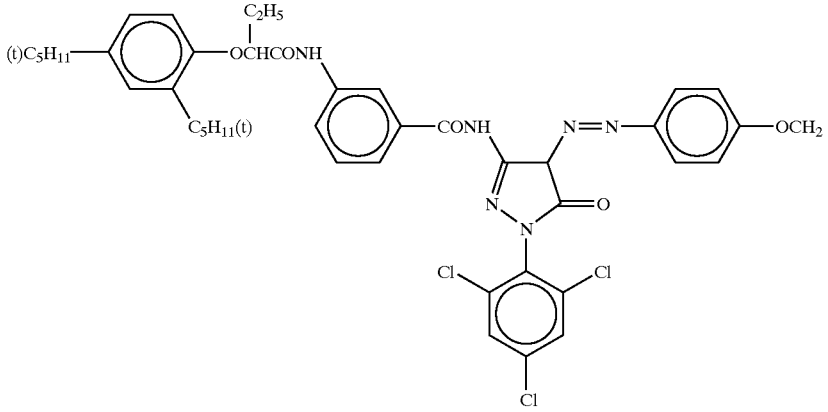
ExM-2
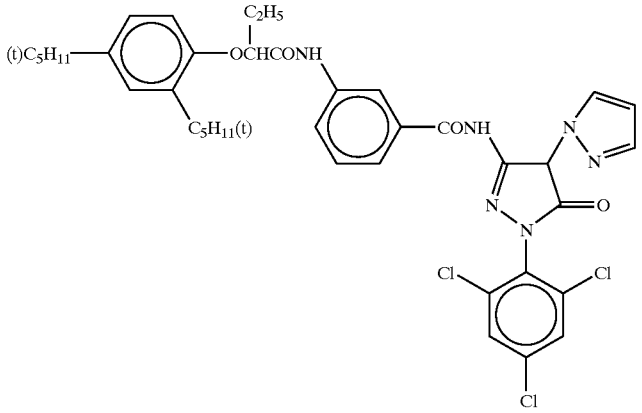

-continued
ExM-3
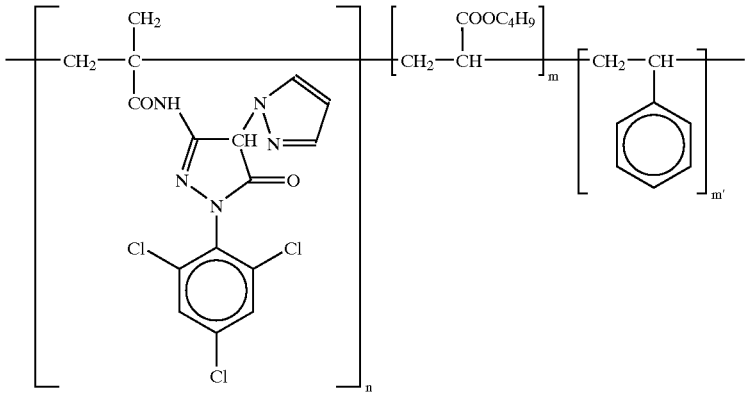
n = 50
m = 25
m′ = 25
mol. wt. c. a. 20,000
ExM-4
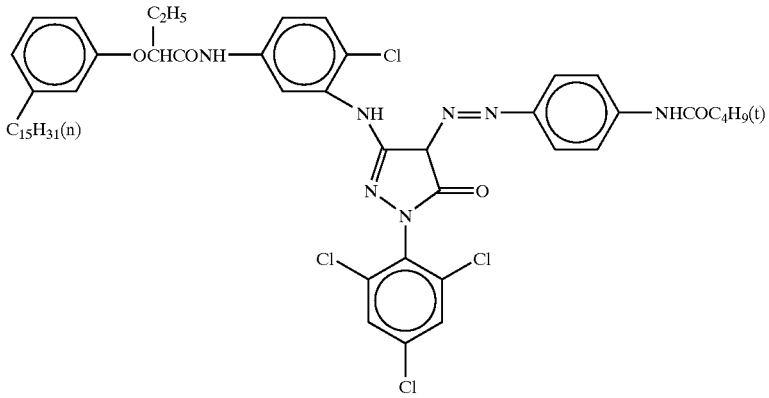
(2)
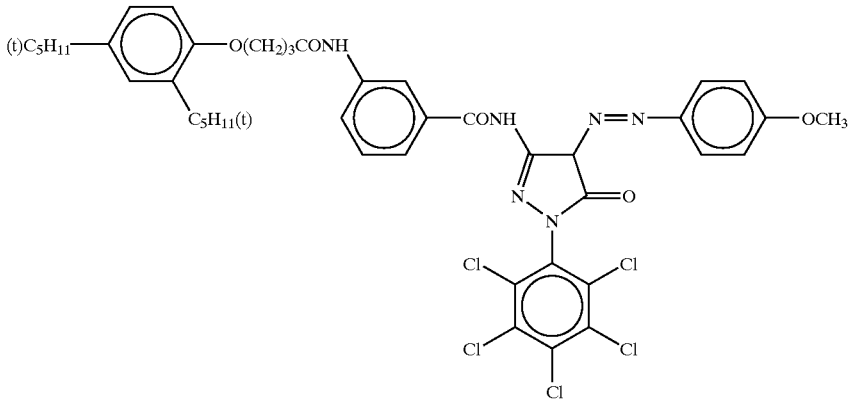
(1):(2) = 1:1(molar ratio)
ExM-5
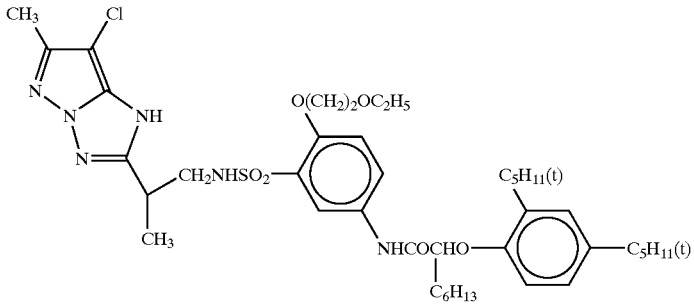

-continued
ExM-6
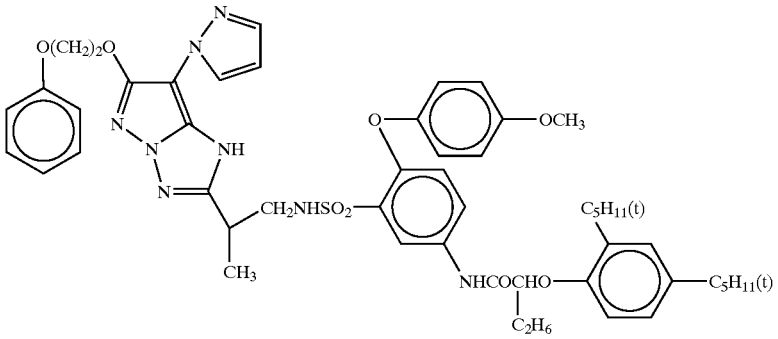
ExY-1
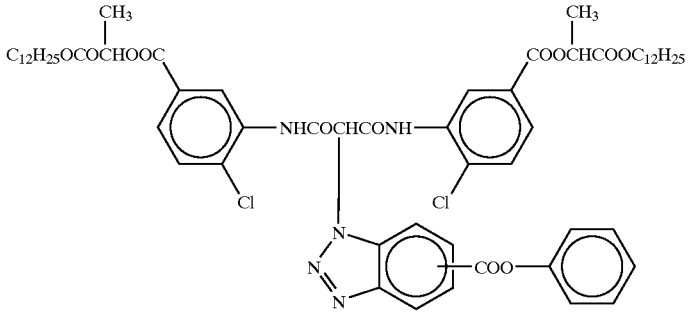
ExY-2
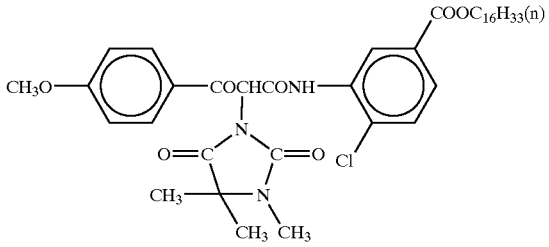
ExY-3
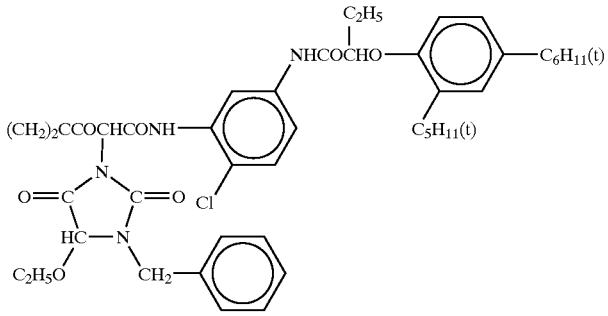
ExY-4
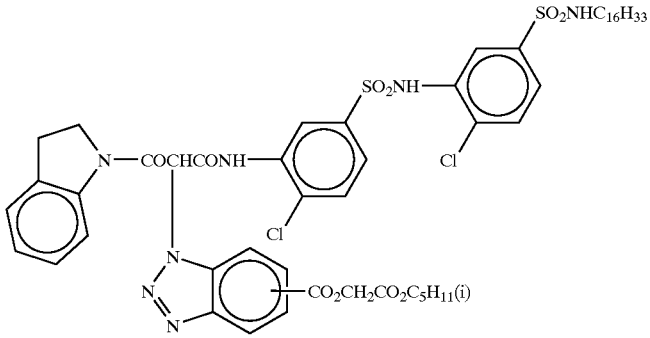

-continued
ExY-5
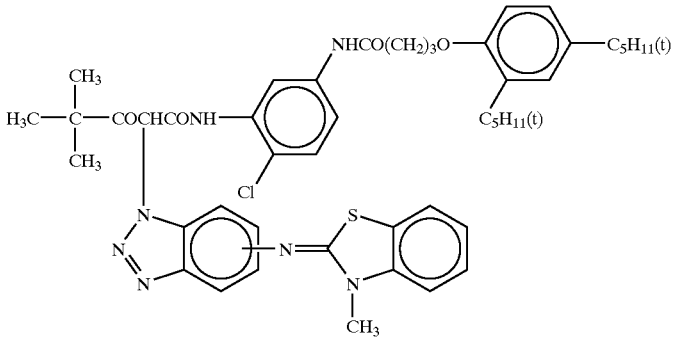
ExF-1
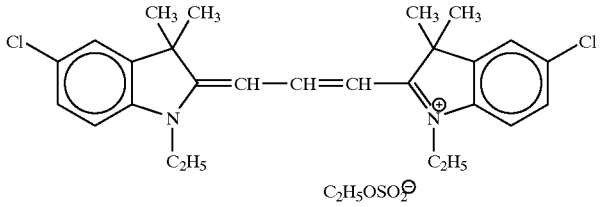
ExF-8
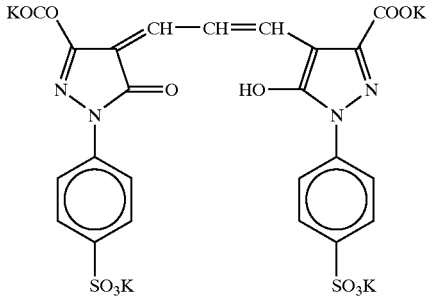
ExF-9
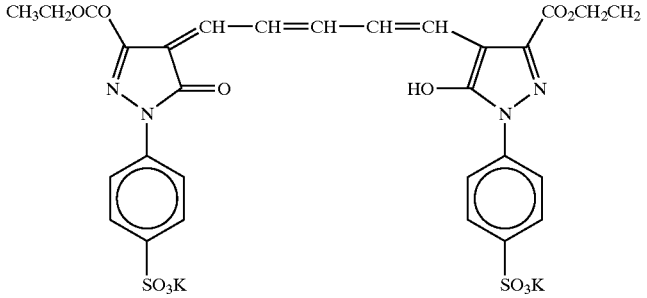
Cpd'-1
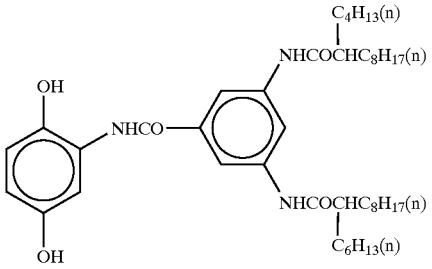

-continued
Cpd′-2
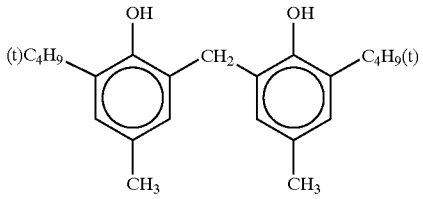
Cpd′-3
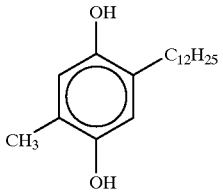
Cpd′-4
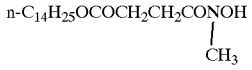
UV–1
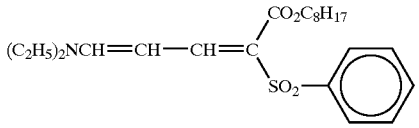
UV–2
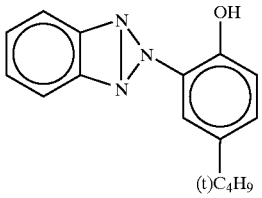
UV–3
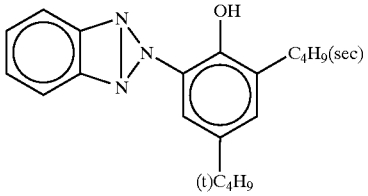
UV–4
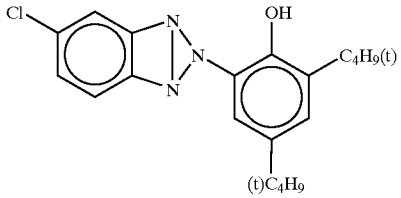
HBS–1
Tricresyl phosphate
HBS–2
Di-n-butyl phthalate
HBS–3
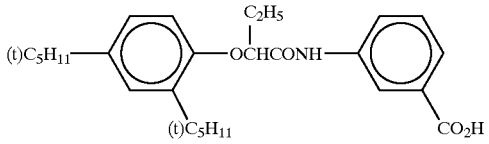

-continued
HBS-4
Tri (2-ethylhexyl) phosphate
ExS-1
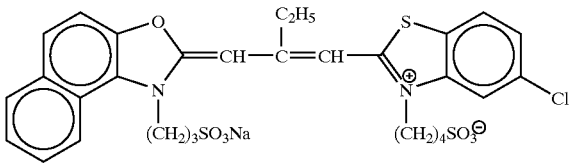
ExS-2
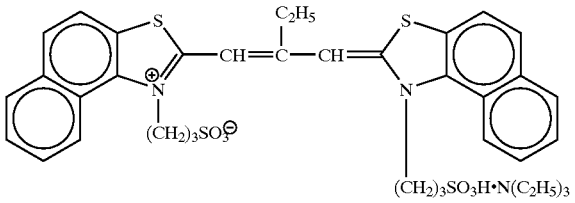
ExS-3
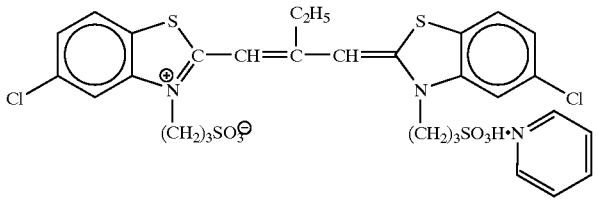
ExS-4
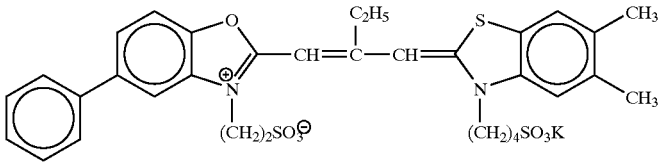
ExS-5
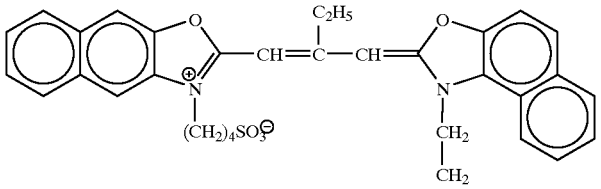
ExS-6
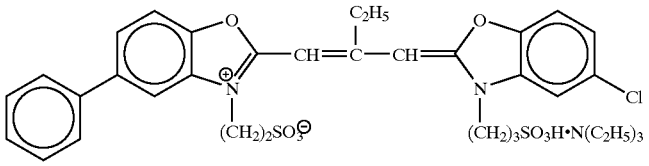
ExS-7
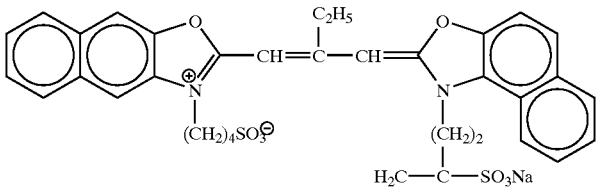
ExS-8
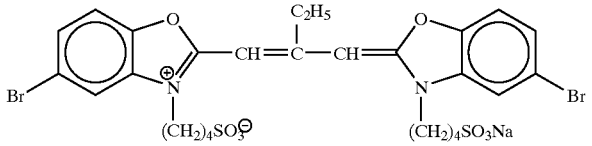

-continued
ExS-9
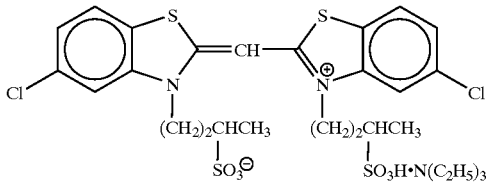
ES-1
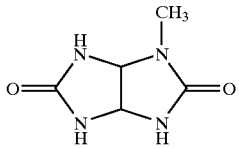
H′-1
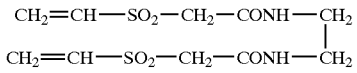
B′-1
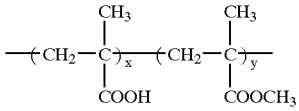
x/y = 10/90
Av. molecular weight:
c. a. 35,000
B′-2
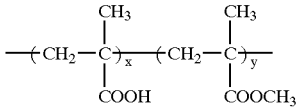
x/y = 40/60
Av. molecular weight:
c. a. 20,000
B′-3
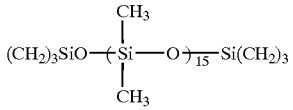
B′-4
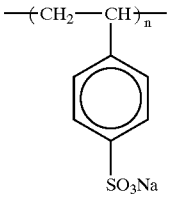
Av. molecular weight:
c. a. 750,000
B′−5
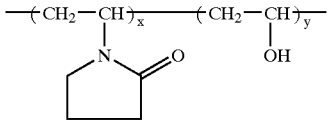
x/y = 70/30
Av. molecular weight:
c. a. 17,000
B′−6
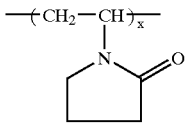
Av. molecular weight:
c. a. 10,000

-continued
W′−1
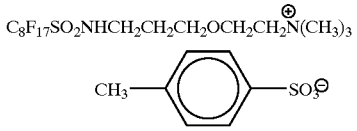
W′−2
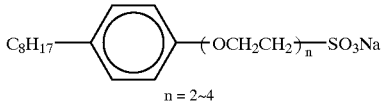
W′−3
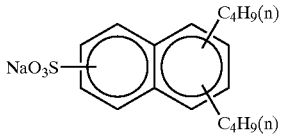
F′−1
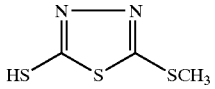
F′−2
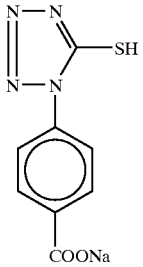
F′−3
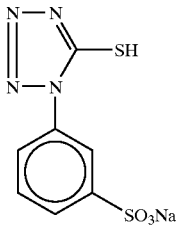
F′−4
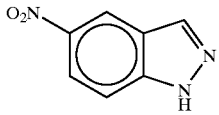
F′−5
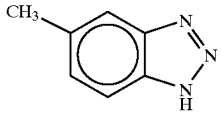
F′−6
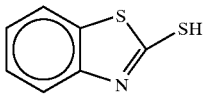
F′−7
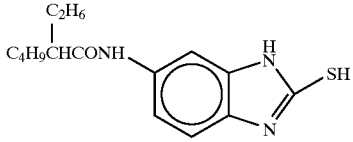

-continued
F′−8
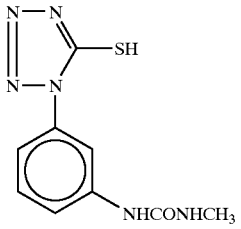
F′−9
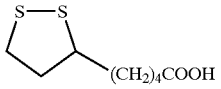
F′−10
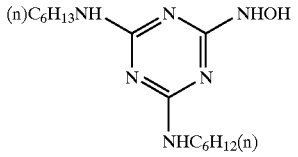
F′−11
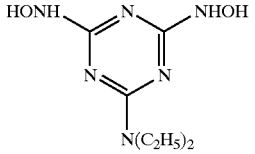
F′−12
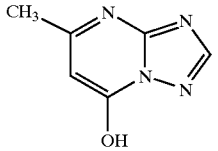
F′−13
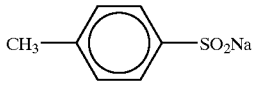
F′−14
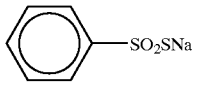
F′−15
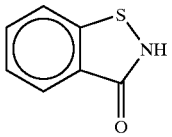
F′−16
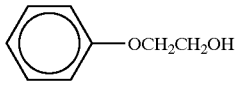
F′−17
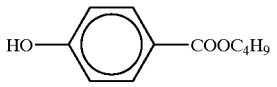
F′−18
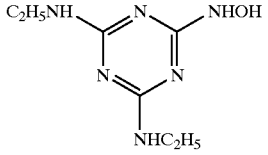

In Table 7, (1) Emulsions J' to M' were subjected to reduction sensitization using thiourea dioxide and thiosulfonic acid at the time of preparation of grains, according to the example described in JP-A-2-191938.

(2) Emulsions C' to E', G' to I', and M' were subjected to gold sensitization, sulfur sensitization and selenium sensitization under the presence of respective spectral sensitizing dyes described for each layer and sodium thiocyanate, according to the example described in JP-A-3-237450.

(3) At the preparation of tabular grains, low-molecular-weight gelatin was used, according to the example described in JP-A-1-158426.

(4) In tabular grains, were observed dislocation lines by a high-pressure electron microscope, as described in JP-A-3-237450.

(5) Emulsions A' to E', G', U', J' to M' contained Rh, Ir, and Fe, each in an optimum amount. Further, the tabulability of tabular silver halide grains is the value defined as $Dc/t^2$, wherein Dc is the average diameter of a circle having the same area as the projected area of each tabular grains (which is also referred to as the average circle-eguivalent diameter) and t is the average thickness of the tabular grains.

The thus-prepared light-sensitive material was cut into a strip having a length of 160 cm and a width of 24 mm. Two perforations of 2 mm square were made at intervals of 5.8 mm, located at the position of 0.7 mm in the width direction and at one side in the lengthwise direction of the light-sensitive material, respectively. Further, sets of such two perforations were made at intervals of 32 mm. The sample was encased in a plastic film cartridge (patrone, cassette), as illustrated in FIG. 1 to FIG. 7 of the above-described explanation.

FM signals were recorded at the 1,000/s conveying speed between the above-described perforations of the sample light-sensitive material, by means of a head which had a head gap of 5 $\mu$m from the magnetic recording layer-coated surface side of the sample, and which was capable for input and output of the turn number of 2,000.

The recorded samples were stored at 25° C., 55% relative humidity, for 3 days, and thereafter they were evaluated for the following properties.

(1) Photographic Property (Sensitivity)

Samples were cut into a desired length, and they were subjected to exposure of a given light amount of white light for 1/100 sec. using a wedge for sensitometry, followed by a color-development processing. As a result, it was observed that the sample according to the present invention was excellent in sensitivity, graininess (granularity), and color reproduction. Further, the change in these photographic properties at the time of storage was small.

(Processing Steps)

| Processing step | Processing time | Processing temperature | Replenisher* | Tank Volume |
|---|---|---|---|---|
| Color developing | 3 min 5 sec | 38.0° C. | 20 ml | 17 liters |
| Bleaching | 50 sec | 38.0° C. | 5 ml | 5 liters |
| Fixing (1) | 50 sec | 38.0° C. | — | 5 liters |
| Fixing (2) | 50 sec | 38.0° C. | 8 ml | 5 liters |
| Washing | 30 sec | 38.0° C. | 17 ml | 3.5 liters |

-continued (Processing Steps)

| Processing step | Processing time | Processing temperature | Replenisher* | Tank Volume |
|---|---|---|---|---|
| Stabilizing (1) | 20 sec | 38.0° C. | — | 3 liters |
| Stabilizing (2) | 20 sec | 38.0° C. | 15 ml | 3 liters |
| Drying | 1 min 30 sec | 60° C. | | |

Note: *Replenisher amount (ml) per 1.1 m of light-sensitive material of a 35-mm width (corresponding to one 24-Ex. film).

Stabilizing was carried out in a countercurrent mode from tank (2) to tank (1), and overflow solutions from washing were all introduced into fixing bath (2). Further, with respect to the fixing solutions, both tanks were connected by way of countercurrent piping from tank (2) to tank (1). In addition, the carried over amount of color developer to the bleaching step, the carried over amount of bleaching solution to the fixing step, and the carried over amount of fixing solution to the washing step, were, respectively, 2.5 ml, 2.0 ml, and 2.0 ml, per 1.1 m of the light-sensitive material of a 35-mm width. Each crossover time was 6 sec and it was included in the processing time of the preceding step.

Each opening area in the processor were 100 $cm^2$ for the color-developer, 120 $cm^2$ for the bleaching solution, and about 100 $cm^2$ for other processing solutions, respectively.

The composition of each processing solution was as follows, respectively:

| | Tank solution (g) | Replenisher (g) |
|---|---|---|
| (Color-developer) | | |
| Diethylenetriaminepentaacetic acid | 2.0 | 2.0 |
| 1-Hydroxyethylidene-1,1-diphosphonic acid | 2.0 | 2.0 |
| Sodium sulfite | 3.9 | 5.3 |
| Potassium carbonate | 37.5 | 39.0 |
| Potassium bromide | 1.4 | 0.4 |
| Potassium iodide | 1.3 mg | — |
| Disodium-N,N-bis(sulfonatoethyl) hydroxylamine | 2.0 | 2.0 |
| Hydroxylamine sulfate | 2.4 | 3.3 |
| 2-Methyl-4-[N-ethyl-N-(β-hydroxyethyl) amino]-aniline sulfonate | 4.5 | 6.4 |
| Water to make | 1.0 liter | 1.0 liter |
| pH | 10.05 | 10.18 |
| (pH was adjusted by potassium hydroxide and sulfuric acid.) | | |
| (Bleaching solution) | | |
| 1,3-Diaminopropanetetraacetic acid iron (III) ammonium monohydrate | 118 | 180 |
| Ammonium bromide | 80 | 115 |
| Ammonium nitrate | 14 | 21 |
| Succinic acid | 40 | 60 |
| Maleic acid | 33 | 50 |
| Water to make | 1.0 liter | 1.0 liter |
| pH | 4.4 | 4.0 |
| (pH was adjusted by aqueous ammonia.) | | |
| (Fixing solution) | | |
| Ammonium methanesulfinate | 10 | 30 |
| Ammonium methanethiosulfonate | 4 | 12 |
| Aqueous ammonium thiosulfate solution (700 g/liter) | 280 ml | 840 ml |

-continued

| | Tank solution (g) | Replenisher (g) |
|---|---|---|
| Imidazole | 7 | 20 |
| Ethylenediaminetetraacetic acid | 15 | 45 |
| Water to make | 1.0 liter | 1.0 liter |
| pH | 7.4 | 7.45 |
| (pH was adjusted by aqueous ammonia and acetic acid) | | |

(Washing Water)

Tap water was treated by passage through a mixed bed ion-exchange column filled with an H-type strong acidic cation exchange resin (Amberlite IR-120B, trade name, made by Rohm & Haas) and an OH-type strong basic anion exchange resin (Amberlite IR-400, the same as the above) so that the concentrations of Ca ions and Mg ions in water were both made to decrease to 3 mg/liter or below, followed by adding 20 mg/liter of sodium dichlorinated isocyanurate and 150 mg/liter of sodium sulfate. The pH of this water was in the range of 6.5 to 7.5.

| (Stabilizing solution) (Both tank solution and replenisher) | (g) |
|---|---|
| Sodium p-toluenesulfinate | 0.03 |
| Polyoxyethylene-p-monononylphenylether (av. polymerization degree: 10) | 0.2 |
| Disodium ethylenediaminetetraacetate | 0.05 |
| 1,2,4-Triazole | 1.3 |
| 1,4-Bis(1,2,4-triazole-1-ylmethyl)pyperazine | 0.75 |
| 1,2-Benzoisothiazoline-3-one | 0.10 |
| Water to make | 1.0 liter |
| pH | 8.5 |

Example 5

(Preparation of Sample 501)

The support used in this example was prepared in the same manner as in the preparation of the sample in the above Example 4, which support was provided the undercoat layer and the backing layer on the PEN base.

Layers having the below-shown compositions were multi-coated on the support of the opposite side of the backing layer of the support, to prepare a multi-layer color light-sensitive material, Sample 501.

(Compositions of Light-sensitive Layers)

Main materials used in each layer were classified as follows:

ExC': Cyan coupler

ExM': Magenta coupler

ExY': Yellow coupler

ExS': Sensitizing dye

UV': Ultraviolet ray absorbent

HBS': High-boiling organic solvent

H': Gelatin hardening agent

Figures corresponding to each component represents the coating amount in terms of g/m$^2$, and for silver halide, in terms of silver. With respect to sensitizing dyes, the coating amount is shown in mol, per mol of the silver halide in the same layer.

(Sample 501)

| | | |
|---|---|---|
| **First Layer (First halation-prevention layer)** | | |
| Black colloidal silver | silver | 0.155 |
| Silver bromoiodide emulsion P | silver | 0.01 |
| Gelatin | | 0.87 |
| ExC'-1 | | 0.002 |
| ExC'-3 | | 0.002 |
| Cpd"-2 | | 0.001 |
| HBS'-1 | | 0.004 |
| HBS'-2 | | 0.002 |
| **Second Layer (Second halation-preventing layer)** | | |
| Black colloidal silver | silver | 0.006 |
| Gelatin | | 0.407 |
| ExM'-1 | | 0.050 |
| ExF'-1 | | $2.0 \times 10^{-3}$ |
| HBS'-1 | | 0.074 |
| Solid dispersion S-12 | in terms of III-25 | 0.070 |
| **Third Layer (Intermediate layer)** | | |
| Silver bromoiodide emulsion O | | 0.020 |
| ExC'-2 | | 0.022 |
| Polyethyl acrylate latex | | 0.085 |
| Gelatin | | 0.294 |
| **Fourth Layer (Low-sensitivity red-sensitive emulsion layer)** | | |
| Silver bromoiodide emulsion A | silver | 0.323 |
| ExS'-1 | | $5.5 \times 10^{-4}$ |
| ExS'-2 | | $1.0 \times 10^{-5}$ |
| ExS'-3 | | $2.4 \times 10^{-4}$ |
| ExC'-1 | | 0.109 |
| ExC'-3 | | 0.044 |
| ExC'-4 | | 0.072 |
| ExC'-5 | | 0.011 |
| ExC'-6 | | 0.003 |
| Cpd"-2 | | 0.025 |
| Cpd"-4 | | 0.025 |
| HBS'-1 | | 0.17 |
| Gelatin | | 0.80 |
| **Fifth Layer (Medium-sensitivity red-sensitive emulsion layer)** | | |
| Silver bromoiodide emulsion B | silver | 0.28 |
| Silver bromoiodide emulsion C | silver | 0.54 |
| ExS'-1 | | $5.0 \times 10^{-4}$ |
| ExS'-2 | | $1.0 \times 10^{-5}$ |
| ExS'-3 | | $2.0 \times 10^{-4}$ |
| ExC'-1 | | 0.14 |
| ExC'-2 | | 0.026 |
| ExC'-3 | | 0.020 |
| ExC'-4 | | 0.12 |
| ExC'-5 | | 0.016 |
| ExC'-6 | | 0.007 |
| Cpd"-2 | | 0.036 |
| Cpd"-4 | | 0.028 |
| HBS'-1 | | 0.16 |
| Gelatin | | 1.18 |
| **Sixth Layer (High-sensitivity red-sensitive emulsion layer)** | | |
| Silver bromoiodide emulsion D | silver | 1.47 |
| ExS'-1 | | $3.7 \times 10^{-4}$ |
| ExS'-2 | | $1 \times 10^{-5}$ |
| ExS'-3 | | $1.8 \times 10^{-4}$ |
| ExC'-1 | | 0.18 |
| ExC'-3 | | 0.07 |
| ExC'-6 | | 0.029 |
| ExC'-7 | | 0.010 |
| ExY'-5 | | 0.008 |
| Cpd"-2 | | 0.046 |
| Cpd"-4 | | 0.077 |
| HBS'-1 | | 0.25 |
| HBS'-2 | | 0.12 |
| Gelatin | | 2.12 |

-continued

| Seventh Layer (Intermediate layer) | | |
|---|---|---|
| Cpd"-1 | | 0.089 |
| Solic dispersion S-9 | in terms of III-2 | 0.030 |
| HBS'-1 | | 0.050 |
| Polyethyl acrylate latex | | 0.83 |
| Gelatin | | 0.84 |
| **Eighth Layer (Layer imparting interlayer effect to the red-sensitive layers)** | | |
| Silver bromoiodide emulsion E | silver | 0.560 |
| ExS'-6 | | $1.7 \times 10^{-4}$ |
| ExS'-10 | | $4.6 \times 10^{-4}$ |
| Cpd"-4 | | 0.030 |
| ExM'-2 | | 0.096 |
| ExM'-3 | | 0.028 |
| ExY'-1 | | 0.031 |
| HBS'-1 | | 0.085 |
| HBS'-3 | | 0.003 |
| Gelatin | | 0.58 |
| **Ninth Layer (low-sensitivity green-sensitive emulsion layer)** | | |
| Silver bromoiodide emulsion F | silver | 0.39 |
| Silver bromoiodide emulsion G | silver | 0.28 |
| Silver bromoiodide emulsion H | silver | 0.35 |
| ExS'-4 | | $2.4 \times 10^{-5}$ |
| ExS'-5 | | $1.0 \times 10^{-4}$ |
| ExS'-6 | | $3.9 \times 10^{-4}$ |
| ExS'-7 | | $7.7 \times 10^{-5}$ |
| ExS'-8 | | $3.3 \times 10^{-4}$ |
| ExM'-2 | | 0.36 |
| ExM'-3 | | 0.045 |
| HBS'-1 | | 0.28 |
| HBS'-3 | | 0.01 |
| HBS'-4 | | 0.27 |
| Gelatin | | 1.39 |
| **Tenth Layer (Medium-sensitivity green-sensitive emulsion layer)** | | |
| Silver bromoiodide emulsion I | silver | 0.45 |
| ExS'-4 | | $5.3 \times 10^{-5}$ |
| ExS'-7 | | $1.5 \times 10^{-4}$ |
| ExS'-8 | | $6.3 \times 10^{-4}$ |
| ExC'-6 | | 0.009 |
| ExM'-2 | | 0.031 |
| ExM'-3 | | 0.029 |
| ExY'-1 | | 0.006 |
| ExM'-4 | | 0.028 |
| HBS'-1 | | 0.064 |
| HBS'-3 | | $2.1 \times 10^{-3}$ |
| Gelatin | | 0.44 |
| **Eleventh Layer (High-sensitivity green-sensitive emulsion layer)** | | |
| Silver bromoiodide emulsion I | silver | 0.19 |
| Silver bromoiodide emulsion J | silver | 0.80 |
| ExS'-4 | | $4.1 \times 10^{-5}$ |
| ExS'-7 | | $1.1 \times 10^{-4}$ |
| ExS'-8 | | $4.9 \times 10^{-4}$ |
| ExC'-6 | | 0.004 |
| ExM'-1 | | 0.016 |
| ExM'-3 | | 0.036 |
| ExM'-4 | | 0.020 |
| ExM'-5 | | 0.004 |
| ExY'-5 | | 0.003 |
| ExM'-2 | | 0.013 |
| Cpd"-3 | | 0.004 |
| Cpd"-4 | | 0.007 |
| HBS'-1 | | 0.18 |
| Polyethyl acrylate latex | | 0.099 |
| Gelatin | | 1.11 |
| **Twelfth Layer (Yellow filter layer)** | | |
| Yellow colloidal silver | silver | 0.047 |
| Cpd"-1 | | 0.16 |
| Solid dispersion T-13 | (in terms of IX-1) | 0.15 |
| HBS'-1 | | 0.082 |
| Gelatin | | 1.057 |

-continued

| Thirteenth Layer (Low-sensitivity blue-sensitive emulsion layer) | | |
|---|---|---|
| Silver bromoiodide emulsion K | silver | 0.18 |
| Silver bromoiodide emulsion L | silver | 0.20 |
| Silver bromoiodide emulsion M | silver | 0.07 |
| ExS'-9 | | $4.4 \times 10^{-4}$ |
| ExS'-10 | | $4.0 \times 10^{-4}$ |
| ExC'-1 | | 0.041 |
| ExC'-8 | | 0.012 |
| ExY'-1 | | 0.035 |
| ExY'-2 | | 0.71 |
| ExY'-3 | | 0.10 |
| ExY'-4 | | 0.005 |
| Cpd"-2 | | 0.10 |
| Cpd"-3 | | $4.6 \times 10^{-3}$ |
| HBS'-1 | | 0.24 |
| Gelatin | | 1.41 |
| **Fourteenth Layer (High-sensitivity blue-sensitive emulsion layer)** | | |
| Silver bromoiodide emulsion N | silver | 0.75 |
| ExS'-9 | | $3.6 \times 10^{-4}$ |
| ExC'-1 | | 0.013 |
| ExY'-2 | | 0.031 |
| ExY'-3 | | 0.05 |
| ExY'-6 | | 0.062 |
| Cpd"-2 | | 0.075 |
| Cpd"-3 | | $1.0 \times 10^{-3}$ |
| HBS'-1 | | 0.10 |
| Gelatin | | 0.91 |
| **Fifteenth Layer (First protective layer)** | | |
| Silver bromoiodide emulsion O | silver | 0.30 |
| UV'-1 | | 0.21 |
| UV'-2 | | 0.13 |
| UV'-3 | | 0.20 |
| UV'-4 | | 0.025 |
| F'-18 | | 0.009 |
| HBS'-1 | | 0.12 |
| HBS'-4 | | $5.0 \times 10^{-2}$ |
| Gelatin | | 2.3 |
| **Sixteenth Layer (Second protective layer)** | | |
| H"-1 | | 0.40 |
| B"-1 (diameter: 1.7 μm) | | $5.0 \times 10^{-2}$ |
| B"-2 (diameter: 1.7 μm) | | 0.15 |
| B"-3 | | 0.05 |
| S'-1 | | 0.20 |
| Gelatin | | 0.75 |

Further, in order to improve preservability, processability, pressure resistance, antimold and antibacterial properties, antistatic property, and coating property, compounds of W"-1 to W"-5, B"-4 to B"-6, and F"-1 to F"-18, and salts of iron, lead, gold, platinum, palladium, iridium, rutheniumu, and rhodium were appropriately added in each layer. Also, $8.5\times10^{-3}$ g of calcium per mol of the silver halide in the coating solution for the eighth layer, and $7.9\times10^{-3}$ g of calcium per mol of the silver halide in the eleventh layer, were added in the form of an aqueous calcium nitrate solution, thereby the sample was prepared.

The AgI content, the grain size, the surface iodide content (percentage), and so on of the emulsions indicated by the above-described abbreviations, are shown in the following Table 8. The surface iodide content can be determined by XPS as described below. Namely, the samples were cooled to −115° C. in a vacuum of 1×10 torr or below, and then MgKα as a probe X ray was irradiated to the cooled samples at X ray source voltage of 8 kV and X ray electric current of 20 mA, and thereafter a measurement was carried out with respect to Ag 3d5/2, Br 3d, and I 3d5/2 electrons. An integral intensity of the measured peak was corrected with a sensitivity factor. The surface iodide content was determined, based on these intensity ratio.

TABLE 8

| Emulsion name | Average iodide content (MOL %) | Deviation coefficient concerning distribution of iodide among grains | Average grain diameter (sphere-equivalent diameter; μm) | Deviation coefficient of diameter corresponding to sphere (%) | Diameter of projected area assumed to be a circle (μm) | Ratio of diameter/ thickness | Surface iodide content (MOL %) | Grain sharp |
|---|---|---|---|---|---|---|---|---|
| Emulsion A" | 3.9 | 20 | 0.37 | 19 | 0.40 | 2.7 | 2.3 | Tabular grains |
| B" | 5.1 | 17 | 0.52 | 21 | 0.67 | 5.2 | 3.5 | " |
| C" | 7.0 | 18 | 0.86 | 22 | 1.27 | 5.9 | 5.2 | " |
| D" | 4.2 | 17 | 1.00 | 18 | 1.53 | 6.5 | 2.8 | " |
| E" | 7.2 | 22 | 0.87 | 22 | 1.27 | 5.7 | 5.3 | " |
| F" | 2.6 | 18 | 0.28 | 19 | 0.28 | 1.3 | 1.7 | " |
| G" | 4.0 | 17 | 0.43 | 19 | 0.58 | 3.3 | 2.3 | " |
| H" | 5.3 | 18 | 0.52 | 17 | 0.79 | 6.5 | 4.7 | " |
| I" | 5.5 | 16 | 0.73 | 15 | 1.03 | 5.5 | 3.1 | " |
| J" | 7.2 | 19 | 0.93 | 18 | 1.45 | 5.5 | 5.4 | " |
| K" | 1.7 | 18 | 0.40 | 16 | 0.52 | 6.0 | 2.1 | " |
| L" | 8.7 | 22 | 0.64 | 18 | 0.86 | 6.3 | 5.8 | " |
| M" | 7.0 | 20 | 0.51 | 19 | 0.82 | 5.0 | 4.9 | " |
| N" | 6.5 | 22 | 1.07 | 24 | 1.52 | 7.3 | 3.2 | " |
| O" | 1.0 | — | 0.07 | — | 0.07 | 1.0 | — | Uniform structure |
| P" | 0.9 | — | 0.07 | — | 0.07 | 1.0 | — | Uniform structure |

In Table 8, (1) Emulsions L" to O" were subjected to reduction sensitization using thiourea dioxide and thiosulfonic acid at the time of preparation of grains, according to the example described in JP-A-2-191938.

(2) Emulsions A" to O" were subjected to gold sensitization, sulfur sensitization and selenium sensitization, in the presence of respective spectral sensitizing dyes as described for each light-sensitive layer and sodium thiocyanate, according to the example described in JP-A-3-237450.

(3) At the preparation of tabular grains, low-molecular-weight gelatin was used, according to the example described in JP-A-1-158426.

(4) In tabular grains, there were observed dislocation lines by a high-pressure electron microscope, as described in JP-A-3-237450.

ExC'-1

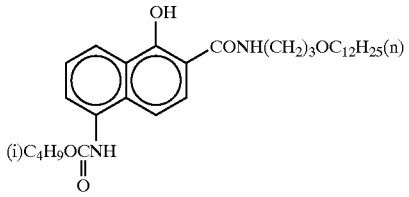

ExC'-2

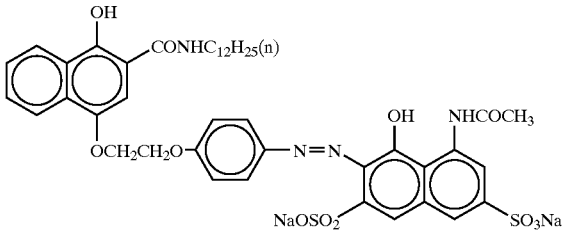

ExC'-3

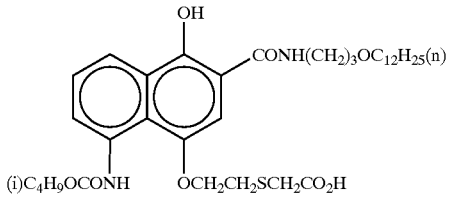

ExC'-4

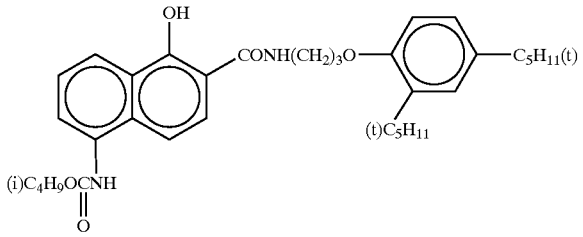

-continued
ExC′-5
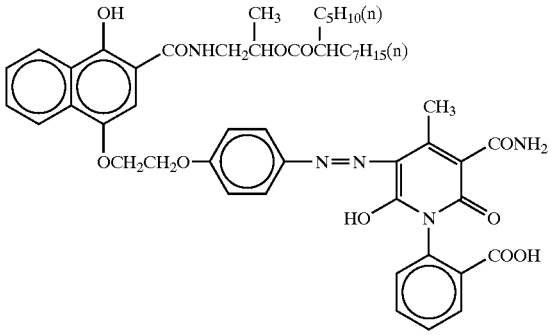
ExC′-6
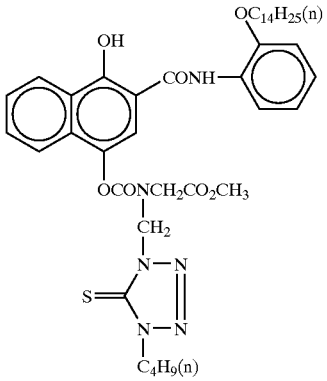
ExC′-7
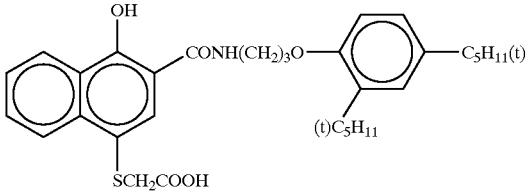
ExC′-8
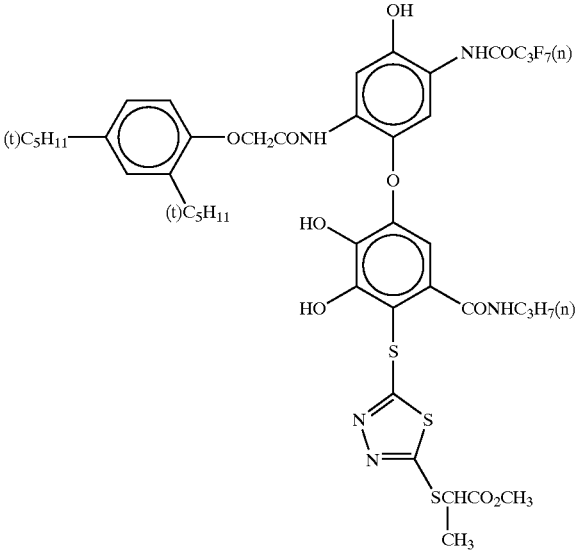
ExM′-1
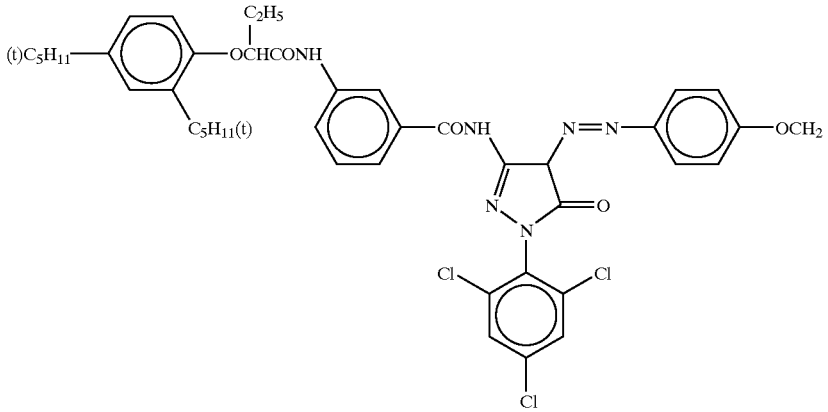

-continued
ExM′-2
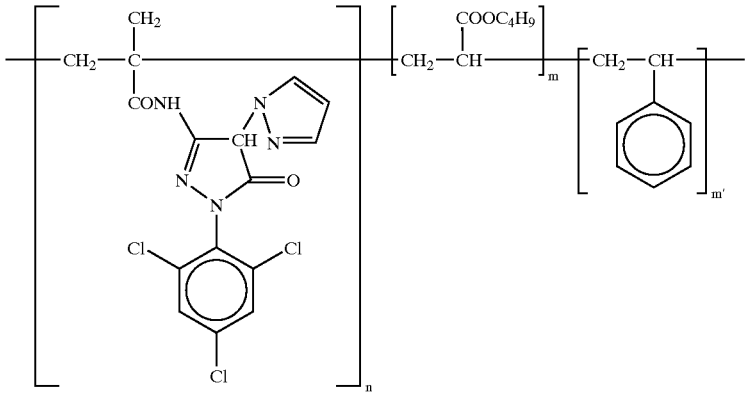
n = 50
m = 25
m′ = 25
mol. wt. c. a. 20,000
ExM′-3
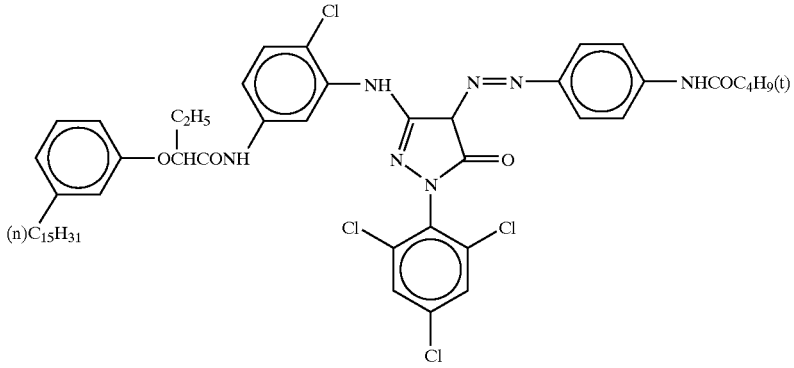
ExM′-4
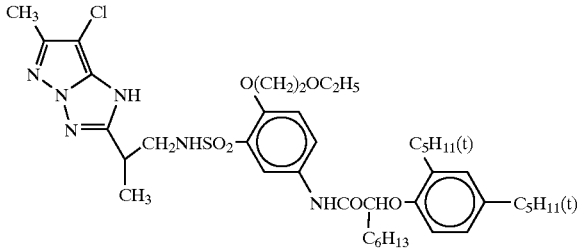
ExM′-5
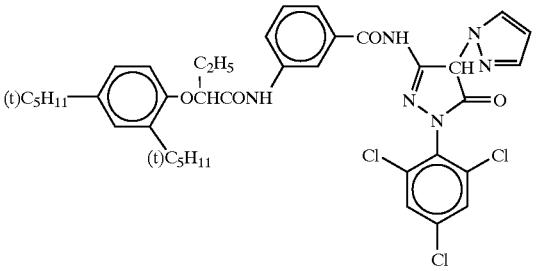
ExY′-1
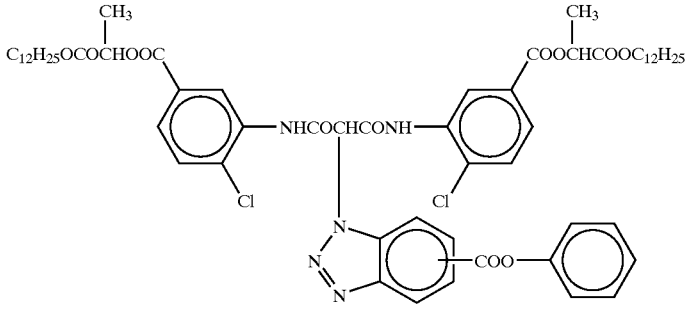

-continued
ExY′-2
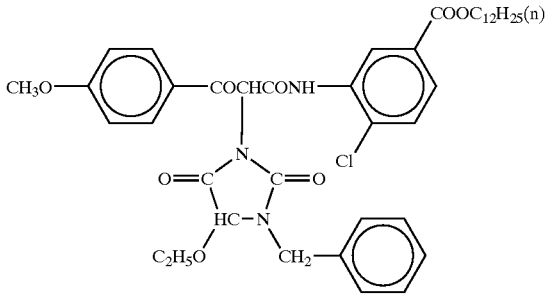
ExY′-3
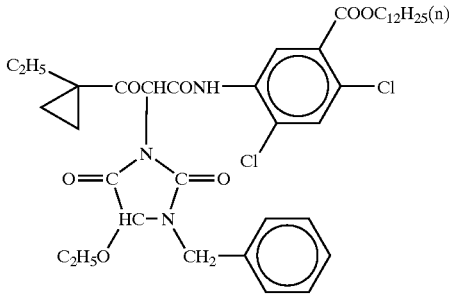
ExY′-4
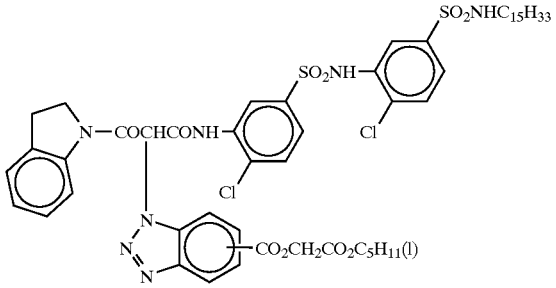
ExY′-5
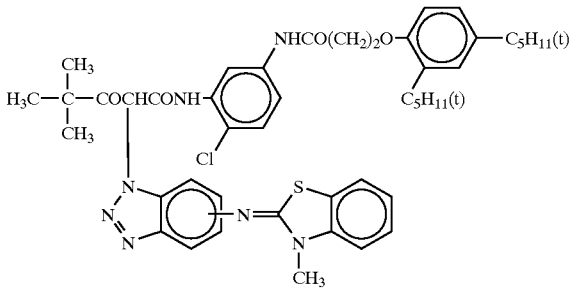
ExY′-6
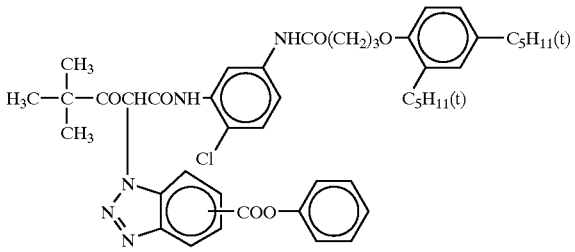
ExF′-1
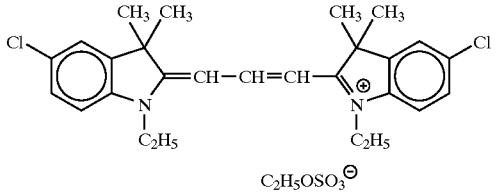
ExF′-8
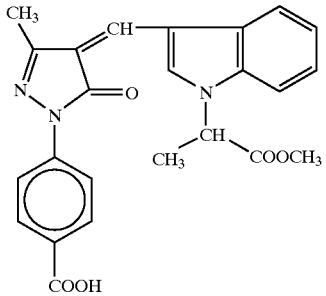
Cpd″-1
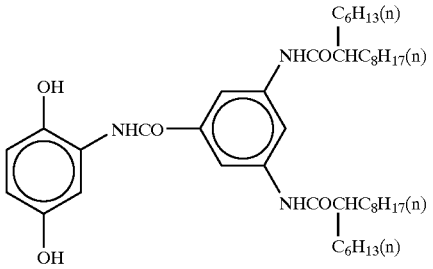
Cpd″-2
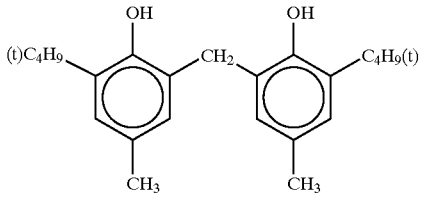
Cpd″-3
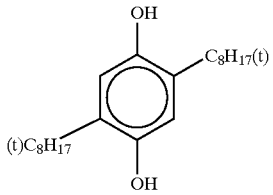
Cpd″-4
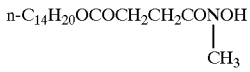
UV′-1
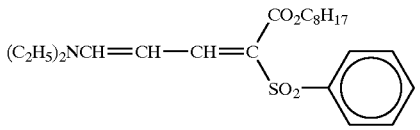

-continued
UV′-2
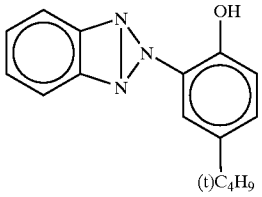
UV′-3
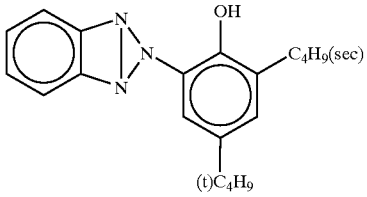
UV′-4
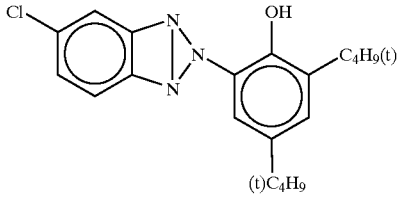
HBS′-1
Tricresyl phosphate
HBS′-2
Di-n-butyl phthalate
HBS′-3
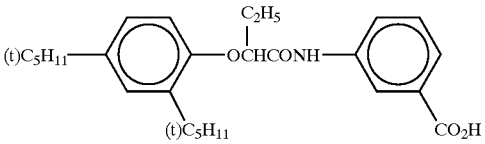
HBS′-4
Tri (2-ethylhexyl) phosphate
ExS′-1
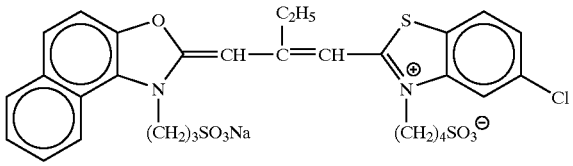
ExS′-2
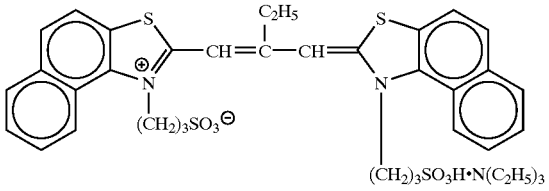
ExS′-3
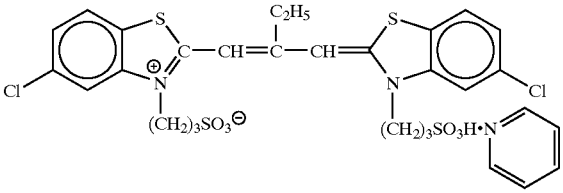
ExS′-4
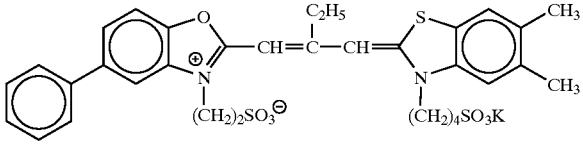
ExS′-5
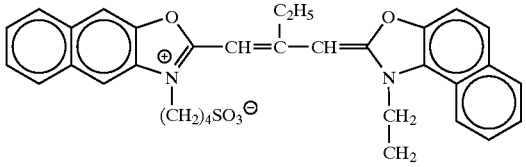
ExS′-6
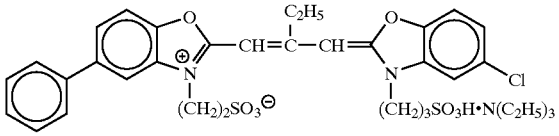
ExS′-7
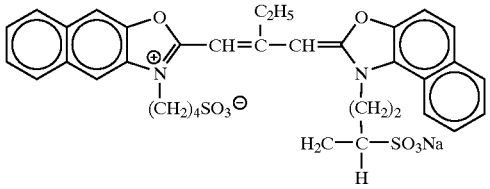
ExS′-8
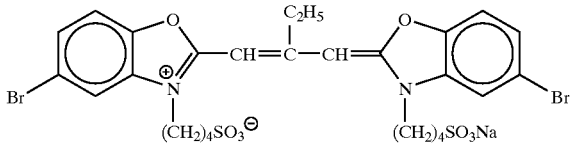
ExS′-9
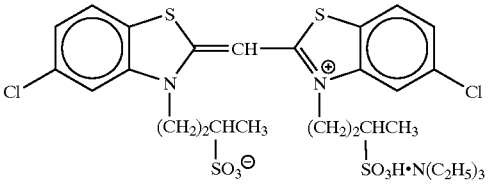

-continued
S′-1
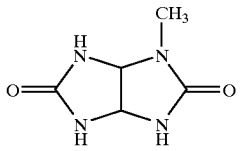
ExS′-10
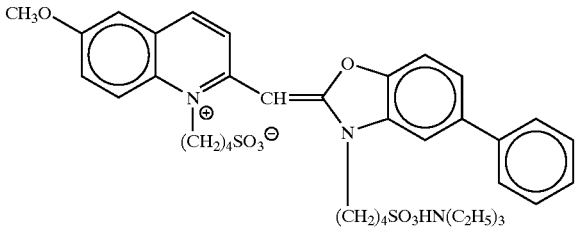
ExS′-11
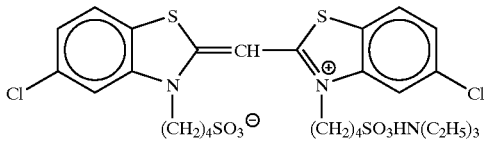
H″-1
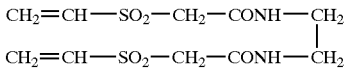
B″-1
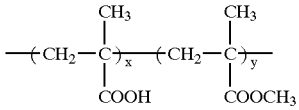
x/y = 10/90 (weight ratio)
Av. molecular weight:
c. a. 35,000
B″-2
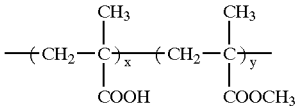
x/y = 40/60 (weight ratio)
Av. molecular weight:
c. a. 20,000
B″-3
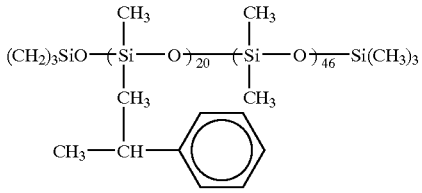
(molar ratio)
Av. molecular weight:
c. a. 8,000
B″-4
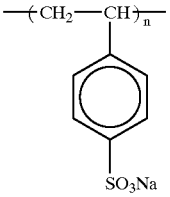
Av. molecular weight:
c. a. 750,000
B″-5
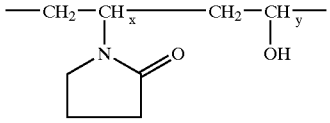
x/y = 70/30 (weight ratio)
Av. molecular weight:
c. a. 17,000
B″-6
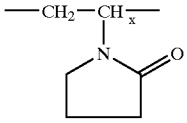
Av. molecular weight:
c. a. 10,000
W″-1
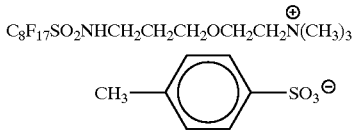
W″-2
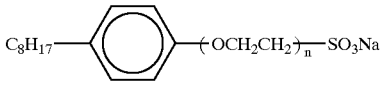
n = 2~4
W″-3
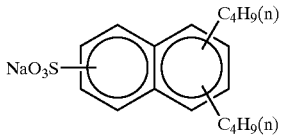
W″-4
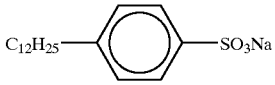
W″-5
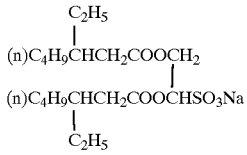
F″-1
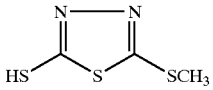

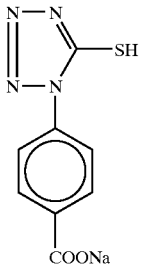
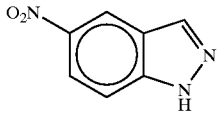
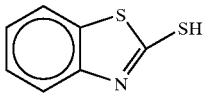
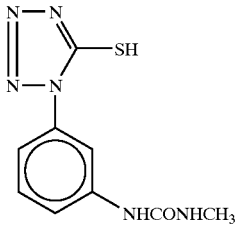
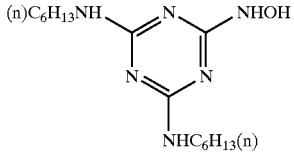
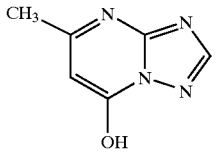
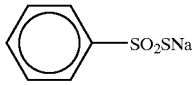
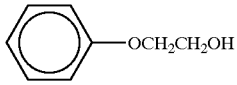
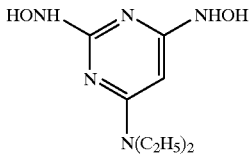
-continued
F″-2
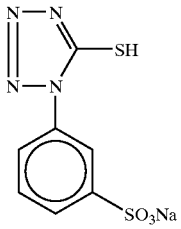
F″-3
F″-4
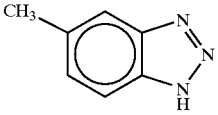
F″-5
F″-6
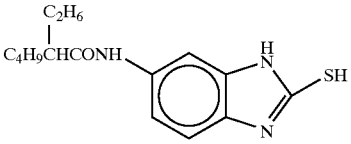
F″-7
F″-8
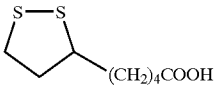
F″-9
F″-10
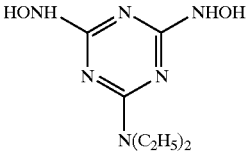
F″-11
F″-12
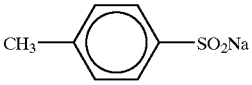
F″-13
F″-14
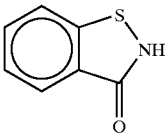
F″-15
F″-16
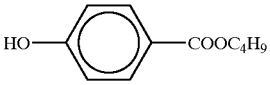
F″-17
F″-18

The development processing method of each samples is shown below.

(Processing Method)

| Processing step | Processing time | Processing temperature |
|---|---|---|
| Color developing | 3 min 15 sec | 38° C. |
| Bleaching | 3 min 00 sec | 38° C. |
| Washing | 30 sec | 24° C. |
| Fixing | 3 min 00 sec | 38° C. |
| Washing (1) | 30 sec | 24° C. |
| Washing (2) | 30 sec | 24° C. |
| Stabilizing | 30 sec | 38° C. |
| Drying | 4 min 20 sec | 50° C. |

The composition of each processing solutions is shown below.

| | (g) |
|---|---|
| (Color-developer) | |
| Diethylenetriaminepentaacetic acid | 1.0 |
| 1-Hydroxyethylidene-1,1-diphosphonic acid | 2.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-[N-ethyl-N-(β-hydroxyethyl) amino]-2-methylaniline sulfate | 4.5 |
| Water to make | 1.0 liter |
| pH | 10.5 |
| (pH was adjusted by potassium hydroxide and sulfuric acid.) | |
| (Bleaching solution fixing solution) | |
| Ethylenediaminetetraacetic acid iron (III) sodium trihydrate | 100.0 |
| Disodium ethylenediaminetetraacetate | 10.0 |
| 3-Mercapto-1,2,4,-triazole | 0.03 |
| Ammonium bromide | 140.0 |
| Ammonium nitrate | 30.0 |
| Aqueous ammonia (27%) | 6.5 ml |
| Water to make | 1.0 liter |
| pH | 6.0 |
| (pH was adjusted by aqueous ammonia and nitric acid.) | |
| (Fixing solution) | |
| Disodium ethylenediaminetetraacetate | 0.5 |
| Ammonium sulfite | 20.0 |
| Aqueous ammonium thiosulfate solution (700 g/liter) | 295.0 ml |
| Acetic acid (90%) | 3.3 |
| Water to make | 1.0 liter |
| pH | 6.7 |
| (pH was adjusted by aqueous ammonia and acetic acid.) | |
| (Stabilizing solution) | |
| p-nonylphenoxypolyglycidol (glycidol av. polymerization degree: 10) | 0.2 |
| Ethylenediaminetetraacetic acid | 0.05 |
| 1,2,4-Triazole | 1.3 |
| 1,4-Bis(1,2,4-triazole-1-ylmethyl)pyperazine | 0.75 |
| Hydroxyacetic acid | 0.02 |
| Hydroxyethylcellulose (manufactured by Daicell Chemicals Co., Ltd., tradename, HEC-SP-2000) | 0.1 |
| 1,2-Benzisothiazoline-3-one | 0.05 |
| Water to make | 1.0 liter |
| pH | 8.5 |

The above Sample 501 employing a dispersion of the present invention was excellent in sensitivity, granularity and sharpness. Further, no surface defect was observed in the sample 501.

Example 6

In Example 1 described in JP-A-9-222694, a dispersion of S-10 was employed in place of the dispersion of dye C. As a result, a desired preferable crossover-cut property was obtained in the resultant sample.

Example 7

In Example 1, Compound C-10 was employed in place of IX-1 of the dispersion S-16, and the resulting mixture was dispersed in the same manner as in Example 1, to obtain Dispersion S-19. In Sample 301 of Example 3, C-10 was coated in the form of the dispersion S-19 as for the layer in which C-10 was employed, to thereby prepare Sample 701. As a result, no surface defect was observed, and the image quality was excellent in the sample 701.

Having described our invention as related to the present embodiments, it is our intention that the invention not be limited by any of the details of the description, unless otherwise specified, but rather be construed broadly within its spirit and scope as set out in the accompanying claims.

What we claim is:

1. A method of preparing a photographic solid fine-grain dispersion, the method comprising the steps of:

successively bringing a slurry of a water-insoluble photographically useful compound in a grinding chamber of a dispersing machine, which chamber is filled with media, allowing the compound to contact the media in the grinding chamber, to produce fine grains of the compound successively, successively separating the media from the compound by centrifugal force, and taking the compound out of the grinding chamber, wherein the bulk density of the media is 4.0 g/cm$^3$ or more, the Vickers hardness thereof is 10 GPa or more, the breaking tenacity thereof is 5 MPa m$^{1/2}$ or more, and the average grain size thereof is 0.3 mm or less, and wherein the fine grains in the solid dispersion prepared have an average grain size of 0.01 μm to 1 μm.

2. The method of preparing a photographic solid fine-grain dispersion as claimed in claim 1, wherein the member that contacts the media of the dispersing machine, is composed of a material selected from a ceramic whose main component is substantially a zirconia or an alumina, a polyurethane, a polytetrafluoroethylene, and a polyethylene.

3. The method of preparing a photographic solid fine-grain dispersion as claimed in claim 1, wherein the dispersion machine has such a mechanism that the same comprises a cylindrical container having a feed port and a discharge port for slurry, a screen covering the discharge port and projecting inward a dispersing container, and a rotatable shaft equipped with a plurality of stirrers; wherein at the feed port side of the cylindrical container, the grinding chamber filled with the media is arranged, and at the discharge port side of the cylindrical container, a media-separating chamber in which substantially no media exist, is arranged, respectively; wherein a disc-like rotor mounted on the rotatable shaft at the closest side to the discharge port is equipped with a stirrer member, the tip of which extends to the vicinity of a lateral face at the discharge port side of the screen; wherein, by rotation of the stirrer member, centrifugal force is applied to the media introduced into the separating chamber, and thereby the media is returned to the grinding chamber.

4. The method of preparing a photographic solid fine-grain dispersion as claimed in claim 3, wherein the member that contacts the media of the dispersing machine, is composed of a material selected from a ceramic whose main component is substantially a zirconia or an alumina, a polyurethane, a polytetrafluoroethylene, and a polyethylene.

5. The method of preparing a photographic solid fine-grain dispersion as claimed in claim 1, wherein the dispersing machine comprises a grinding chamber filled with beads and having a feed port and a discharge port for slurry, a rotatable shaft equipped with an stirrer, and a media-separating chamber containing substantially no media, which chamber is separated by a wall from the grinding chamber and which chamber is installed with an impeller that applies by rotation a centrifugal force to the media introduced into the separating chamber to return the media to the grinding chamber taking out the slurry through a discharge passage formed in the rotatable shaft.

6. The method of preparing a photographic solid fine-grain dispersion as claimed in claim 5, wherein the member that contacts the media of the dispersing machine, is composed of a material selected from a ceramic whose main component is substantially a zirconia or an alumina, a polyurethane, a polytetrafluoroethylene, and a polyethylene.

7. The method of preparing a photographic solid fine-grain dispersion as claimed in claim 1, wherein the grinding chamber is filled with media at a filling rate in the range of 70–90%.

8. The method of preparing a photographic solid fine-grain dispersion as claimed in claim 1, wherein said media is separated from the compound in a media-separating chamber in which centrifugal force is applied to the media thereby returning the media from the media-separating chamber to the grinding chamber.

* * * * *